US006095121A

United States Patent [19]

Osanai

[11] Patent Number: 6,095,121

[45] Date of Patent: Aug. 1, 2000

[54] EVAPORATED FUEL TREATMENT DEVICE OF AN ENGINE

[75] Inventor: Akinori Osanai, Susono, Japan

[73] Assignee: Toyota Jidosha Kabushiki Kaisha, Aichi-ken, Japan

[21] Appl. No.: 09/157,722

[22] Filed: Sep. 21, 1998

[30] Foreign Application Priority Data

Sep. 22, 1997 [JP] Japan ..... 9-256792
Jan. 30, 1998 [JP] Japan ..... 10-019567

[51] Int. Cl.[7] ..... F02M 33/02

[52] U.S. Cl. ..... 123/520; 123/357

[58] Field of Search ..... 123/518, 519, 123/520, 521, 516, 357

[56] References Cited

U.S. PATENT DOCUMENTS 5,251,592 10/1993 Seki ..... 123/520
5,611,320 3/1997 Hara et al. .
5,634,454 6/1997 Fujita .
5,655,507 8/1997 Kawasaki .
5,676,118 10/1997 Saito ..... 123/520
5,680,849 10/1997 Morikawa ..... 123/520
5,685,285 11/1997 Ohtani, et al. .
5,694,911 12/1997 Kawamoto et al. .
5,699,778 12/1997 Muraguchi et al. .
5,727,537 3/1998 Nakagawa et al. .
5,735,255 4/1998 Farmer et al. .
5,746,187 5/1998 Ninomiya ..... 123/520
5,884,609 3/1999 Kawamoto ..... 123/520
5,909,726 6/1999 Kobayashi ..... 123/520
5,909,727 6/1999 Naragawa ..... 123/520
5,921,222 7/1999 Freenano ..... 123/520

FOREIGN PATENT DOCUMENTS 5223021 8/1993 Japan .
5248312 9/1993 Japan .
7269419 10/1995 Japan .

OTHER PUBLICATIONS

U.S. Ser. No. 403,097, Akinori Osanai, filed Mar. 13, 1995.
U.S. Ser. No. 548,887, Akinori Osanai, filed Oct. 26, 1995.
U.S. Ser. No. 910,245, Akinori Osanai, filed Aug. 13, 1997.
U.S. Ser. No. 984,326, Akinori Osanai, filed Dec. 3, 1997.

*Primary Examiner*—Carl S. Miller
*Attorney, Agent, or Firm*—Kenyon & Kenyon

[57] ABSTRACT

An evaporated fuel treatment device comprising a purge control valve for controlling an amount of fuel vapor fed into the intake passage from a charcoal canister, wherein the pressure in the fuel vapor chamber of the canister is detected and wherein the vapor concentration, which is one of the values for correction of the amount of fuel injection, is increased when the pressure in the fuel vapor chamber increases while the purge operation is stopped.

27 Claims, 48 Drawing Sheets

EVAPORATED FUEL TREATMENT DEVICE OF AN ENGINE

BACKGROUND OF THE INVENTION

1. Field of the Invention

The present invention relates to an evaporated fuel treatment device of an engine.

2. Description of the Related Art

Known in the art is an internal combustion engine provided with a canister for temporarily storing evaporated fuel generated in a fuel tank and a purge control valve for controlling the amount of purge of the fuel vapor to be purged from the canister to the inside of an intake passage, which stores in advance the relationship between the amount of evaporated fuel absorbed in the canister and the concentration of the vapor in the intake passage when the purge action is being performed, finds the initial concentration of vapor immediately after the start of the purge from the amount of deviation of the air-fuel ratio, uses the above relationship stored in advance to find the initial amount of absorbed evaporated fuel of the canister from the initial concentration of vapor, then finds the amount of reduction of the amount of absorbed evaporated fuel of the canister per unit time from the initial concentration of vapor, then uses the relationship stored in advance to predict the concentration of vapor from the reduced amount of absorbed evaporated fuel of the canister, finds the amount of reduction of the amount of absorbed evaporated fuel of the canister per unit time once again from the predicted concentration of vapor, then uses the relationship stored in advance to predict the concentration of vapor once again from the reduced amount of absorbed evaporated fuel of the canister, and corrects the amount of fuel supplied based on the predicted concentration of vapor so that the air-fuel ratio becomes a target air-fuel ratio (see Japanese Unexamined Patent Publication (Kokai) No. 5-248312).

That is, in transitional operation, sometimes the air-fuel ratio fluctuates despite the concentration of vapor not changing. If however the concentration of vapor is calculated based on the amount of deviation of the air-fuel ratio, it is judged that the concentration of vapor has changed even in such a case. If the concentration of vapor is updated at this time, the air-fuel ratio will conversely fluctuate. Therefore, in the above internal combustion engine, it is assumed that the amount of absorbed evaporated fuel of the canister gradually falls after the purge action has started and, based on this assumption, it is predicted that the concentration of vapor gradually falls along with the elapse of time and the amount of evaporated fuel is corrected based on this predicted concentration of vapor so that fluctuation of the air-fuel ratio is suppressed.

When for example the temperature of the fuel is high, however, a large amount of evaporated fuel is absorbed in the canister when the purge is temporarily stopped and therefore the amount of absorbed evaporated fuel of the canister increases. In the above internal combustion engine, however, even in this case, the amount of absorbed evaporated fuel of the canister is considered to gradually fall. Since the predicted value of the concentration of vapor also is made to gradually fall, when the purge is restarted, the predicted value of the concentration of vapor deviates considerably from the actual concentration of vapor and therefore the problem arises of a considerable fluctuation in the air-fuel ratio.

SUMMARY OF THE INVENTION

An object of the present invention is to provide an evaporated fuel treatment device capable of preventing an air-fuel ratio from fluctuating when the purge operation of fuel vapor is started again after the purge operation of fuel vapor is temporarily stopped.

According to the present invention, there is provided an evaporated fuel treatment device for an engine provided with an intake passage, comprising a purge passage of fuel vapor connecting an upper space of a fuel tank and the intake passage; a purge control valve arranged in the purge passage; air-fuel ratio detecting means for detecting an air-fuel ratio; first fuel supply correcting means for controlling an amount of fuel supply based on an air-fuel ratio detected by the air-fuel ratio detecting means so that an air-fuel ratio becomes a target air-fuel ratio; vapor concentration calculating means for calculating a vapor concentration of fuel vapor supplied to the intake passage from an amount of deviation of the air-fuel ratio from the target air-fuel ratio; second fuel supply correcting means for correcting the amount of fuel supply based on the vapor concentration so that the air-fuel ratio becomes the target air-fuel ratio; and concentration change detecting means for detecting a change of vapor concentration of fuel vapor occurring at one of a purge passage from the upper space of the fuel tank to the purge control valve and the upper space of the fuel tank while a purge operation is stopped; one of the first fuel supply correcting means and the second fuel supply correcting means correcting the amount of fuel supply in accordance with a change in the vapor concentration so that the air-fuel ratio immediately after the purge is restarted becomes the target air-fuel ratio.

BRIEF DESCRIPTION OF THE DRAWINGS

The present invention may be more fully understood from the description of preferred embodiments of the invention set forth below together with the accompanying drawings, in which.

DESCRIPTION OF THE PREFERRED EMBODIMENTS

Figure 1:
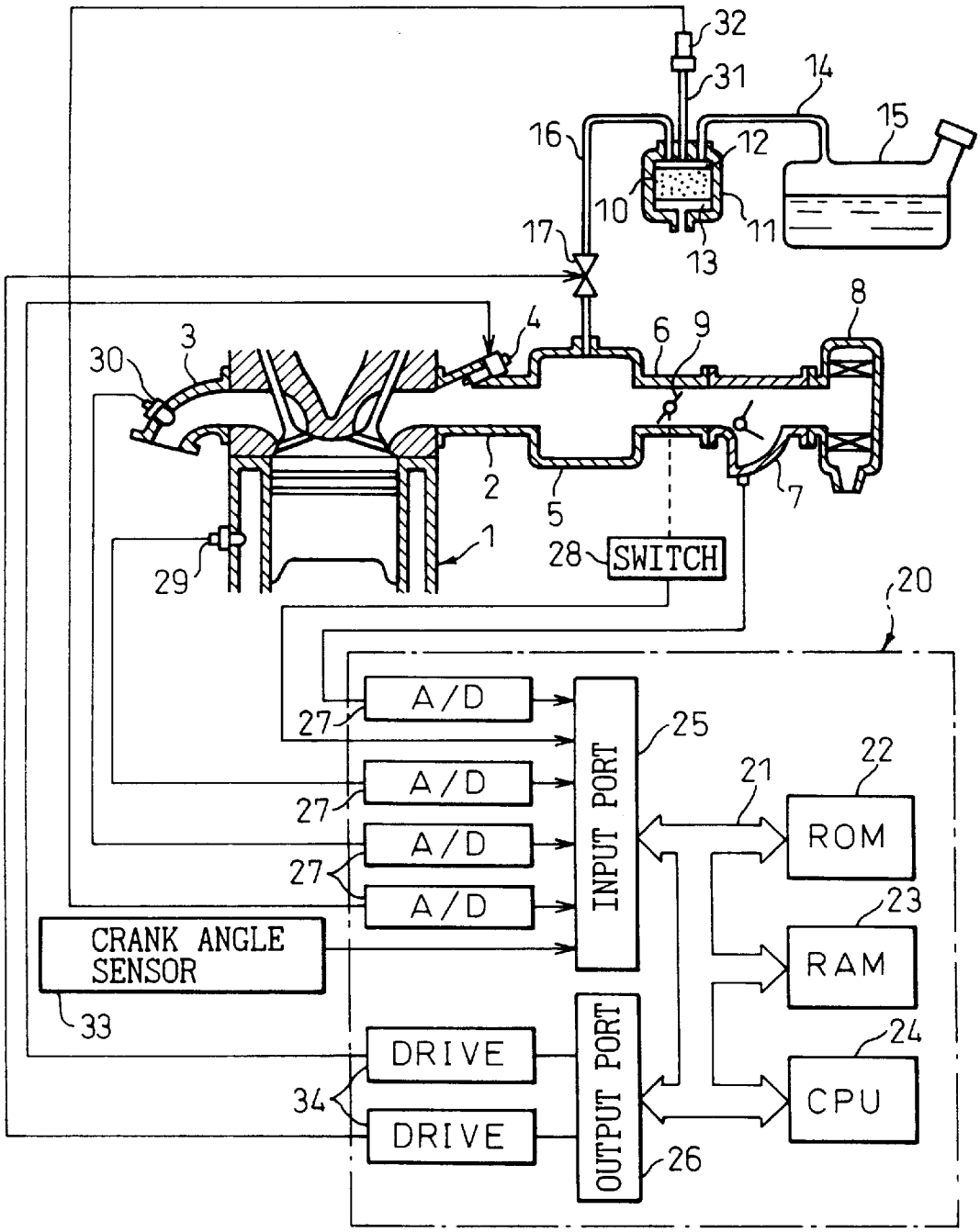
FIG. 1 is an overall view of an internal combustion engine.

Referring to FIG. 1, 1 is an engine body, 2 an intake tube, 3 an exhaust manifold, and 4 a fuel injector attached to each of the intake tubes 2. Each intake tube 2 is connected to a common surge tank 5. The surge tank 5 is connected through an intake duct 6 and an air flow meter 7 to an air cleaner 8. In the intake duct 6 is arranged a throttle valve 9. Further, as shown in FIG. 1, the internal combustion engine has disposed in it a canister 11 containing activated carbon 10. The canister 11 has a fuel vapor chamber 12 and an atmospheric chamber 13 on the two sides of the activated carbon 10. The fuel vapor chamber 12 on the one hand is connected through a conduit 14 to the upper space of a fuel tank 15 and on the other hand through a conduit 16 to the inside of the surge tank 5. In the conduit 16 is disposed a purge control valve 17 which is controlled by output signals from an electronic control unit 20. The fuel vapor which is generated in the fuel tank 15 is sent through the conduit 14 into the canister 11 where it is absorbed by the activated carbon 10. When the purge control valve 17 opens, the air is sent from the atmospheric chamber 13 through the activated carbon 10 into the conduit 16. When the air passes through the activated carbon 10, the fuel vapor which is absorbed in the activated carbon 10 is released from the activated carbon 10 therefore air containing the evaporated fuel, that is, the fuel vapor, is purged through the conduit 16 to the inside of the surge tank 5.

The electronic control unit 20 is comprised of a digital computer and is provided with a read only memory (ROM) 22, a random access memory (RAM) 23, a microprocessor (CPU) 24, an input port 25, and an output port 26 connected to each other through a bidirectional bus 21. The air flow meter 7 generates an output voltage proportional to the amount of intake air. This output voltage is input through a corresponding AD converter 27 to the input port 35. The throttle valve 9 has attached to it a throttle switch 28 which is turned on when the throttle valve 9 is at the idling opening. The output signal of the throttle switch 28 is input to the input port 25. The engine body 1 has attached to it a water temperature sensor 29 for generating an output voltage proportional to the coolant water temperature of the engine. The output voltage of the water temperature sensor 29 is input through the corresponding AD converter 27 to the input port 25. The exhaust manifold 3 has an air-fuel ratio sensor 30 attached to it. The output signal of the air-fuel ratio sensor 30 is input through the corresponding AD converter 27 to the input port 25.

Further, the fuel vapor chamber 12 is connected through a conduit 31 to a pressure sensor 32. The pressure sensor 32 detects the pressure inside the fuel vapor chamber 12. The pressure sensor 32 generates an output voltage proportional to the pressure in the fuel vapor chamber 12, that is, the pressure of the upper space of the fuel tank 15 or the conduit 16 from the upper space of the fuel tank 15 to the purge control valve 17. This output voltage is input through an AD converter 27 to the input port 25. Further, the input port 25 has connected to it a crank angle sensor 33 generating an output pulse every time the crankshaft rotates by for example 30 degrees. In the CPU 24, the engine speed is calculated based on this output pulse. On the other hand, the output port 26 is connected through the corresponding drive circuit 34 to the fuel injectors 4 and the purge control valve 17.

In the internal combustion engine shown in FIG. 1, the fuel injection time TAU is basically calculated based on the following equation:

$$TAU=TP\cdot FW\cdot(FAF+KGj-FPG)$$

where, the coefficients show the following:

TP: basic fuel injection time
FW: correction coefficient
FAF: feedback correction coefficient
KGj: learning coefficient of air-fuel ratio
FPG: purge air-fuel ratio correction coefficient (hereinafter referred to as the purge A/F correction coefficient)

The basic fuel injection time TP is the experimentally found injection time required for making the air-fuel ratio the target air-fuel ratio. The basic fuel injection time TP is stored in advance in the ROM 22 as a function of the engine load QIN (intake air amount Q/engine speed N) and the engine speed N.

The correction coefficient FW expresses the engine warmup increase coefficient and the acceleration increase coefficient all together. When no upward correction is needed, FW is made 1.0.

The feedback correction coefficient FAF is set to control the air-fuel ratio to the target air-fuel ratio based on the output signal of the air-fuel ratio sensor 30.

The purge A/F correction coefficient FPG is made 0 in the interval from when the engine started operating to when the purge is started. When the purge operation is started, it becomes larger the higher the concentration of the fuel vapor. Note that when the purge operation is temporarily stopped during the engine operation, FPG is made 0 while the purge operation is stopped.

As explained above, however, the feedback control coefficient FAF is for controlling the air-fuel ratio to the target air-fuel ratio based on the output signal of the air-fuel ratio sensor 30. In this case, as the target air-fuel ratio, any air-fuel ratio may be used, but in the embodiment shown in FIG. 1, the target air-fuel ratio is made the stoichiometric air-fuel ratio, therefore the explanation will be made of the case of making the target air-fuel ratio the stoichiometric air-fuel ratio hereinafter. Note that when the target air-fuel ratio is the stoichiometric air-fuel ratio, as the air-fuel ratio sensor 30, a sensor whose output voltage changes in accordance with the concentration of oxygen in the exhaust gas is used, therefore hereinafter the air-fuel ratio sensor 30 will be referred to as an $O_2$ sensor. This $O_2$ sensor 30 generates an output voltage of about 0.9V when the air-fuel ratio is rich and generates an output voltage of about 0.1V when the air-fuel ratio is lean.

Figure 2:
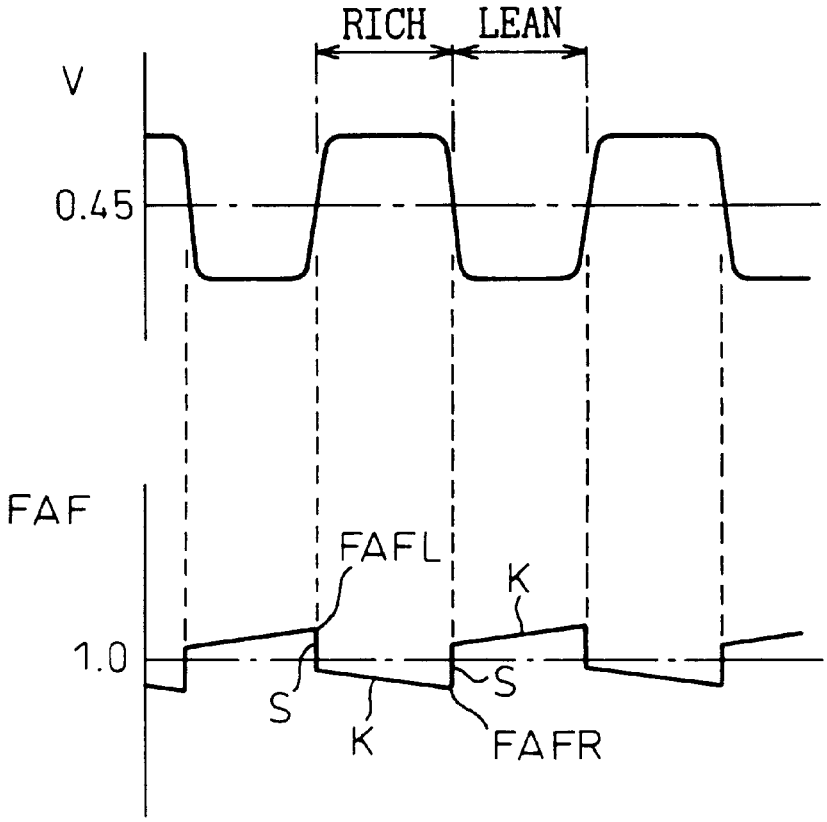
FIG. 2 is a view of the changes in a feedback correction coefficient FAF.

FIG. 2 shows the relationship between the output voltage V of the $O_2$ sensor 30 and the feedback control coefficient FAF when the air-fuel ratio is maintained at the target air-fuel ratio. As shown in FIG. 2, when the output voltage V of the $O_2$ sensor 30 becomes higher than a reference voltage, for example, 0.45V, that is, when the air-fuel ratio becomes rich, the feedback control coefficient FAF is rapidly reduced by the skip amount S, then is gradually reduced by the integration constant K. As opposed to this, when the output voltage V of the $O_2$ sensor 30 becomes lower than the reference voltage, that is, when the air-fuel ratio becomes lean, the feedback control coefficient FAF is rapidly increased by the skip amount S and then gradually increased by the integration constant K.

That is, when the air-fuel ratio becomes rich, the feedback control coefficient FAF is reduced, so the amount of fuel injection is reduced, while when the air-fuel ratio becomes lean, the feedback control coefficient FAF is increased and the amount of fuel injection is increased. Therefore, the air-fuel ratio is maintained at the stoichiometric air-fuel ratio. As shown in FIG. 2, at this time, the feedback control coefficient FAF fluctuates about a reference value, that is, 1.0.

Further, in FIG. 2, FAFL shows the value of the feedback control coefficient FAF when the air-fuel ratio changes from lean to rich, while FAFR shows the value of the feedback control coefficient FAF when the air-fuel ratio changes from rich to lean. In the embodiment of the present invention, as the average of the fluctuation of the feedback control coefficient FAF (hereinafter referred to simply as the average value), the average value between FAFL and FAFR is used.

Figure 3:
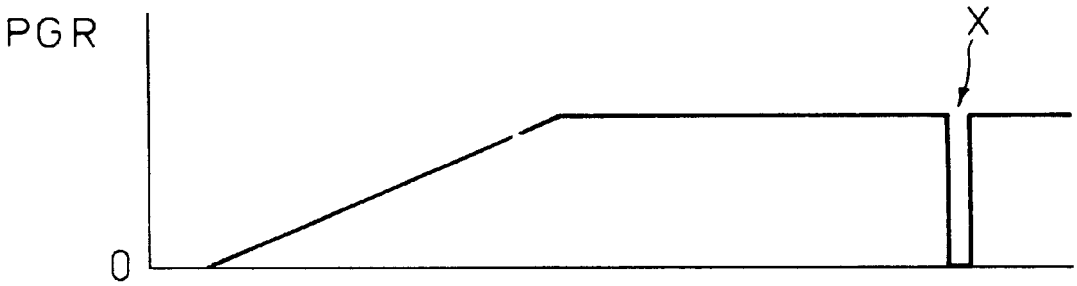
FIG. 3 is a view of changes in a purge rate PGR.

FIG. 3 summarizes the purge operation. Note that in FIG. 3, PGR shows the purge rate of the fuel vapor. As shown in FIG. 3, in the embodiment of the present invention, when the purge action is started for the first time after the start of engine operation, the purge rate PGR is gradually increased from zero. When the purge rate PGR reaches a certain value, for example, 6 percent, the purge rate PGR is maintained at the target purge rate.

Next, for example, in the case where the supply of fuel is stopped at the time of a deceleration operation, the purge rate PGR is temporarily made zero. Next, the purge operation is restarted by the purge rate PGR immediately before the purge operation was stopped.

Next, an explanation will be made of the method of learning the concentration of the fuel vapor referring to FIG. 4.

The learning of the concentration of the fuel vapor starts with the accurate determination of the vapor concentration per unit purge rate. The vapor concentration per unit purge rate is shown by FGPG in FIG. 4. The purge A/F correction coefficient FPG is obtained by multiplying the purge rate PGR with FGPG.

The vapor concentration per unit purge rate FGPG is calculated based on the following formula every time the feedback correction coefficient FAF skips (S in FIG. 2):

$$tFG=(1-FAFAV)/(PGR\cdot a)$$

$$FGPG=FGPG+tFG$$

Here, tFG shows the amount of update of FGPG performed with every skip of FAF, while FAFAV shows the average value of the feedback correction coefficient (=(FAFL+FAFR)/2). In this embodiment of the present invention, a is set to 2.

That is, when the purge is started, since the air-fuel ratio becomes rich, the feedback correction coefficient FAF for making the air-fuel ratio the stoichiometric air-fuel ratio becomes smaller. Next, at the time $t_1$, when it is judged from the $O_2$ sensor 31 that the air-fuel ratio has changed from rich to lean, the feedback correction coefficient FAF is increased. In this case, the amount of change ΔFAF (ΔFAF=(1.0−FAF)) of the feedback correction coefficient FAF from when the purge is started to the time $t_1$ shows the amount of change of the air-fuel ratio due to the purge operation. This amount of change AFAF shows the concentration of fuel vapor at the time $t_1$.

When the time $t_1$ is reached, the air-fuel ratio is maintained at the stoichiometric air-fuel ratio, then the vapor concentration per unit purge rate FGPG is gradually updated every skip of the feedback correction coefficient FAF to restore the average value FAFAV of the feedback correction coefficient to 1.0 so that the air-fuel ratio does not deviate from the stoichiometric air-fuel ratio. The amount of update per time tFG of the FGPG at this time is made half of the amount of deviation of the average value FAFAV of the feedback correction coefficient with respect to 1.0, therefore the amount of update tFG becomes tFG (1−FAFAV)/(PGR·2) as explained above.

Figure 4:
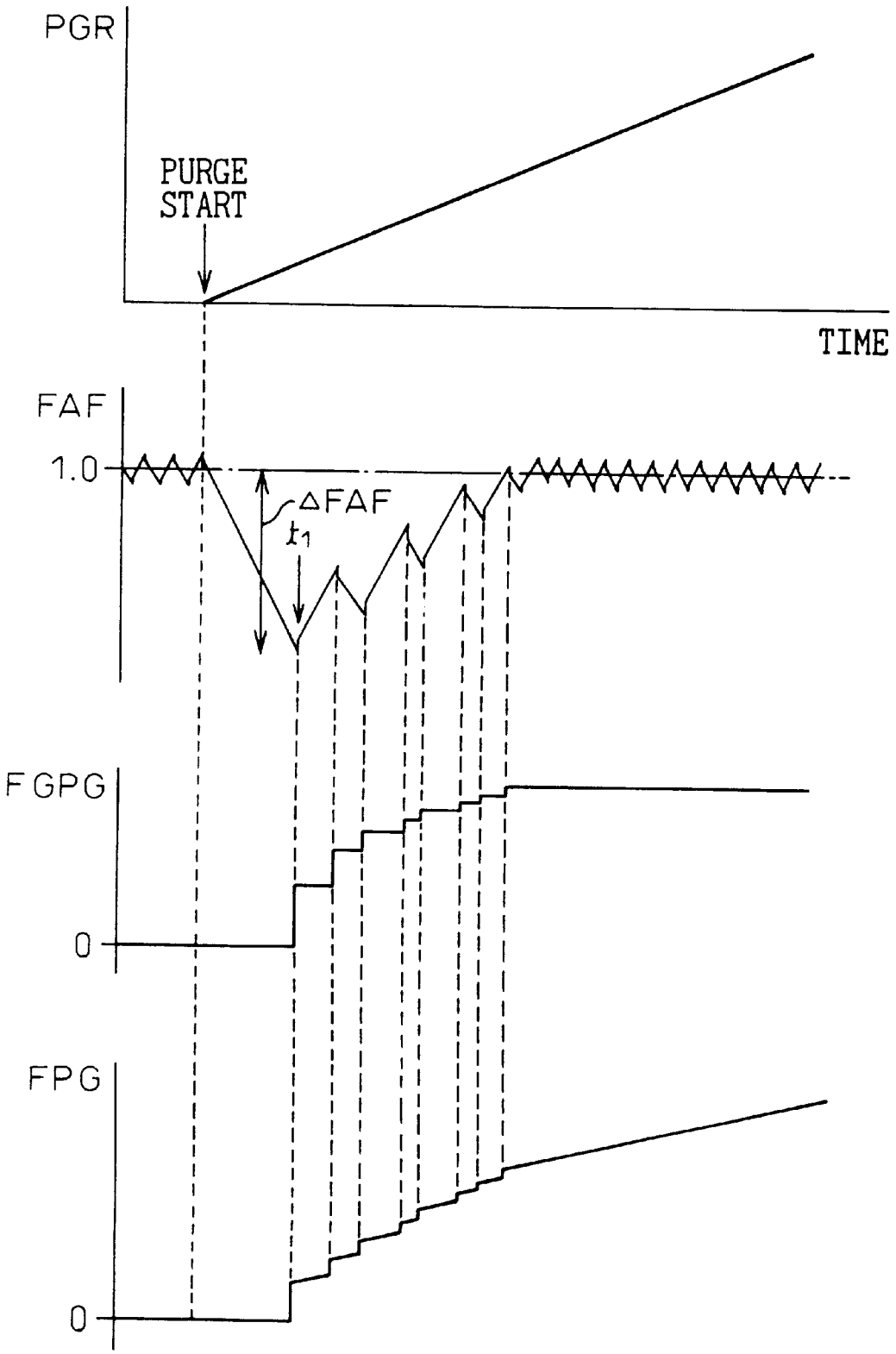
FIG. 4 is a view of changes in the feedback correction coefficient FAF etc. at the time of start of a purge action.

As shown in FIG. 4, when the update operation of the FGPG is repeated several times, the average value of the feedback correction coefficient FAFAV returns to 1.0, then the vapor concentration per unit purge rate FGPG becomes constant. The FGPG becoming constant in this way means that the FGPG at this time accurately shows the vapor concentration per unit purge rate and therefore means that the learning of the vapor concentration has ended. On the other hand, the actual concentration of the fuel vapor becomes the vapor concentration per unit purge rate FGPG multiplied by the purge rate PGR. Therefore, the purge A/F correction coefficient FPG (=FGPG·PGR) showing the actual concentration of fuel vapor is updated every time FGPG is updated and increases along with an increase of the purge rate PGR as shown in FIG. 4.

Even after the learning of the vapor concentration after the start of the purge once ends, if the vapor concentration changes, the feedback correction coefficient FAF deviates from 1.0. Even at this time, the above tFG (=(1−FAFAV)/(PGR·a)) is used to calculate the amount of update of the FGPG.

Next, an explanation will be made of the routine for the control of the purge referring to FIG. 5 and FIG. 6. Note that this routine is executed by interruption every predetermined time interval.

Figure 5:
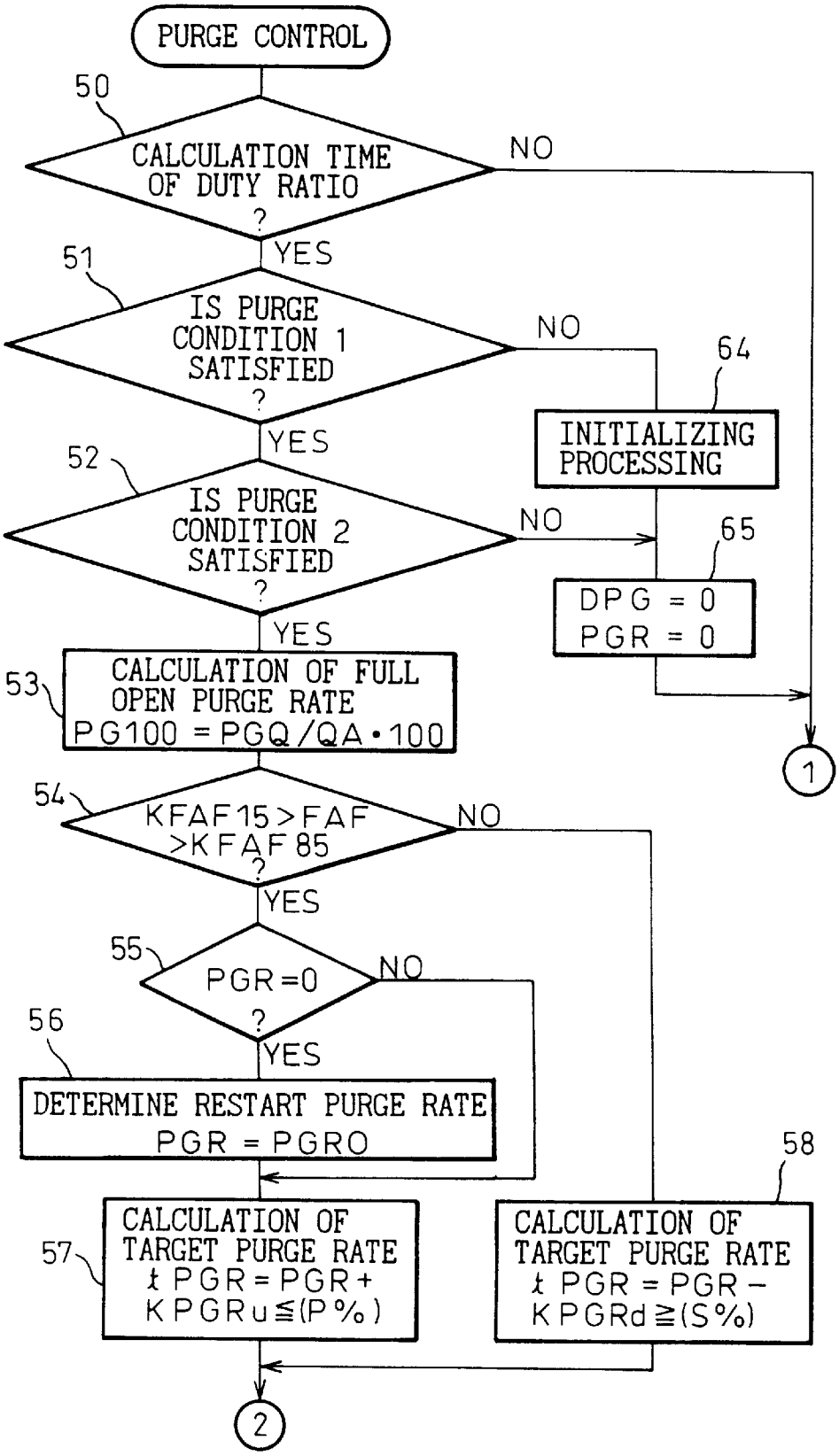
FIGS. 5 and 6 are flow charts of purge control.
Figure 6:
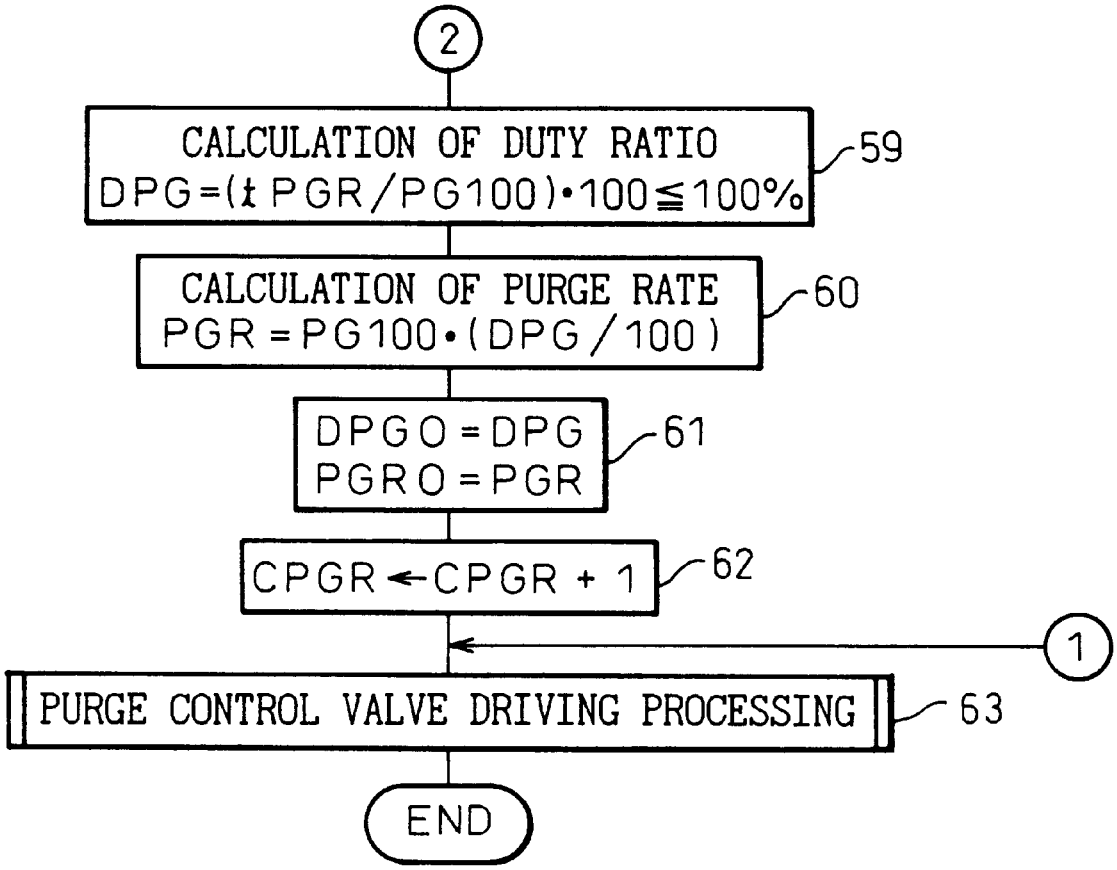

Referring to FIG. 5 and FIG. 6, first, at step 50, it is judged whether the time is the time of calculation of the duty ratio of the drive pulse of the purge control valve 17 or not. In the embodiment according to the present invention, the duty ratio is calculated every 100 msec. When not the time for calculation of the duty ratio, the routine jumps to step 63, where the processing for driving the purge control valve 17 is executed. As opposed to this, when it is the time for calculation of the duty ratio, the routine proceeds to step 51, where it is judged if the purge condition 1 is satisfied or not, for example, if the engine warmup has been completed or not. When the purge condition 1 is not satisfied, the routine proceeds to step 64, where the initialization processing is performed, then at step 65, the duty ratio DPG and the purge rate PGR are made zero. As opposed to this, when the purge condition 1 is satisfied, the routine proceeds to step 52, where it is judged if the purge condition 2 is satisfied or not, for example, whether feedback control of the air-fuel ratio is being performed or not. When the purge condition 2 is not satisfied, the routine proceeds to step 65, while when the purge condition 2 is satisfied, the routine proceeds to step 53.

At step 53, the ratio between the full open purge amount PGQ and the amount of intake air QA, that is, the full open purge rate PG100 (=(PGQ/QA)·100), is calculated. Here, the full open purge amount PGQ shows the amount of purge when the purge control valve 17 is fully open. The full open purge rate PG100 is a function of for example the engine load Q/N (amount of intake air QA/engine speed N) and the engine speed N and is found in advance by experiments. It is stored in advance in the ROM 22 in the form of a map as shown in the following table.

TABLE 1

| | Q/N | | | | | | | | | | |
|---|---|---|---|---|---|---|---|---|---|---|---|
| N | 0.15 | 0.30 | 0.45 | 0.60 | 0.75 | 0.90 | 1.05 | 1.20 | 1.35 | 1.50 | 1.65 |
| 400 | 25.6 | 25.6 | 21.6 | 15.0 | 11.4 | 8.6 | 6.3 | 4.3 | 2.8 | 0.8 | 0 |
| 800 | 25.6 | 16.3 | 10.8 | 7.5 | 5.7 | 4.3 | 3.1 | 2.1 | 1.4 | 0.4 | 0 |
| 1600 | 16.6 | 8.3 | 5.5 | 3.7 | 2.8 | 2.1 | 1.5 | 1.2 | 0.9 | 0.3 | 0 |
| 2400 | 10.6 | 5.3 | 3.5 | 2.4 | 1.8 | 1.4 | 1.1 | 0.8 | 0.6 | 0.3 | 0.1 |
| 3200 | 7.8 | 3.9 | 2.5 | 1.8 | 1.4 | 1.1 | 0.9 | 0.6 | 0.5 | 0.4 | 0.2 |
| 4000 | 6.4 | 3.2 | 2.1 | 1.5 | 1.2 | 0.9 | 0.7 | 0.6 | 0.4 | 0.4 | 0.3 |

The lower the engine load Q/N becomes, the larger the full open purge amount PGQ with respect to the amount of intake air QA becomes, so as shown in Table 1, the full open purge rate PG100 becomes larger the lower the engine load Q/N becomes and the full open purge amount PGQ with respect to the amount of intake air QA becomes larger the lower the engine speed N becomes, so as shown in Table 1, the full open purge rate PG100 becomes larger the lower the engine speed N.

Next, at step 54, it is judged if the feedback control coefficient FAF is between the upper limit KFAF15 (=1.15) and the lower limit KFAF85 (=0.85) or not. When KFAF15>FAF>KFAF85, that is, when the air-fuel ratio is being controlled by feedback to the stoichiometric air-fuel ratio, the routine proceeds to step 55, where it is judged if the purge rate PGR is zero or not. When the purge action is already being performed, PGR>0, so at this time the routine jumps to step 57. As opposed to this, further, when the purge action has not yet been started, the routine proceeds to step 56, where the purge rate GRP0 is made the restart purge rate PGR. When the purge condition 1 and the purge condition 2 are satisfied for the first time after the engine has started operating, the purge rate PGR0 is made zero by the initialization processing (step 64), so at this time PGR becomes 0. As opposed to this, when the purge action is stopped once and then the purge control is resumed, the purge rate PGR0 just before the purge control was stopped is made the restart purge rate PGR.

Next, at step 57, the target purge rate tPGR (=PGR+KPRGu) is calculated by adding a predetermined value KPGRu to the purge rate PGR. That is, when KFAF15>FAF>KFAF85, it is understood, the target purge rate tPGR is gradually increased every 100 msec. Note that an upper limit value P (P is for example 6%) is set for this target purge rate tPGR, therefore the target purge rate tPGR can only rise up to this upper limit value P. Next, the routine proceeds to step 59.

On the other hand, when it is judged at step 54 that FAF≧KFAF15 or FAF≦KFAF85, the routine proceeds to step 58, where the predetermined value KPGRd is subtracted from the purge rate PGR to calculate the target purge rate tPGR (=PGR−KPGRd). That is, when the air-fuel ratio cannot be maintained at the stoichiometric air-fuel ratio due to the purge action of the fuel vapor, the target purge rate tPGR is reduced. Note that a lower limit value S (S=0%) is set for the target purge rate tPGR. Next, the routine proceeds to step 59.

At step 59, the target purge rate tPGR is divided by the full open purge rate PG100 to calculate the duty ratio DPG (=(tPGR/PG100)·100) of the drive pulse of the purge control valve 17. Therefore, the duty ratio DPG of the drive pulse of the purge control valve 17, that is, the amount of opening of the purge control valve 17, is controlled in accordance with the ratio of the target purge rate tTPG to the full open purge rate PG100. If the amount of opening of the purge control valve 17 is controlled in accordance with the ratio of the target purge rate tTPG to the full open purge rate PG100 in this way, no matter what purge rate the target purge rate tTPG is, regardless of the engine operating state, the actual purge rate will be maintained at the target purge rate.

Suppose for example that the target purge rate tTPG is 2 percent and the full open purge rate PG100 at the current operating state is 10 percent. The duty ratio DPG of the drive pulse will become 20 percent and the actual purge rate at this time will become 2 percent. Next, supposing that the operating state changes and the full open purge rate PG100 at the changed operating state becomes 5 percent, the duty ratio DPG of the duty ratio will become 40 percent and the actual purge ratio at this time will become 2 percent. That is, if the target purge rate tTPG is 2 percent, the actual purge rate will become 2 percent regardless of the engine operating state. If the target purge rate tTPG changes and becomes 4 percent, the actual purge rate will be maintained at 4 percent regardless of the engine operating state.

Next, at step 60, the full open rate PG100 is multiplied by the duty ratio DPG to calculate the actual purge rate PGR (=PG100·(DPG/100)). That is, as explained above, the duty ratio DPG is expressed by (tPGR/PG100)·100. In this case, when the target purge rate tPGR becomes larger than the full open purge rate PG100, the duty ratio DPG would become more than 100 percent. The duty ratio DPG, however, cannot become more than 100 percent. At this time, the duty ratio DPG is made 100 percent, therefore the actual purge rate PGR becomes smaller than the target purge rate tPGR. Accordingly, the actual purge rate PGR is expressed by PG100·(DPG/100) as explained above.

Next, at step 61, the duty ratio DPG is made DPG0 and the purge rate PGR is made PGR0. Next, at step 62, the purge execution time counter CPGR showing the time from when the purge was started is incremented by exactly 1. Next, at step 63, processing is performed to drive the purge control valve 17. This drive processing is shown in FIG. 7, therefore, an explanation will next be made of the drive processing of FIG. 7.

Figure 7:
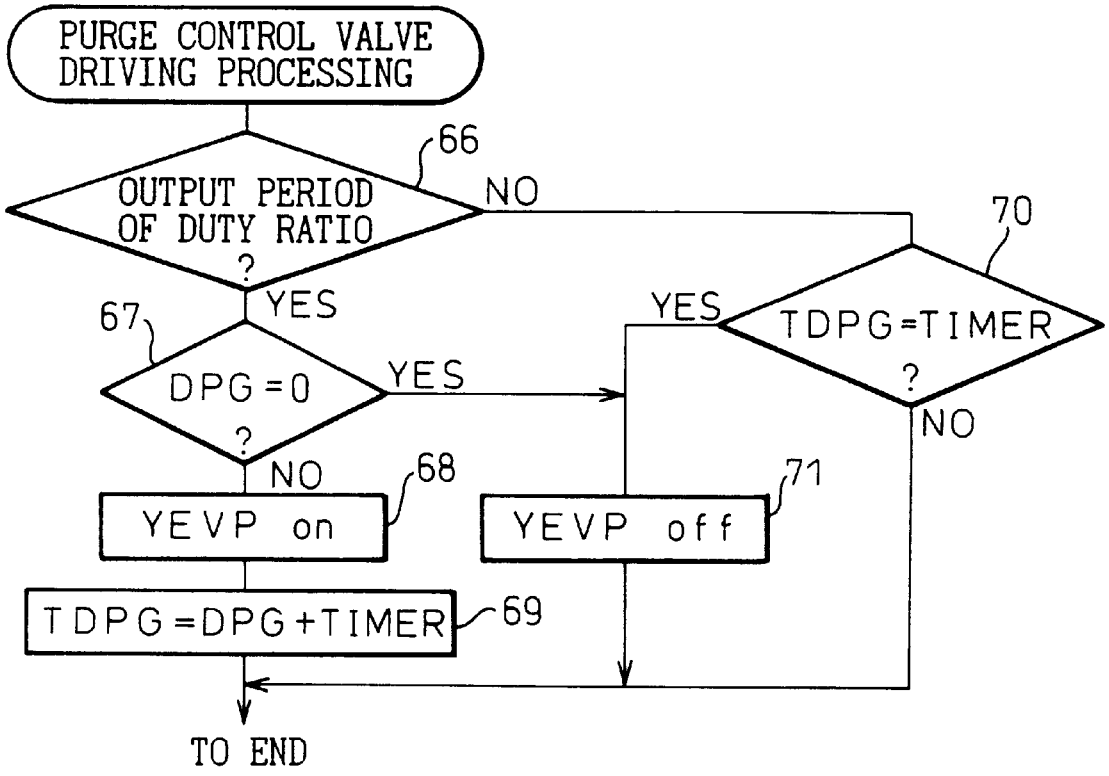
FIG. 7 is a flow chart of processing for driving a purge control valve.

Referring to FIG. 7, first, at step 66, it is judged if the output period of the duty ratio, that is, the rising period of the drive pulse of the purge control valve 17, has arrived or not. The output period of the duty ratio is 100 msec. If the output period of the duty ratio has arrived, the routine proceeds to step 67, where it is judged if the duty ratio DPG is zero or not. When DPG is 0, the routine proceeds to step 71, where the drive pulse YEVP of the purge control valve 17 is turned off. As opposed to this, when DPG is not 0, the routine proceeds to step 68, where the drive pulse YEVP of the purge control valve 17 is turned on. Next, at step 69, the duty ratio DPG is added to the current time TIMER to calculate the off time TDPG of the drive pulse (=DPG+TIMER).

On the other hand, when it is judged at step 66 that the output period of the duty ratio has not arrived, the routine proceeds to step 70, where it is judged if the current time TIMER is the off time TDPG of the drive pulse. When TDPG=TIMER, the routine proceeds to step 71, where the drive pulse YEVP is turned off.

Next, the routine for calculation of the feedback control coefficient FAF shown in FIG. 8 will be explained. This routine is executed by interruption every predetermined interval for example.

Figure 8:
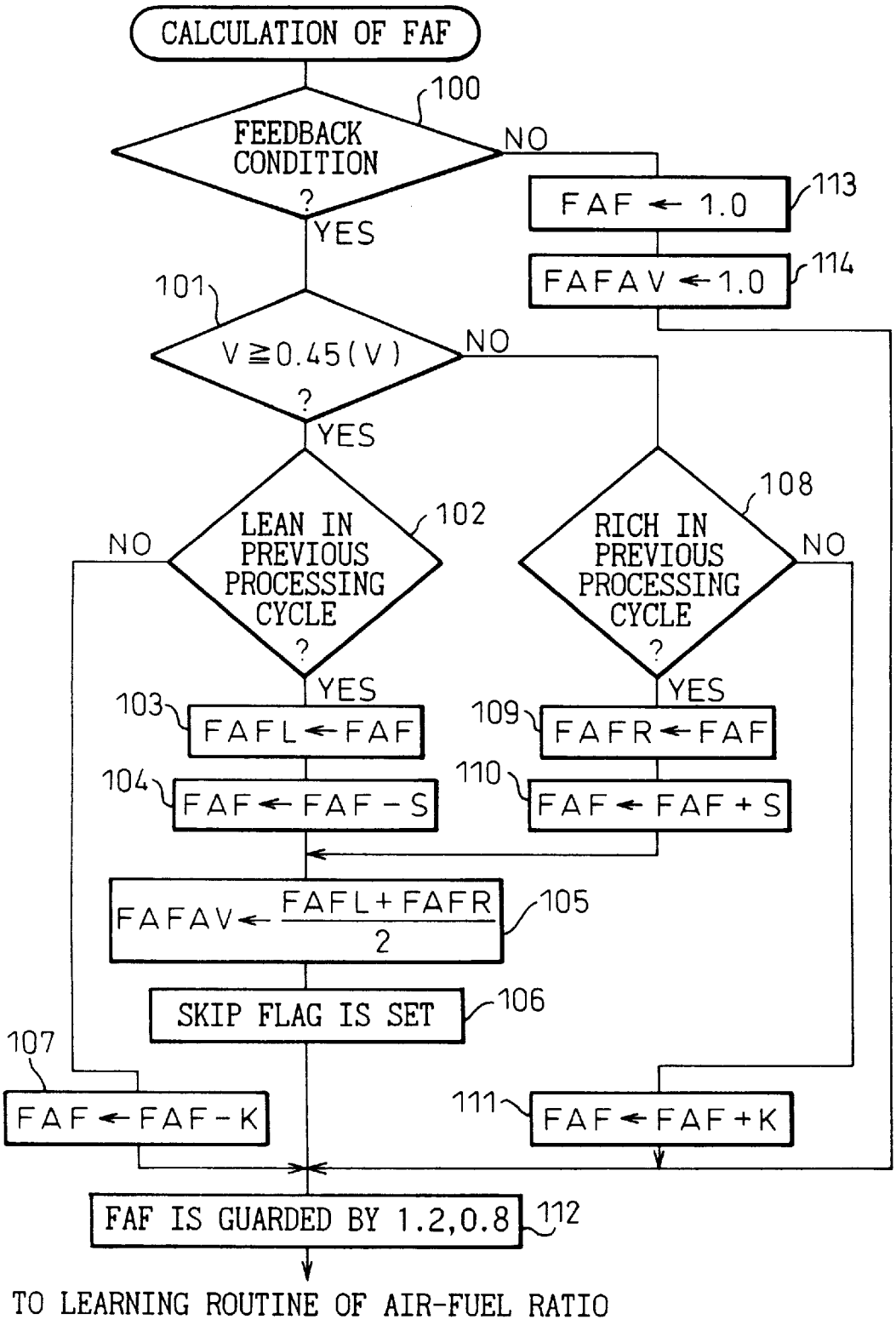
FIG. 8 is a flow chart of calculation of the feedback correction coefficient FAF.

Referring to FIG. 8, first, at step 100, it is judged if the feedback control conditions of the air-fuel ratio are satisfied or not. When the feedback control conditions are not satisfied, the routine proceeds to step 113, where the feedback control coefficient FAF is fixed to 1.0, then at step 114, the average value FAFAV of the feedback control coefficient is fixed to 1.0. Next, the routine proceeds to step 112. As opposed to this, when the feedback control conditions are satisfied, the routine proceeds to step 101.

At step 101, it is judged whether the output voltage of the $O_2$ sensor 30 is higher than 0.45V or not, that is, whether the air-fuel ratio is rich or not. When V≧0.45V, that is, when the air-fuel ratio is rich, the routine proceeds to step 102, where it is judged if the air-fuel ratio was lean at the time of the previous processing cycle or not. When it was lean at the time of the previous processing cycle, that is, when it has changed from lean to rich, the routine proceeds to step 103, where the feedback control coefficient FAF is made FAFL and the routine proceeds to step 104. At step 104, a skip value S is subtracted from the feedback control coefficient FAF, therefore, as shown in FIG. 2, the feedback control coefficient FAF is rapidly reduced by the skip value S. Next, at step 105, the average value FAFAV of the FAFL and FAFR is calculated. Next, at step 106, the skip flag is set. Next, the routine proceeds to step 112. On the other hand, when it is judged at step 102 that the air-fuel ratio was rich at the time of the previous processing cycle, the routine proceeds to step 107, where the integral value K (K<<S) is subtracted from the feedback control coefficient FAF, then the routine proceeds to step 112. Therefore, as shown in FIG. 2, the feedback control coefficient FAF is gradually reduced.

On the other hand, when it is judged at step 101 that V<0.45V, that is, when the air-fuel ratio is lean, the routine proceeds to step 108, where it is judged if the air-fuel ratio was rich at the time of the previous processing cycle. When it was rich at the time of the previous processing cycle, that is, when it changed from rich to lean, the routine proceeds to step 109, where the feedback control coefficient FAF is made FAFR and the routine proceeds to step 110. At step 110, the skip value S is added to the feedback control coefficient FAF, therefore, as shown in FIG. 2, the feedback control coefficient FAF is rapidly increased by exactly the skip value S. Next, at step 105, the average value FAFAV of the FAFL and FAFR is calculated. On the other hand, when it was judged at step 108 that the air-fuel ratio was lean at the time of the previous processing cycle, the routine proceeds to step 111, where the integral value K is added to the feedback control coefficient FAF. Therefore, as shown in FIG. 2, the feedback control coefficient FAF is gradually increased.

At step 112, the feedback control coefficient FAF is guarded by the upper limit 1.2 and the lower limit 0.8 of the allowable range of fluctuation. That is, the value of FAF is guarded so that FAF does not become larger than 1.2 and does not become smaller than 0.8. As explained above, when the air-fuel ratio becomes rich and FAF becomes smaller, the fuel injection time TAU becomes shorter, while when the air-fuel ratio becomes lean and the FAF increases, the fuel injection time TAU becomes longer, so the air-fuel ratio is maintained at the stoichiometric air-fuel ratio.

Figure 9:
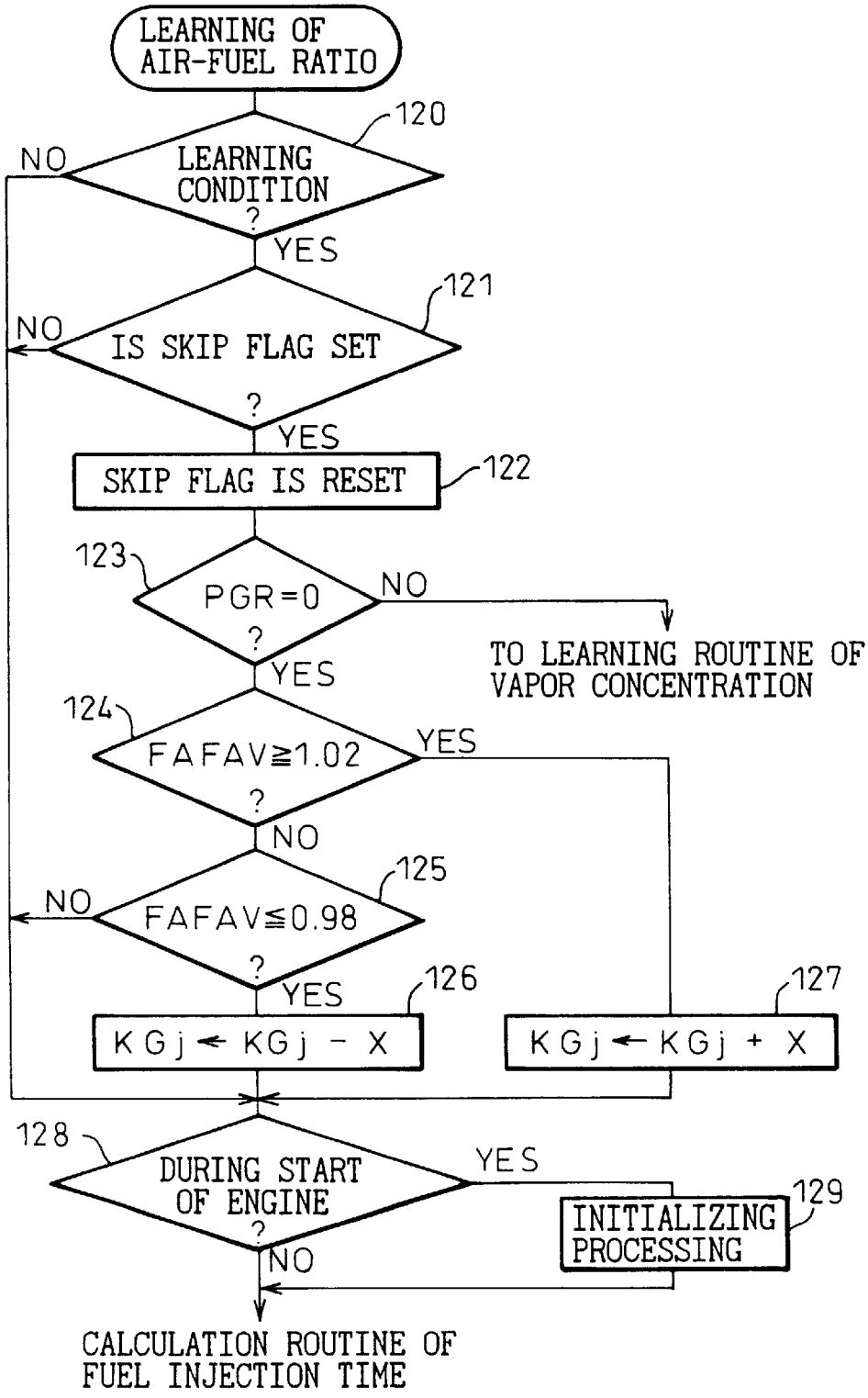
FIG. 9 is a flow chart of learning of the air-fuel ratio.

When the routine for calculation of the feedback control coefficient FAF shown in FIG. 8 is completed, the routine for learning the air-fuel ratio shown in FIG. 9 is started.

Referring to FIG. 9, first, at step 120, it is judged if the learning conditions of the air-fuel ratio are satisfied or not. When the learning conditions of the air-fuel ratio are not satisfied, the routine jumps to step 128, while when the learning conditions of the air-fuel ratio are satisfied, it proceeds to step 121. At step 121, it is judged if the skip flag has been set or not. When the skip flag has not been set, the routine jumps to step 128. As opposed to this, when the skip flag has been set, the routine proceeds to step 122, where the skip flag is reset, then the routine proceeds to step 123. That is, the routine proceeds to step 123 every time the feedback control coefficient FAF is made to skip.

At step 123, it is judged if the purge rate PGR is zero or not, that is, if the purge action is being performed. When the purge rate PGR is not zero, that is, when the purge action is being performed, the routine proceeds to the learning routine of the vapor concentration shown in FIG. 10. As opposed to this, when the purge rate PGR is zero, that is, when the purge action is not being performed, the routine proceeds to step 124, where the learning of the air-fuel ratio is performed.

That is, first, at step 124, it is judged if the average value FAFAV of the feedback control coefficient is larger than 1.02 or not. When FAFAV≧1.02, the routine proceeds to step 127, where the predetermined value X is added to the learning value KGj of the air-fuel ratio for the learning region j. That is, in the embodiment of the present invention, a plurality of learning regions j are set in advance in accordance with the engine load. A learning value KGj of the air-fuel ratio is set for each learning region j. Therefore, at step 127, the learning value KGj of the air-fuel ratio of the learning region j in accordance with the engine load is updated. Next, the routine proceeds to step 128.

On the other hand, when it is judged at step 124 that FAFAV<1.02, the routine proceeds to step 125, where it is judged if the average value FAFAV of the feedback control coefficient is smaller than 0.98. When FAFAV≦0.98, the routine proceeds to step 126, where a predetermined value X is subtracted from the learning value KGj of the air-fuel ratio of the learning region j in accordance with the engine load. On the other hand, when it is judged at step 125 that FAFAV>0.98, that is, when FAFAV is between 0.98 and 1.02, the routine jumps to step 128 without updating the learning value KGj of the air-fuel ratio.

At step 128 and step 129, the initialization processing for learning the vapor concentration is performed. That is, at step 128, it is judged if the engine is in the middle of start-up. When the engine is starting up, the routine proceeds to step 129, where the vapor concentration FGPG per unit purge rate is made zero and the count CPGR of purge execution time is cleared. Next, the routine proceeds to the routine for calculation of the fuel injection time shown in FIG. 11. On the other hand, when the engine is not starting up, the routine proceeds directly to the routine for calculation of the fuel injection time shown in FIG. 11.

Figure 10:
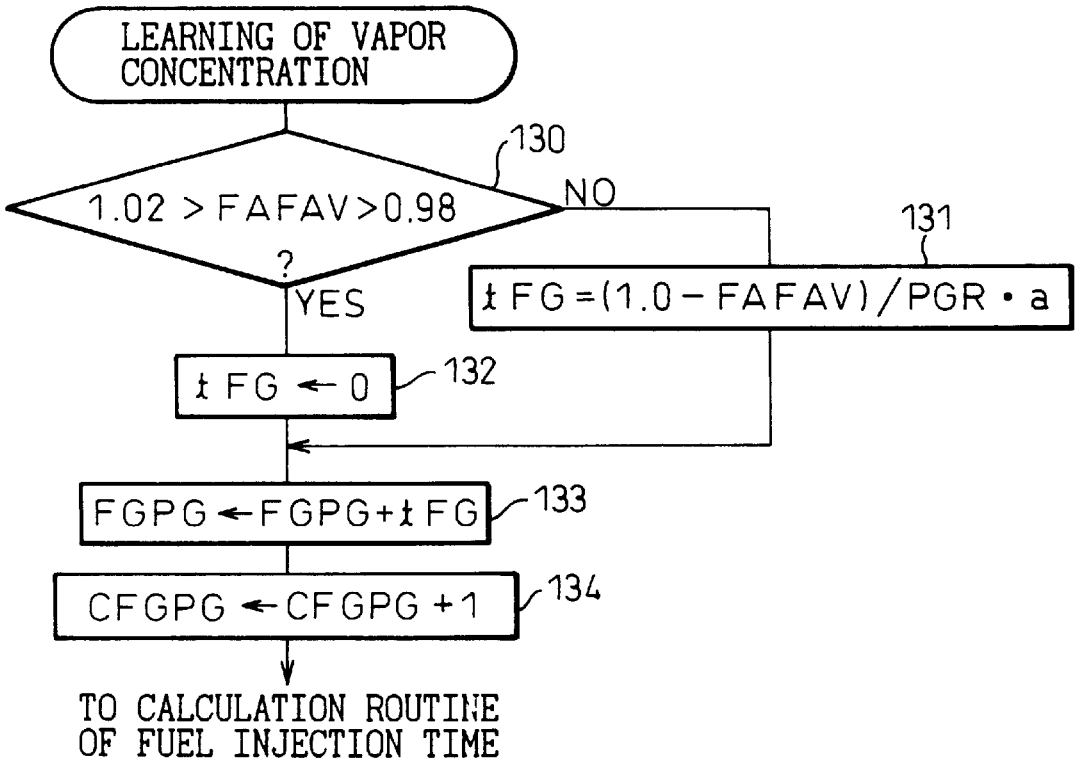
FIG. 10 is a flow chart of learning of the concentration of vapor.

As explained above, when it is judged at step 123 that the purge action is being performed, the routine proceeds to the routine for learning the vapor concentration shown in FIG. 10. Next, the routine for learning the vapor concentration will be explained.

Referring to FIG. 10, first, at step 130, it is judged if the average value FAFAV of the feedback control coefficient is in a set range or not, that is, if 1.02>FAFAV>0.98 or not. When the average value FAFAV of the feedback control coefficient is in the set range, that is, when 1.02>FAFAV>0.98, the routine proceeds to step 132, where the update value tFG of the vapor concentration FGPG per unit purge rate is made zero, then the routine proceeds to step 133. Therefore, at this time, the vapor concentration FGPG is not updated.

On the other hand, when it is judged at step 130 that the average value FAFAV of the feedback control coefficient is outside of the set range, that is, when FAFAV≧1.02 or FAFAV≦0.98, the routine proceeds to step 131, where the update value tFG of the vapor concentration FGPG is calculated based on the following equation:

$$tFG=(1.0-FAFAV)/PGR\cdot a$$

Here, a is 2. That is, when the average value FAFAV of the feedback control coefficient is outside of the set range (between 0.98 and 1.02), half of the deviation of the FAFAV with respect to 1.0 is made the update value tFG. Next, the routine proceeds to step 133. At step 133, the update value fFG is added to the vapor concentration FGPG. Next, at step 134, the update counter CFGPG showing the number of updates of the vapor concentration FGPG is incremented by exactly 1. Next, the routine for calculation of the fuel injection time shown in FIG. 11 is proceeded to.

Next, an explanation will be made of the routine for calculation of the fuel injection time shown in FIG. 11.

Figure 11:
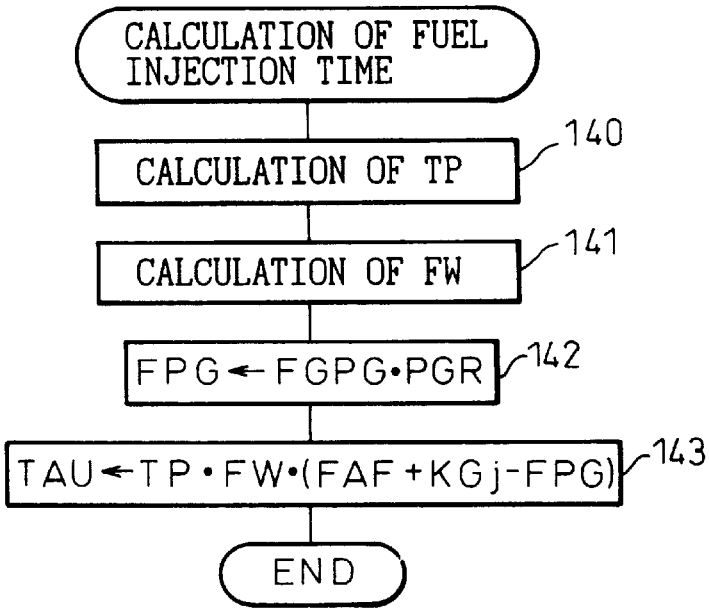
FIG. 11 is a flow chart of calculation of a fuel injection time.

Referring to FIG. 11, first, at step 140, the basic fuel injection time TP is calculated based on the engine load Q/N and the engine speed N. Next, at step 141, the correction coefficient FW for the increase at engine warmup etc. is calculated. Next, at step 142, the purge rate PGR is multiplied with the vapor concentration FGPG per unit purge rate to calculate the purge A/F correction coefficient FPG (=FGPG·PGR). Next, at step 143, the fuel injection time TAU is calculated based on the following equation:

$$TAU=TP\cdot FW\cdot(FAF+KGj-FPG)$$

As explained above, however, in the embodiment according to the present invention, when the purge operation is temporarily stopped during the purge operation and then the purge operation is restarted, the purge operation is restarted with the purge rate immediately before the purge operation had been stopped. In this case, if the vapor concentration in the intake passage immediately before the purge operation was stopped and the vapor concentration in the intake passage when the purge operation is restarted are substantially the same, the air-fuel ratio will not fluctuate when the purge is restarted and the air-fuel ratio will be immediately maintained at the target air-fuel ratio.

If, however, the purge operation is made to stop when the fuel temperature in the fuel tank 15 is high, a large amount of evaporated fuel will be generated in the fuel tank and therefore during this time a large amount of evaporated fuel will be absorbed in the activated carbon 10 of the canister 11. If the purge operation is restarted when a large amount of evaporated fuel is generated in the fuel tank 15 in this way or a large amount of evaporated fuel is absorbed in the activated carbon 10 of the canister 11, the vapor concentration inside the intake passage at the time of restarting the purge becomes considerably high compared with the vapor concentration in the intake passage immediately before the purge had been stopped. In this case, if the amount of supply of the fuel is corrected considering the vapor concentration at the time of restart of the purge the same as the vapor concentration immediately before the stopping of the purge, the problem arises that the air-fuel ratio ends up becoming very rich.

Therefore, in the present invention, when the purge operation is stopped, the vapor concentration of the fuel vapor in the upper space of the fuel tank 15 or the purge passage from the upper space of the fuel tank 15 to the purge control valve 17 is detected. When the vapor concentration increases while the purge operation is stopped, the correction value based on the vapor concentration used when calculating the fuel injection time TAU, specifically the vapor concentration FGPG per unit purge rate, is made to increase.

Next, this will be explained in more detail with reference to FIG. 12 and FIG. 13. In the embodiment shown in FIG. 12 and FIG. 13, the vapor concentration FGPG is controlled based on the pressure PT in the fuel vapor chamber 12 detected by the pressure sensor 32.

Figure 12:
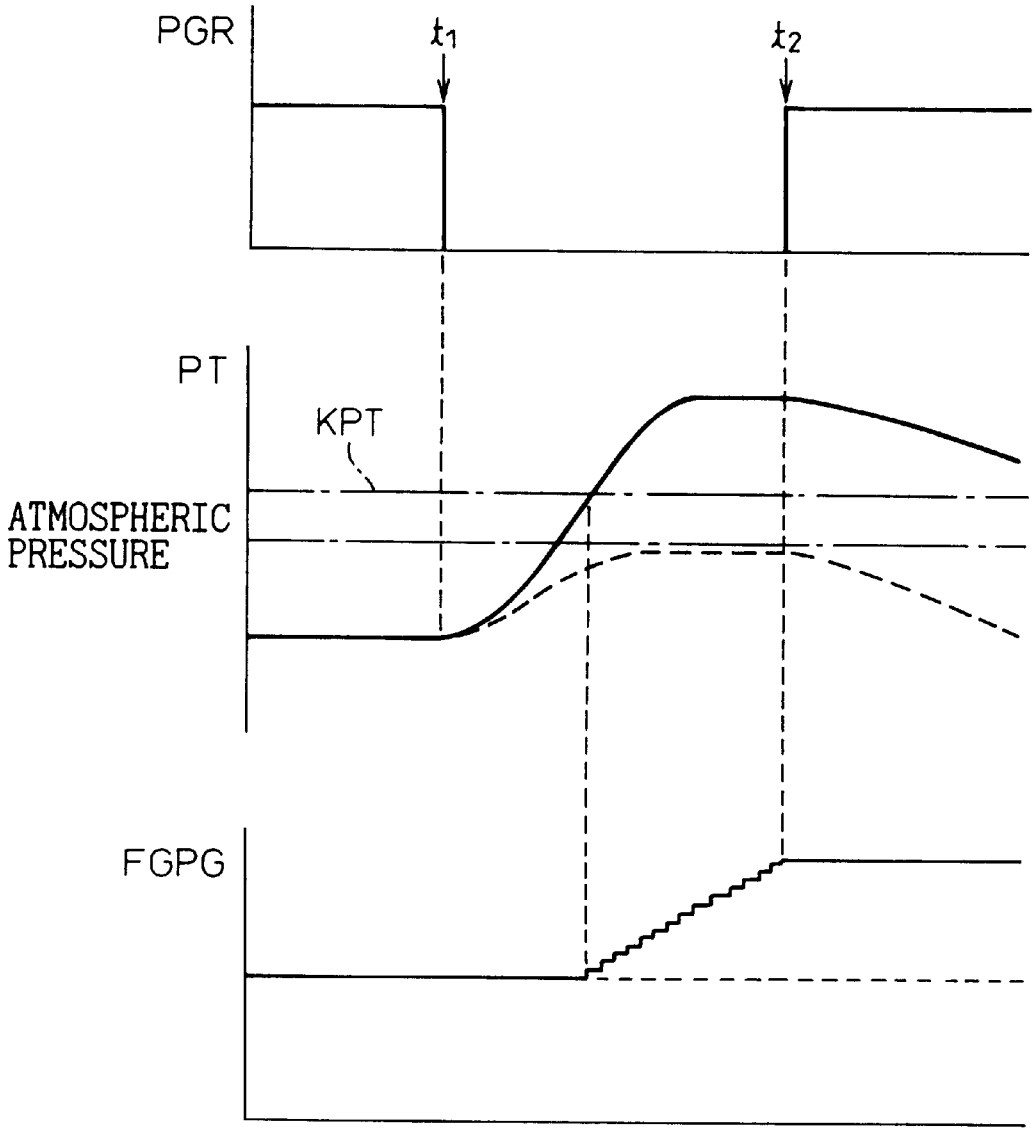
FIG. 12 is a view of changes in the concentration of vapor FGPG.

In FIG. 12, it is assumed that the purge operation is stopped at $t_1$ and the purge operation is restarted at $t_2$. Before the purge operation is stopped, as shown in FIG. 12, the pressure PT in the fuel vapor chamber 12 is a negative pressure. When the fuel temperature in the fuel tank 15 is low, the amount of the evaporated fuel generated is small. At this time, if the vapor operation is stopped, the pressure PT in the fuel vapor chamber 12 rises to substantially atmospheric pressure as shown by the broken line in FIG. 12. In this case, as shown by the broken line in FIG. 12, the value of the vapor concentration FGPG is maintained as it is without being updated.

As opposed to this, if the purge operation is made to stop when the fuel temperature in the fuel tank 15 is high, a large amount of evaporated fuel continues to be generated in the fuel tank 15 during the purge operation, so the pressure PT in the fuel vapor chamber 12 increases considerably over atmospheric pressure as shown by the solid line in FIG. 12. Therefore, in the first embodiment shown in FIG. 12, when the pressure PT in the fuel vapor chamber 12 exceeds the predetermined setting KPT, the vapor concentration FGPG is made to gradually increase as shown by the solid line. When the purge operation is started, the increased vapor concentration FGPG is used to correct the fuel injection time TAU. By doing this, it is possible to inhibit the fluctuation of the air-fuel ratio at the time of restart of the purge.

Figure 13:
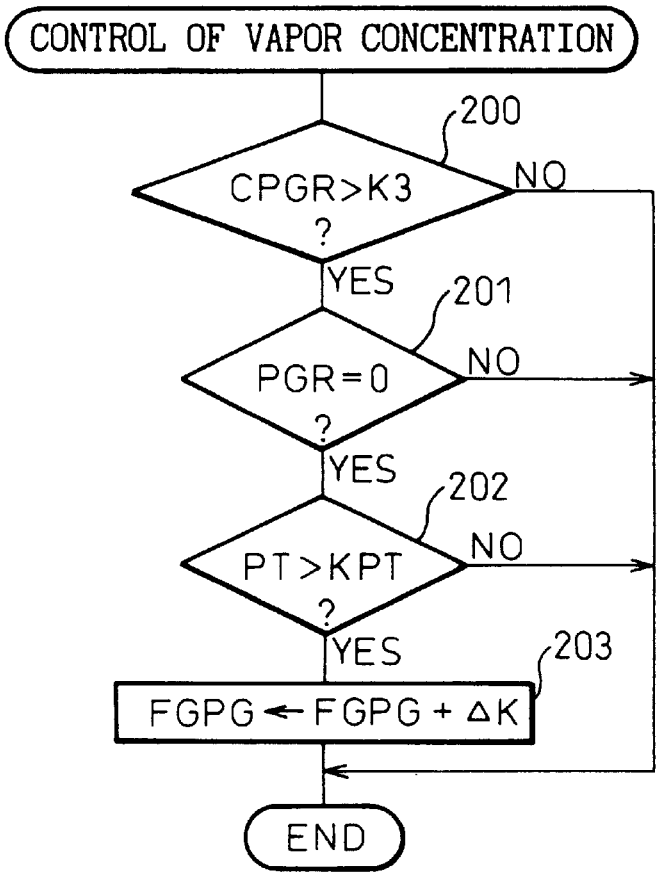
FIG. 13 is a flow chart of the control of the concentration of vapor in a first embodiment.

FIG. 13 shows the routine for control of the vapor concentration. This routine is executed by interruption every certain period, for example, 100 msec.

Referring to FIG. 13, first, at step 200, it is judged if the purge execution time count CPGR has exceeded a predetermined value K3 or not, for example, if 3 minutes have elapsed from when the purge first started after the start of the engine operation. When CPGR≦K3, the processing routine is ended, therefore at this time the vapor concentration FGPG is not updated based on the pressure PT. That is, when the purge is first started, the learning of the vapor concentration FGPG is not yet performed. At this time, there is no meaning even if the vapor concentration FGPG is updated based on the pressure PT in the fuel vapor chamber 12, so at this time updating of the vapor concentration FGPG based on the pressure PT is prohibited. On the other hand, if 3 minutes have elapsed from when the purge was first started, it is considered that the learning of the vapor concentration FGPG is ending, therefore the vapor concentration FGPG is not updated based on the pressure PT.

That is, when it is judged at step 200 that CPGR>K3, the routine proceeds to step 201, where it is judged if the purge rate PGR is zero or not. When PGR=0, that is, when the purge operation is stopping, the routine proceeds to step 202, where it is judged if the pressure PT in the fuel vapor chamber 12 detected by the pressure sensor 32 is higher than the setting KPT (FIG. 12) or not. When PT>KPT, the routine proceeds to step 203, where the predetermined value ΔK is added to the vapor concentration FGPG. Therefore, at this time, the vapor concentration FGPG is made to gradually increase as shown by FIG. 12.

Figure 14:
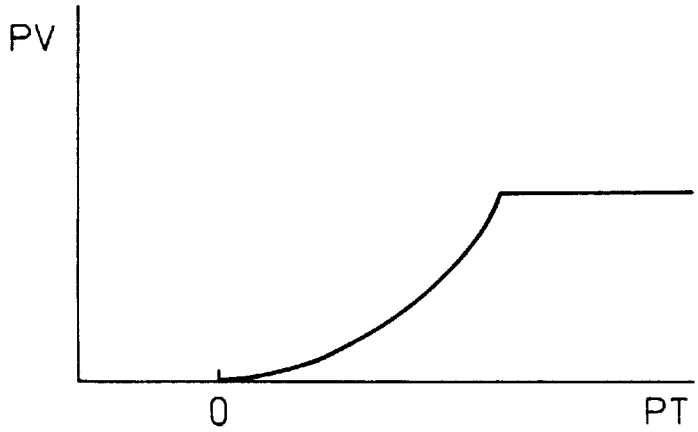
FIG. 14 is a view of the relationship between the pressure PT in a fuel vapor chamber and an amount of evaporated fuel PV.
Figure 15:
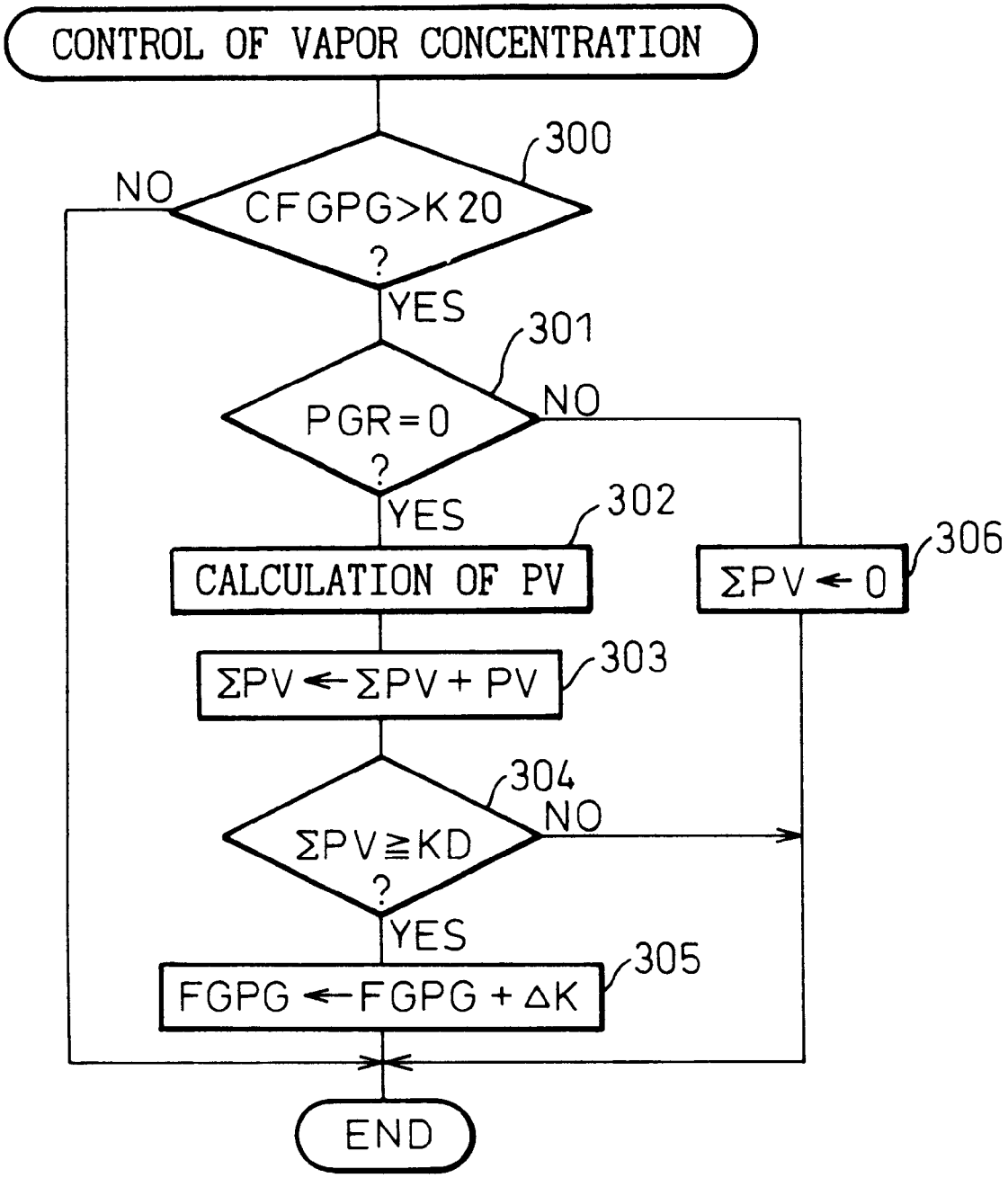
FIG. 15 is a flow chart of the control of the concentration of vapor in a second embodiment.

FIG. 14 and FIG. 15 shows a second embodiment. In this embodiment, the amount of evaporated fuel PV per unit time in the fuel tank 15 is found from the pressure PT in the fuel vapor chamber 12. When the cumulative value of the amount of evaporated fuel PV is found and the cumulative value exceeds the predetermined setting KD, the vapor concentration FGPG is made to gradually increase. Note that in this case, the relationship between the pressure PV in the fuel vapor chamber 12 and the amount of evaporated fuel PV per unit time is found in advance by experiments. This relationship is shown in FIG. 14.

FIG. 15 shows the routine for control of the vapor concentration in the second embodiment. This routine is executed by interruption every predetermined period, for example, 100 msec.

Referring to FIG. 15, first, at step 300, it is judged if the update count CFGPG is larger than a predetermined setting K20, for example, 20. When CFGPG≦K20, the processing cycle is ended. On the other hand, when CFGPG>K20, that is, when the number of updates of the vapor concentration FGPG has become at least about 20, it is judged that the learning of the vapor concentration FGPG is ending. At this time, the routine proceeds to step 301.

At step 301, it is judged if the purge rate PGR is zero or not. When PGR=0, that is, when the purge operation is made to stop, the routine proceeds to step 302, where the amount of evaporated fuel PV per unit time is calculated based on the pressure PT in the fuel vapor chamber 12 from the relationship shown in FIG. 14. Next, at step 303, the cumulative value ΣPV (=ΣPV+PV) of the amount of evaporated fuel PV is calculated. Next, at step 304, it is judged if the cumulative value ΣPV has become larger than the predetermined setting KD or not. When ΣPV≧KD, the routine proceeds to step 305, where a predetermined value ΔK is added to the vapor concentration FGPG. Therefore, while ΣPV≧KD, the vapor concentration FGPG is made to gradually increase. On the other hand, when it is judged at step 301 that the purge rate PGR>0, the routine proceeds to step 306, where the cumulative value ΣPV is made zero.

Figure 16:
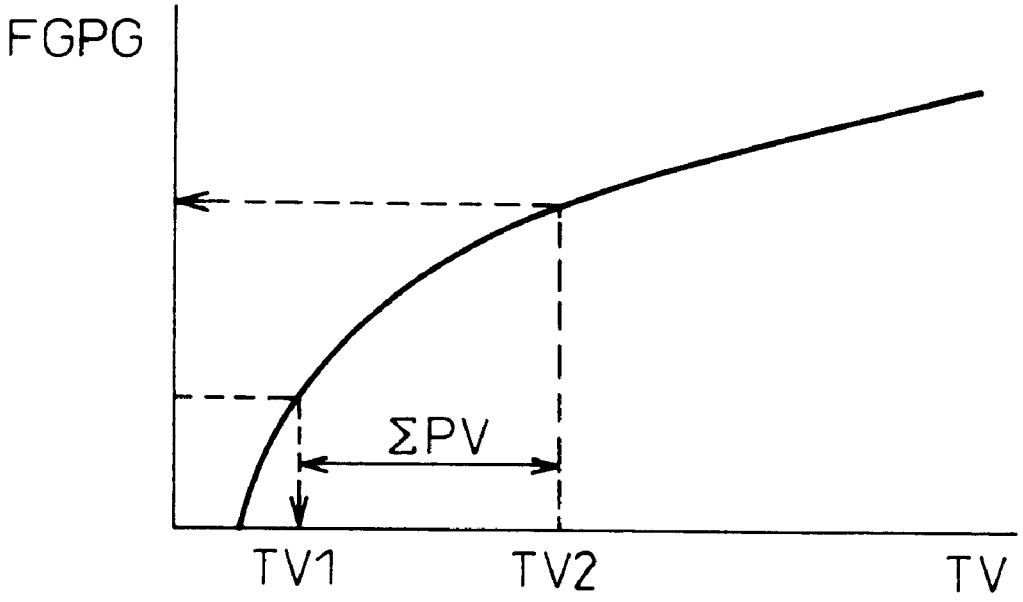
FIG. 16 is a view of the relationship between the concentration of vapor FGPG and the amount of evaporated fuel TV.
Figure 17:
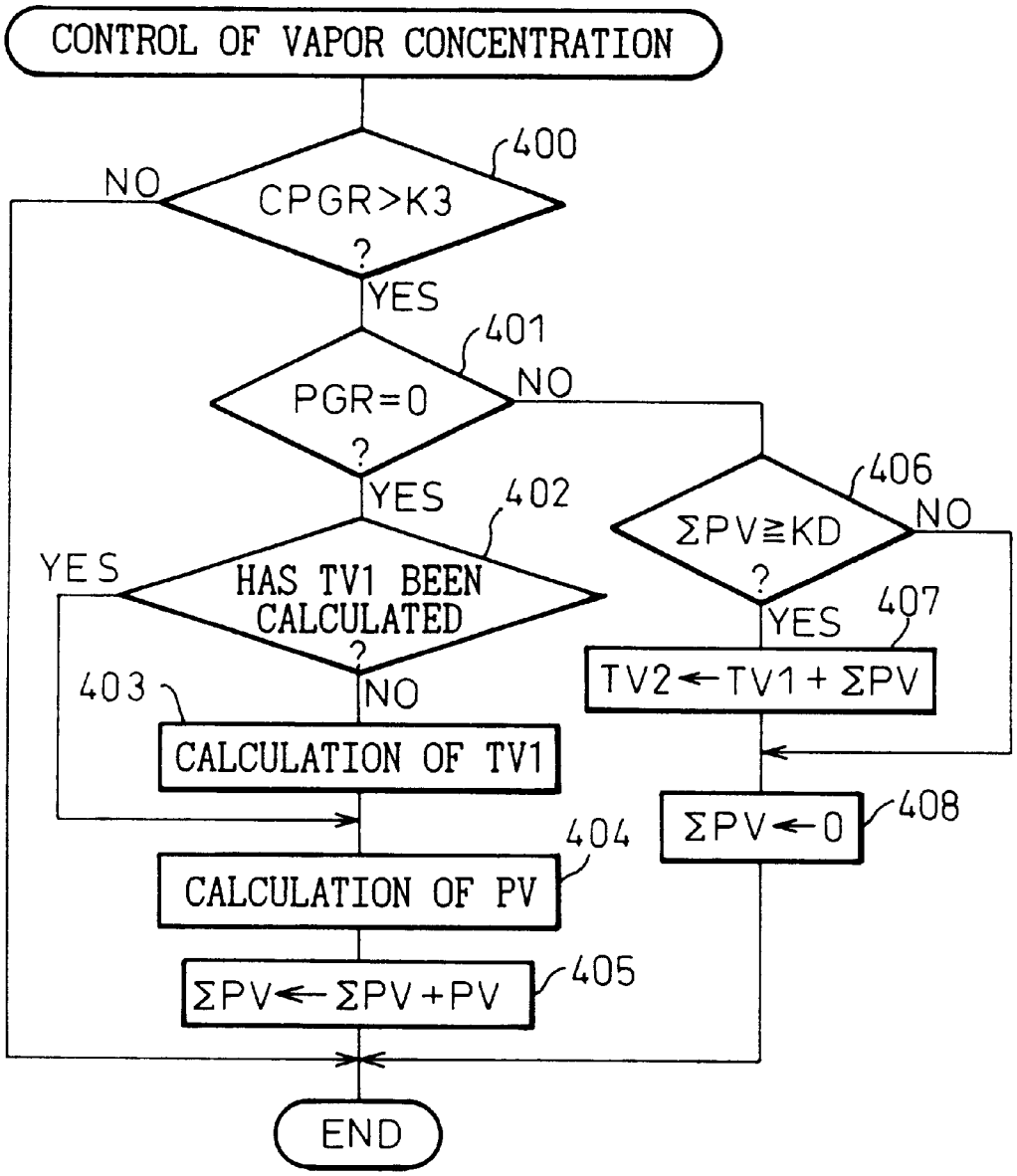
FIG. 17 is a flow chart of the control of the concentration of vapor in a third embodiment.

FIG. 16 and FIG. 17 show a third embodiment. In this embodiment, the relationship between the amount of evaporated fuel TV in the fuel tank 15 and the vapor concentration FGPG is found in advance by experiments and the vapor concentration FGPG is found based on this relationship. FIG. 16 shows the relationship between the amount of evaporated fuel TV in the fuel tank 15 and the vapor concentration FGPG.

FIG. 17 shows the routine for control of the vapor concentration for execution of the third embodiment. This routine is executed by interruption every predetermined period, for example, 100 msec.

Referring to FIG. 17, first, at step 400, it is judged if the purge time execution count CPGR is larger than the setting K3 or not, that is, if 3 minutes have elapsed from the start of the purge operation after the start of the engine operation. When CPGR≦K3, the processing cycle ends. As opposed to this, when CPGR>K3, the routine proceeds to step 401, it is judged if the purge rate PGR is zero or not. When PGR=0, that is, when the purge operation is stopping, the routine proceeds to step 402, where it is judged if the amount of evaporated fuel TV1 in the fuel tank 15 immediately after the purge operation has stopped has been calculated or not. Since the amount of evaporated fuel TV1 has not been calculated immediately after the purge operation is stopped, the routine proceeds to step 403 at this time. The amount of evaporated fuel TV1 is calculated from the vapor concentration FGPG at this time using the relationship shown in FIG. 16.

Next, at step 404, the amount of evaporated fuel PV per unit time is calculated from the pressure PT in the fuel vapor chamber 12 using the relationship shown in FIG. 14, then at step 405 the cumulative value ΣPV (=ΣPV+PV) of the amount of evaporated fuel is calculated. At the next processing cycle, the routine jumps from step 402 to step 404.

On the other hand, when it is judged at step 401 that PGR>0, that is, when the purge operation has started, the routine proceeds to step 406, where it is judged if the cumulative value ΣPV of the amount of evaporated fuel is larger than the setting KD or not. Note that the ΣPV at this time expresses the amount of fuel evaporated while the purge operation is stopped. When ΣPV<KD, the routine jumps to step 408, where ΣPV is made zero. As opposed to this, when ΣPV≧KD, the routine proceeds to step 407, where ΣPV is added to the amount of evaporated fuel TV1 immediately after the purge is stopped so as to calculate the amount of evaporated fuel PV2 in the fuel tank 15 at the time of restart of the purge (FIG. 16). The vapor concentration FGPG at the time of restart of the purge is calculated from this PV2 using the relationship shown in FIG. 16.

Figure 18:
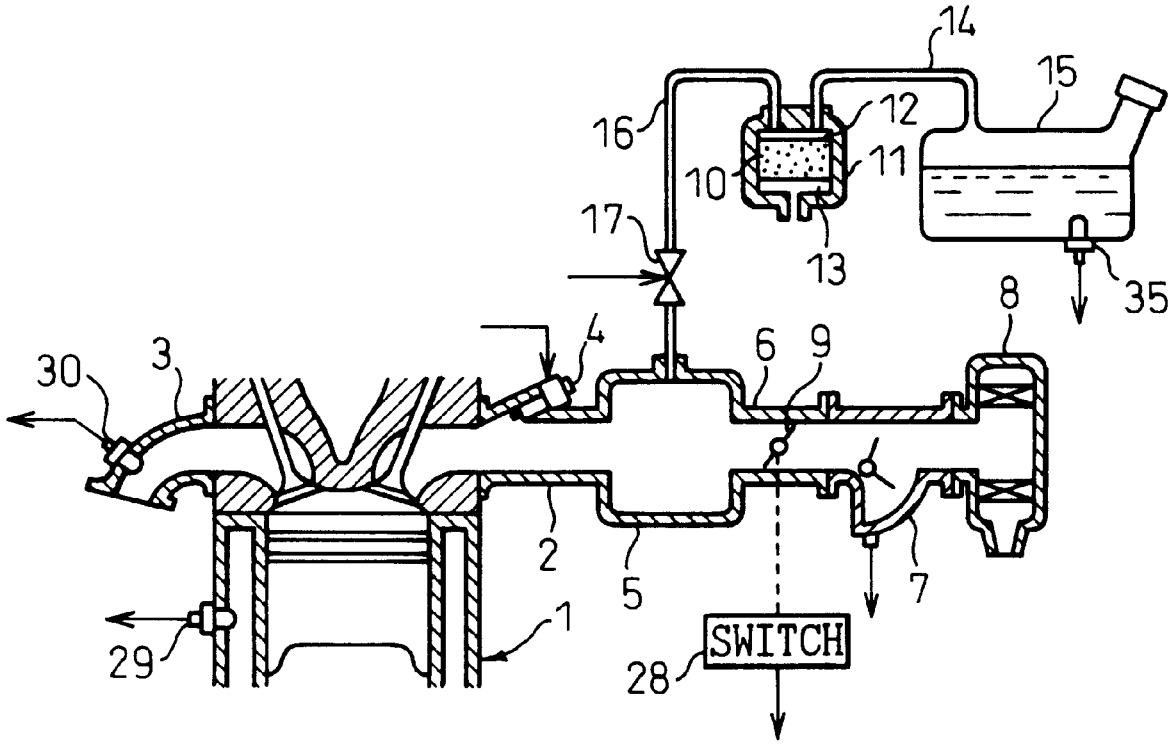
FIG. 18 is an overview of an internal combustion engine.
Figure 19:
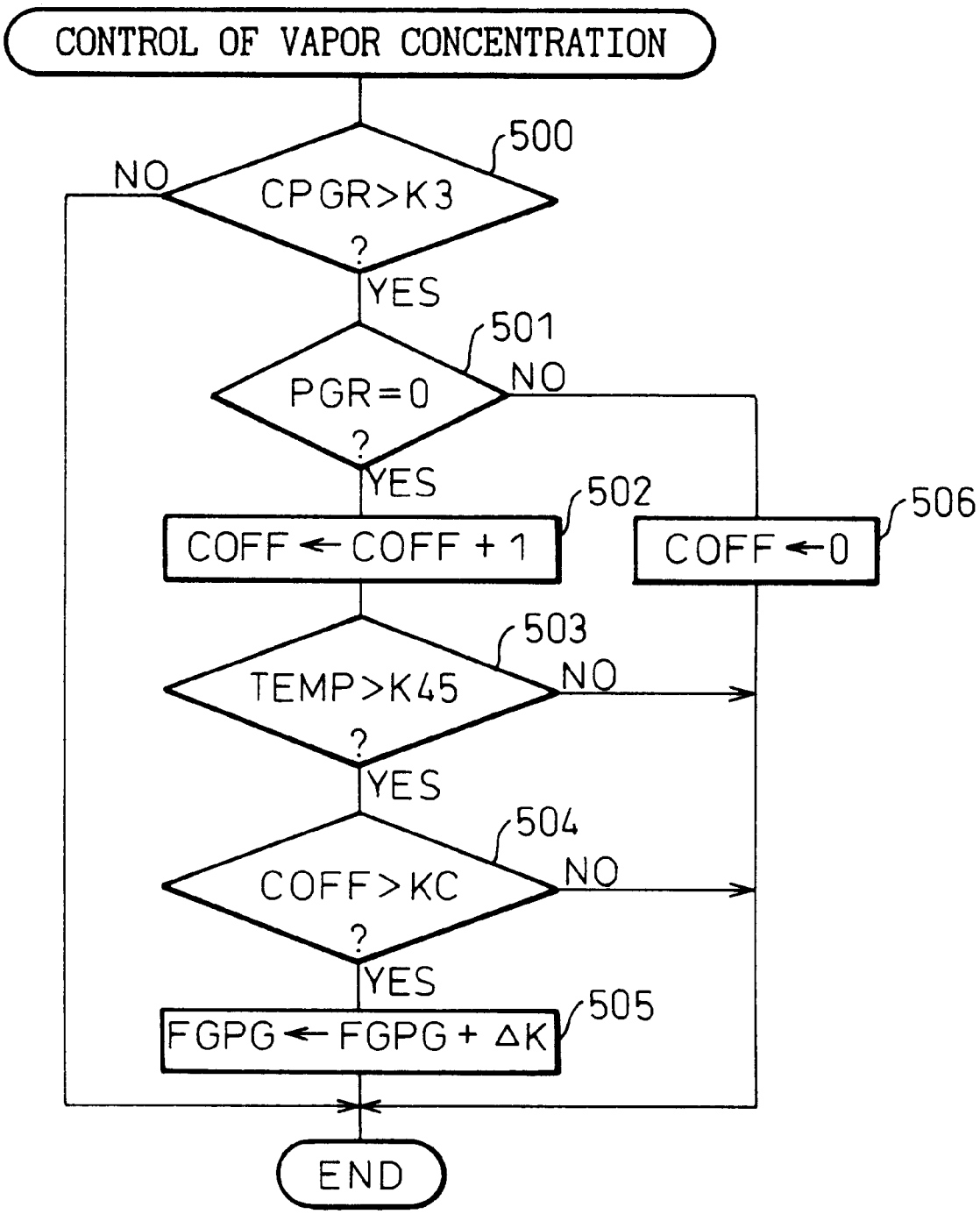
FIG. 19 is a flow chart of control of the concentration of vapor in a fourth embodiment.

FIG. 18 to FIG. 19 show a fourth embodiment. In this embodiment, the vapor concentration FGPG at the time of restart of the purge is calculated based on the fuel temperature in the fuel tank 15. In this embodiment, as shown in FIG. 18, a temperature sensor 35 for detecting the fuel temperature is attached to the fuel tank 15.

FIG. 19 shows the routine for control of the vapor concentration for execution of the fourth embodiment. This routine is executed by interruption every predetermined period, for example, 100 msec.

Referring to FIG. 19, first, at step 500, it is judged if the purge time execution count CPGR is larger than the setting K3 or not, that is, if 3 minutes have elapsed from the start of the purge operation after the start of engine operation. When CPGR≦K3, the processing cycle ends. As opposed to this, when CPGR>K3, the routine proceeds to step 501, where it is judged that the purge rate PGR is zero or not. When PGR=0, that is, when the purge operation has been stopped, the routine proceeds to step 502, where the purge stop period count COFF showing the purge stop period is incremented by exactly 1.

Next, at step 503, it is judged if the fuel temperature TEMP in the fuel tank 15 detected by the temperature sensor 35 is higher than the temperature K45 which causes the generation of a large amount of evaporated fuel, for example, 45° C. When TEMP>K45, the routine proceeds to step 504, where it is judged if the purge stop time count COFF is larger than a predetermined value KC or not. When COFF>KC, the routine proceeds to step 505, where a predetermined value ΔK is added to the vapor concentration FGPG. That is, in this embodiment, when the purge stop time is short (COFF≦KC), the updating of the vapor concentration FGPG is prohibited. As opposed to this, when the fuel temperature inside the fuel tank 15 is for example at least 45° C. and the purge stop time is relatively long, the vapor concentration FGPG is made to gradually increase. On the other hand, when it is judged at step 501 that PGR>0, the routine proceeds to step 506, where COFF is made zero.

Figure 20:
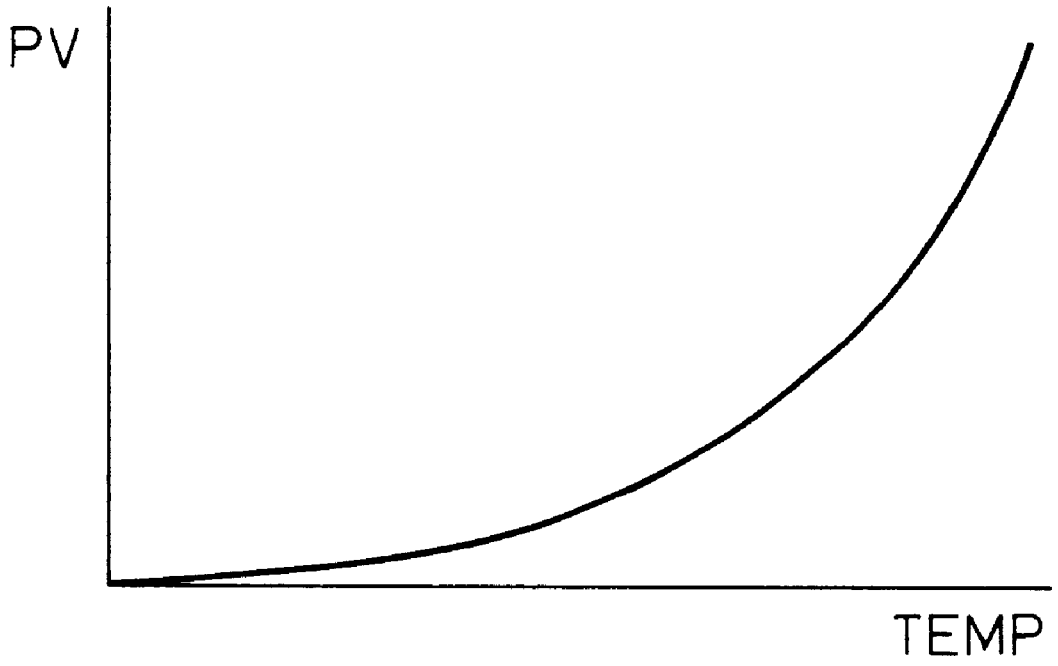
FIG. 20 is a view of the relationship between a fuel temperature TEMP in a fuel tank and an amount of evaporated fuel PV.
Figure 21:
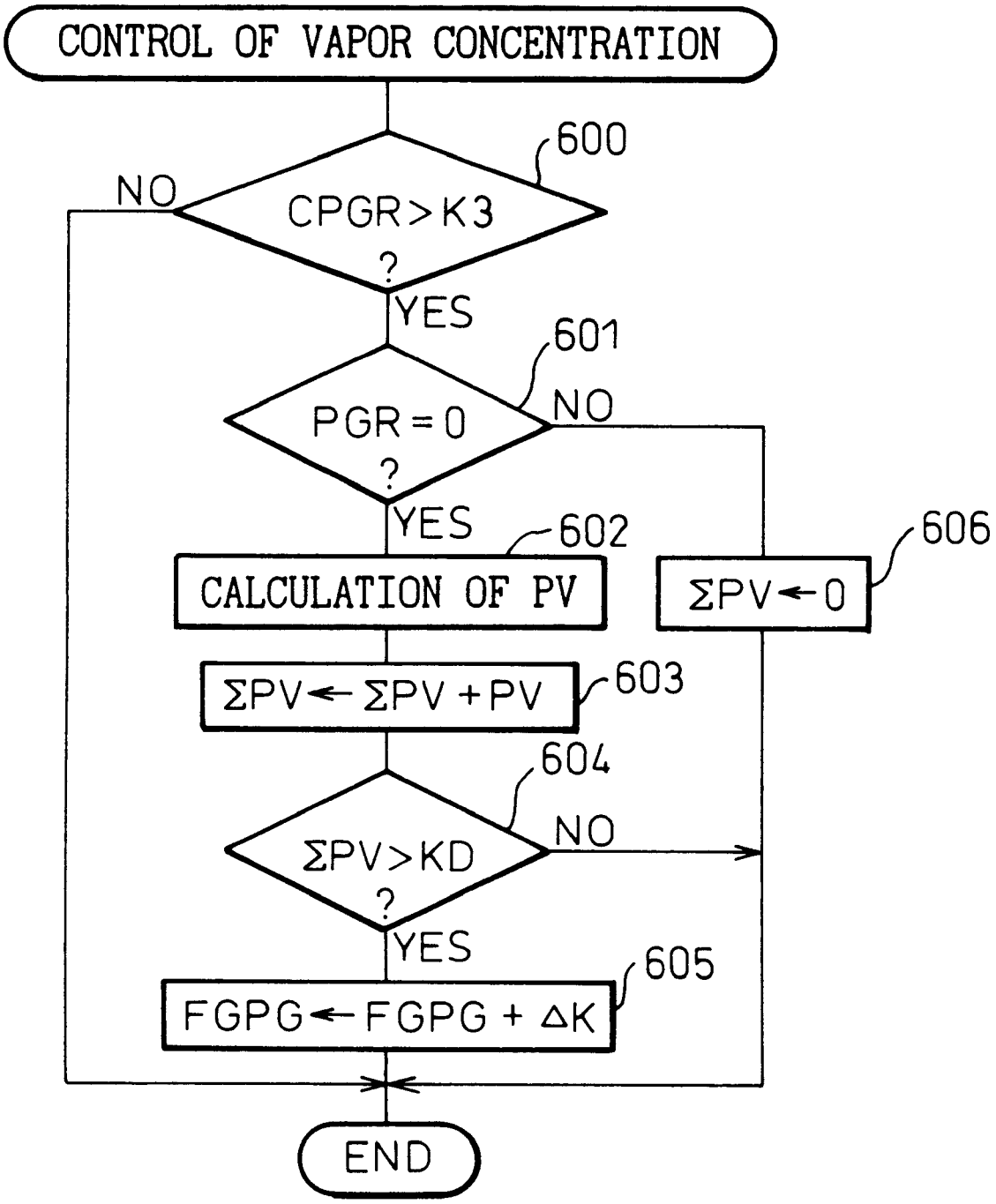
FIG. 21 is a flow chart of the control of the concentration of vapor in a fifth embodiment.

FIG. 20 and FIG. 21 show a fifth embodiment. In this embodiment, the relationship between the fuel temperature TEMP in the fuel tank 15 and the amount of evaporated fuel PV in the fuel tank 15 per unit time is found in advance by experiments and the vapor concentration FGPG is updated at the time of a purge based on this relationship. FIG. 20 shows the relationship between the fuel temperature TEMP in the fuel tank 15 and the amount of evaporated fuel PV in the fuel tank 15 per unit time.

Referring to FIG. 21, first, at step 600, it is judged if the purge time execution count CPGR is larger than the setting K3 or not, that is, if 3 minutes have elapsed from the start of the purge operation after the start of the engine operation. When CPGR≦K3, the processing cycle ends. As opposed to this, when CPGR>K3, the routine proceeds to step 601, where it is judged if the purge rate PGR is zero or not. When PGR=0, that is, when the purge operation has been stopped, the routine proceeds to step 602, where the amount of evaporated fuel PV per unit time is calculated based on the fuel temperature TEMP in the fuel tank 15 from the relationship shown in FIG. 20. Next, at step 603, the cumulative value ΣPV (=ΣPV+PV) of the amount of evaporated fuel PV is calculated. Next, at step 604, it is judged if the cumulative value ΣPV has become larger than the predetermined setting KD or not. When ΣPV≧KD, the routine proceeds to step 605, where a predetermined value ΔK is added to the vapor concentration FGPG. Therefore, while ΣPV≧KD, the vapor concentration FGPG is made to gradually increase. On the other hand, when it is judged at step 601 that the purge rate PGR>0, the routine proceeds to step 606, where the cumulative value ΣPV is made zero.

Figure 22:
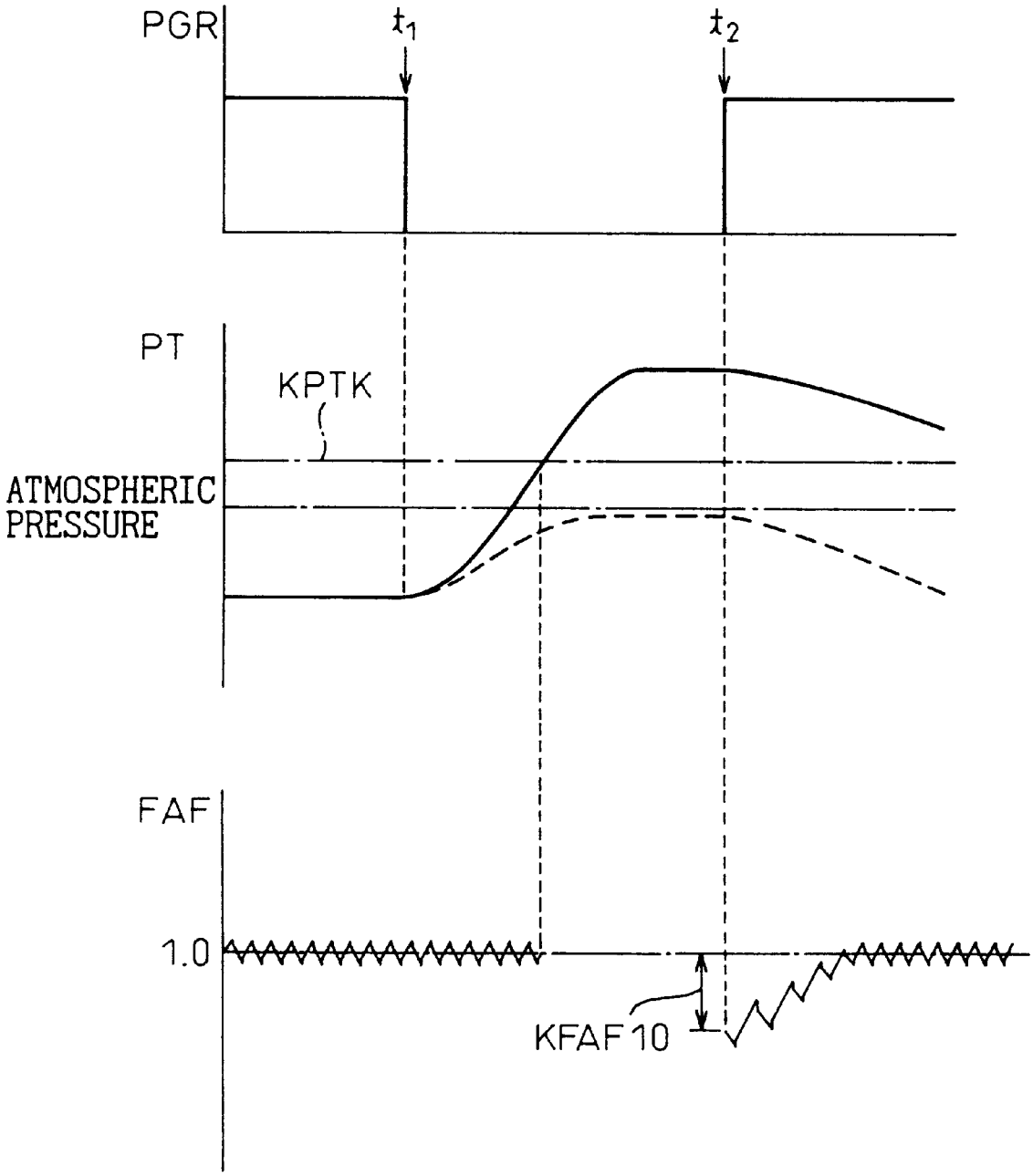
FIG. 22 is a view of changes in the feedback correction coefficient FAF etc.
Figure 23:
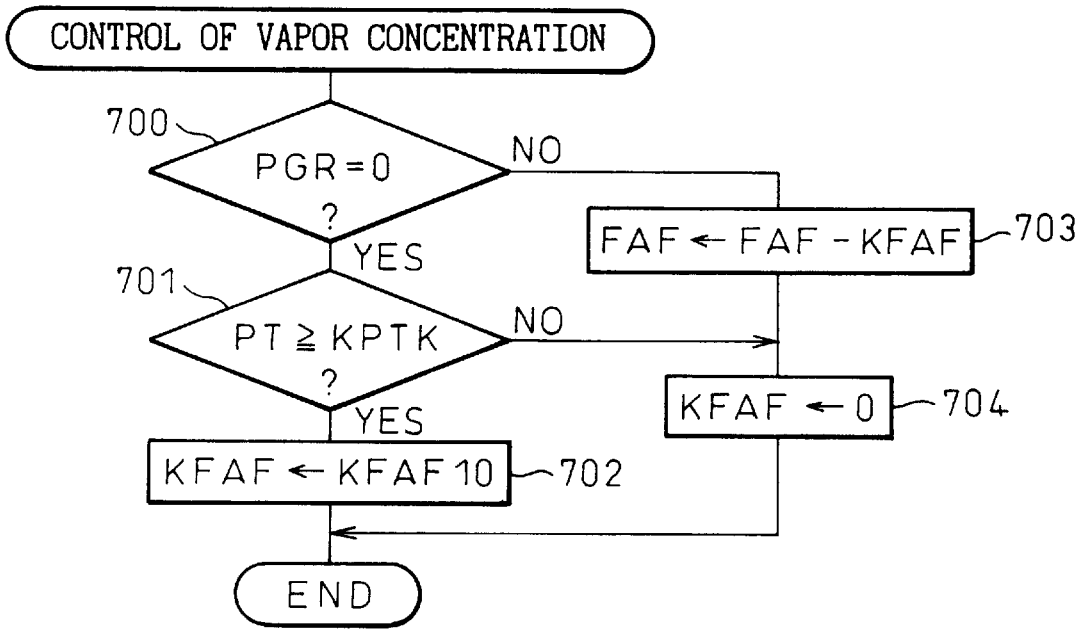
FIG. 23 is a flow chart of the control of the concentration of vapor in a sixth embodiment.

Next, a sixth embodiment will be explained. In this embodiment, when the purge operation is stopped, the vapor concentration of the fuel vapor in the upper space of the fuel tank 15 and in the purge passage from the upper space of the fuel tank 15 to the purge control valve 17 is detected. When the vapor concentration increases when the purge operation is stopped, the value of the feedback correction coefficient FAF at the time of restarting the purge is reduced. FIG. 22 and FIG. 23 show the sixth embodiment in more detail.

FIG. 22, like FIG. 12, shows the case where the purge operation is stopped at t1 and the purge operation is restarted at t2. Further, the solid line shows when the fuel temperature in the fuel tank 15 is high, while the broken line shows when the fuel temperature in the fuel tank 15 is low. In the sixth embodiment, as shown in FIG. 22, when the pressure PT in the fuel vapor chamber 12 exceeds the predetermined setting KPTK during the purge operation such as shown in FIG. 22, the value of the feedback correction coefficient FAF at the time t2 of the restart of the purge is reduced by exactly the predetermined correction value KFAF10 from the value of $t_1$ immediately before the purge was stopped. In the example shown in FIG. 22, the correction value KFAF10 is made 0.1.

In this way, when the pressure PT in the fuel vapor chamber 12 exceeds the setting KPTK, that is, when the vapor concentration of the purge gas at the time $t_2$ of the restart of the purge becomes higher than the vapor concentration of the purge gas at the time $t_1$ immediately before the purge was stopped, if the value of the feedback correction coefficient FAF at the time $t_2$ when the purge is restarted is reduced by exactly the correction value KFAF10, the air-fuel ratio will not become rich at the time $t_2$ when the purge is restarted and therefore it is possible to inhibit the fluctuation of the air-fuel ratio at the time of restart of the purge.

FIG. 23 shows the routine for control of the vapor concentration for execution of the sixth embodiment. This routine is executed by interruption every predetermined period, for example, 100 msec.

Referring to FIG. 23, first, at step 700, it is judged if the purge rate PGR is zero or not. When PGR=0, that is, when the purge operation is stopped, the routine proceeds to step 701, where it is judged if the pressure PT in the fuel vapor chamber 12 detected by the pressure sensor 32 is higher than the setting KPTK (FIG. 22) or not. When PT≧KPTK, the routine proceeds to step 702, where the correction value KFAF of the feedback correction coefficient FAF is made KFAF10 (FIG. 22). As opposed to this, when PT<KPTK, the routine proceeds to step 704, where KFAF is made zero.

On the other hand, when it is judged at step 700 that PGR>0, that is, when the purge operation is started, the routine proceeds to step 703, where the correction value KFAF is subtracted from the feedback correction coefficient FAF. Next, the routine proceeds to step 704. That is, when PT≧KPTK while the purge is stopped, the FAF at the time of restart of the purge is reduced by exactly the correction value KFAF.

Figure 24:
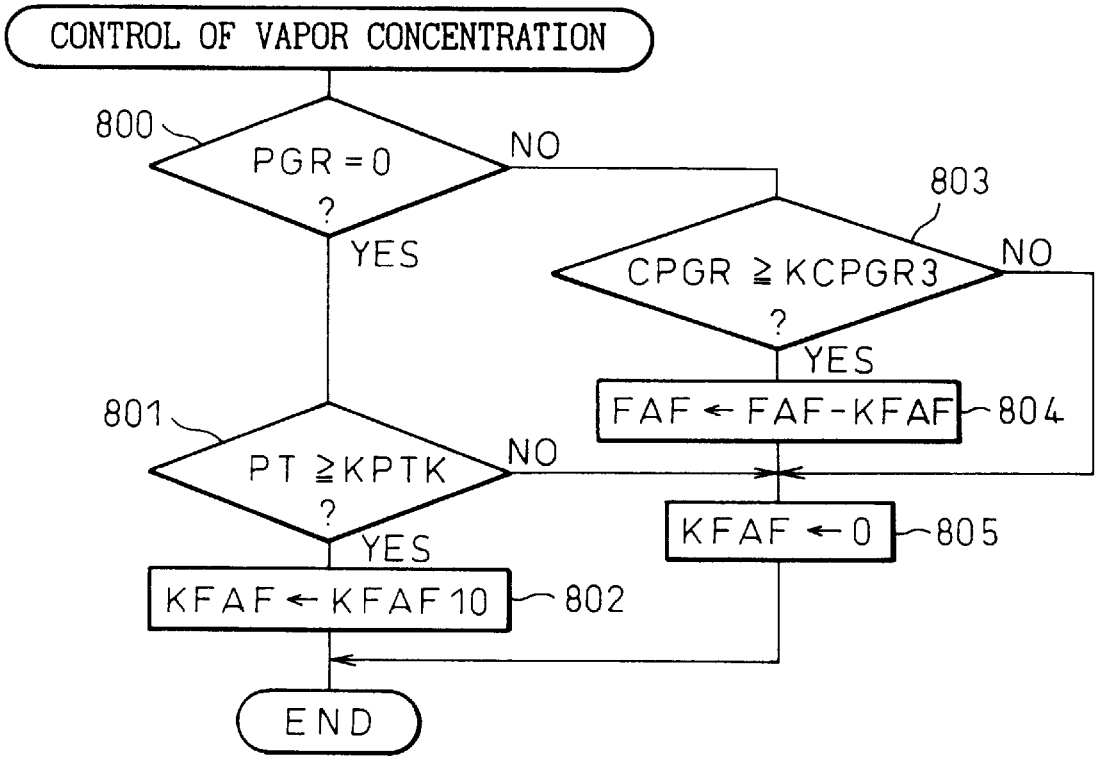
FIG. 24 is a flow chart of a seventh embodiment of the control of the concentration of vapor.

FIG. 24 shows a seventh embodiment of the routine for control of the vapor concentration. This routine is executed by interruption every predetermined period, for example, 100 msec.

This embodiment shows the case where the value of the feedback correction coefficient FAF is reduced when the purge is restarted only when the purge operation will have a major effect on the air-fuel ratio at the time of restart of the purge. For example, when the purge is started for the first time after the engine start, the purge rate PGR is made gradually larger than the small purge rate PGR. In this case, when the purge rate PGR is small, the purge is stopped. When the purge is restarted, if the value of the feedback correction coefficient FAF is reduced, the result is over correction and there is the danger that the air-fuel ratio will become overly lean. To prevent this, in the seventh embodiment, only when the purge execution time count CPGR exceeds a predetermined time KCPGR3, for example, 3 minutes, the feedback correction coefficient FAF is reduced when the purge is restarted.

That is, referring to FIG. 24, first, at step 800, it is judged if the purge rate PGR is zero or not. When PGR=0, that is, when the purge operation is stopped, the routine proceeds to step 801, where it is judged if the pressure PT in the fuel vapor chamber 12 detected by the pressure sensor 32 is higher than the setting KPTK (FIG. 22) or not. When PT≧KPTK, the routine proceeds to step 802, where the correction value KFAF of the feedback correction coefficient FAF is made KFAF10 (FIG. 22). As opposed to this, when PT<KPTK, the routine proceeds to step 805, where KFAF is made zero.

On the other hand, when it is judged at step 800 that PGR>0, that is, when the purge operation is started, the routine proceeds to step 803, where it is judged if the purge execution time count CPGR has become larger than a predetermined time KCPGR3 or not. When CPGR<KCPG3, the routine jumps to step 805. As opposed to this, when CPGR≧KCPGR3, the routine proceeds to step 804, where the correction value KFAF is subtracted from the feedback correction coefficient FAF. Next, the routine proceeds to step 805. That is, when PT>KPTK while the purge is stopped, if CPGR≧KCPGR3 when the purge is restarted, the FAF at the time of restart of the purge is reduced by exactly the correction value FAF.

FIG. 25 to FIG. 28 show a modification of the seventh embodiment wherein the value of the feedback correction coefficient FAF is reduced at the time of restart of the purge only when the purge operation would have a major effect on the air-fuel ratio at the time of restart of the purge. The difference in the routine for control of the vapor concentration shown from FIG. 25 to FIG. 28 from the routine shown in FIG. 24 lies only in step 803 of FIG. 24. The other steps 800, 801, 802, 804, and 805 are the same as the routine of FIG. 24, so only the steps corresponding to step 803 of FIG. 24 will be explained.

Figure 25:
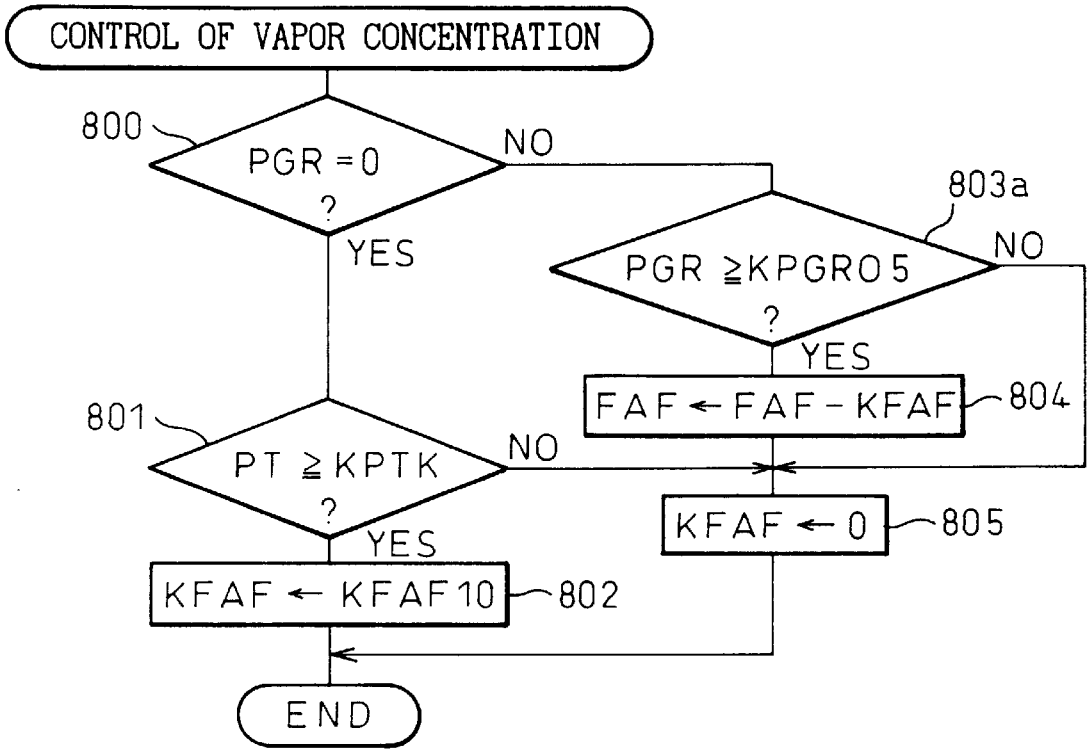
FIG. 25 is a flow chart of the control of the concentration of vapor showing a modification of a seventh embodiment.

In the routine shown in FIG. 25, it is judged at step 803*a* if the purge rate PGR is larger than the predetermined purge rate KPGR05, for example, 0.5 percent. Only when PGR≧KPGR05, the routine proceeds to step 804. That is, when the purge rate PGR is small, the purge is restarted. At this time, if the value of the feedback correction coefficient FAF is reduced, the result is over correction and there is the danger of the air-fuel ratio becoming overly lean. To prevent this, only when the purge rate PGR exceeds the predetermined purge rate KPG05, the feedback correction coefficient FAF is reduced at the time of restart of the purge.

Figure 26:
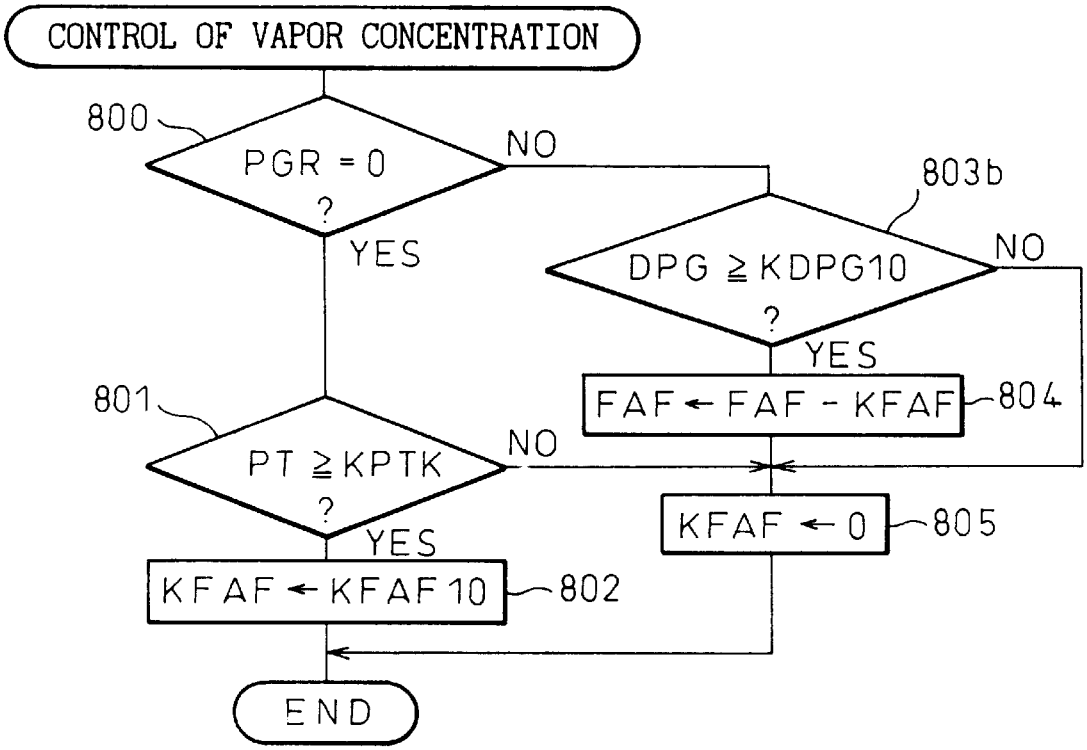
FIG. 26 is a flow chart of the control of the concentration of vapor showing a modification of the seventh embodiment.

In the routine shown in FIG. 26, it is judged at step 803*b* if the duty ratio DPG of the purge control valve 17 is larger than the predetermined duty ratio KDPG10, for example, 10 percent, or not. Only when DPG≧KDPG10, the routine proceeds to step 804. That is, when the duty ratio DPG is small, the purge is restarted. At this time, if the value of the feedback correction coefficient FAF is reduced, the result is over correction and there is the danger that the air-fuel ratio will become overly lean. To prevent this, only when the duty ratio DPG is larger than the predetermined duty ratio KDPG10 is the feedback correction coefficient FAF when the purge is restarted.

Figure 27:
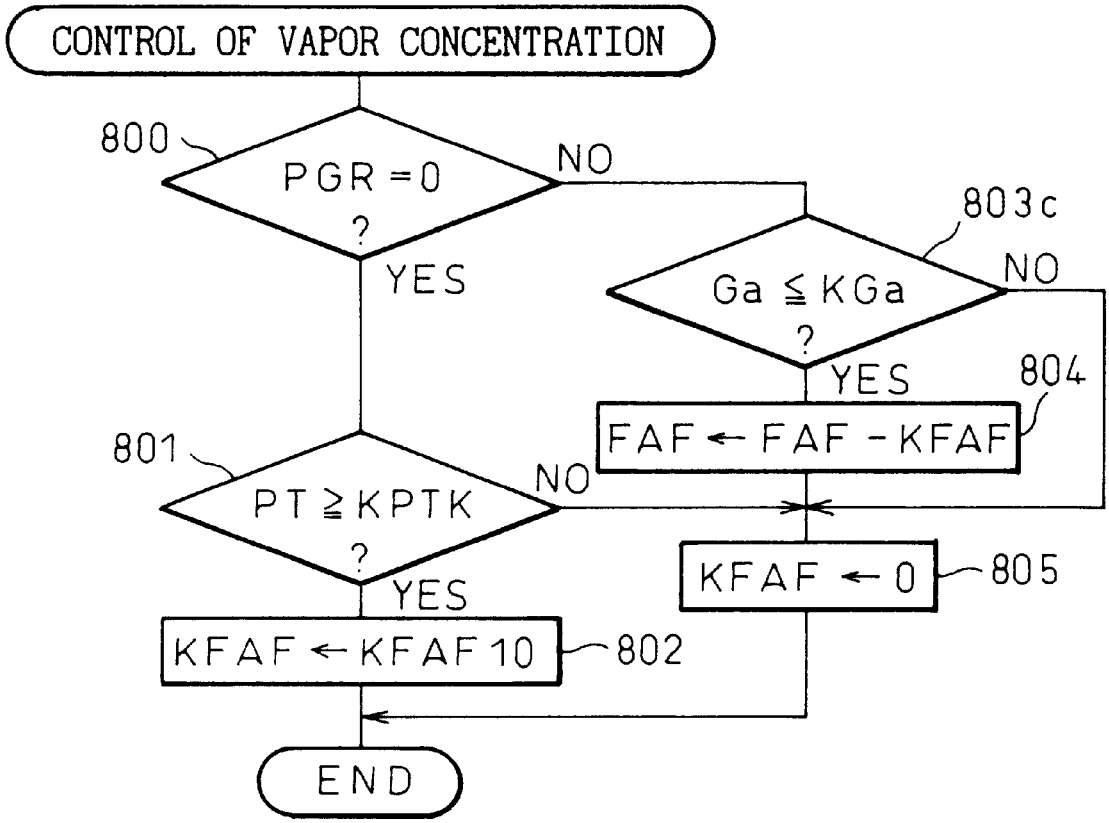
FIG. 27 is a flow chart of the control of the concentration of vapor showing a modification of the seventh embodiment.

In the routine shown in FIG. 27, it is judged at step 803*c* if the amount of intake air Ga is smaller than the predetermined amount of intake air KGa. Only when Ga≦KGa does the routine proceed to step 804. That is, when the amount of intake air is large and the amount of fuel injection is large, the purge is restarted. At this time, if the value of the feedback correction coefficient FAF is reduced, the result is over correction and there is danger of the air-fuel ratio becoming overly lean. To prevent this, only when the amount of intake air Ga is smaller than the predetermined amount of intake air KGa is the feedback correction coefficient FAF reduced at the time of restart of the purge.

Figure 28:
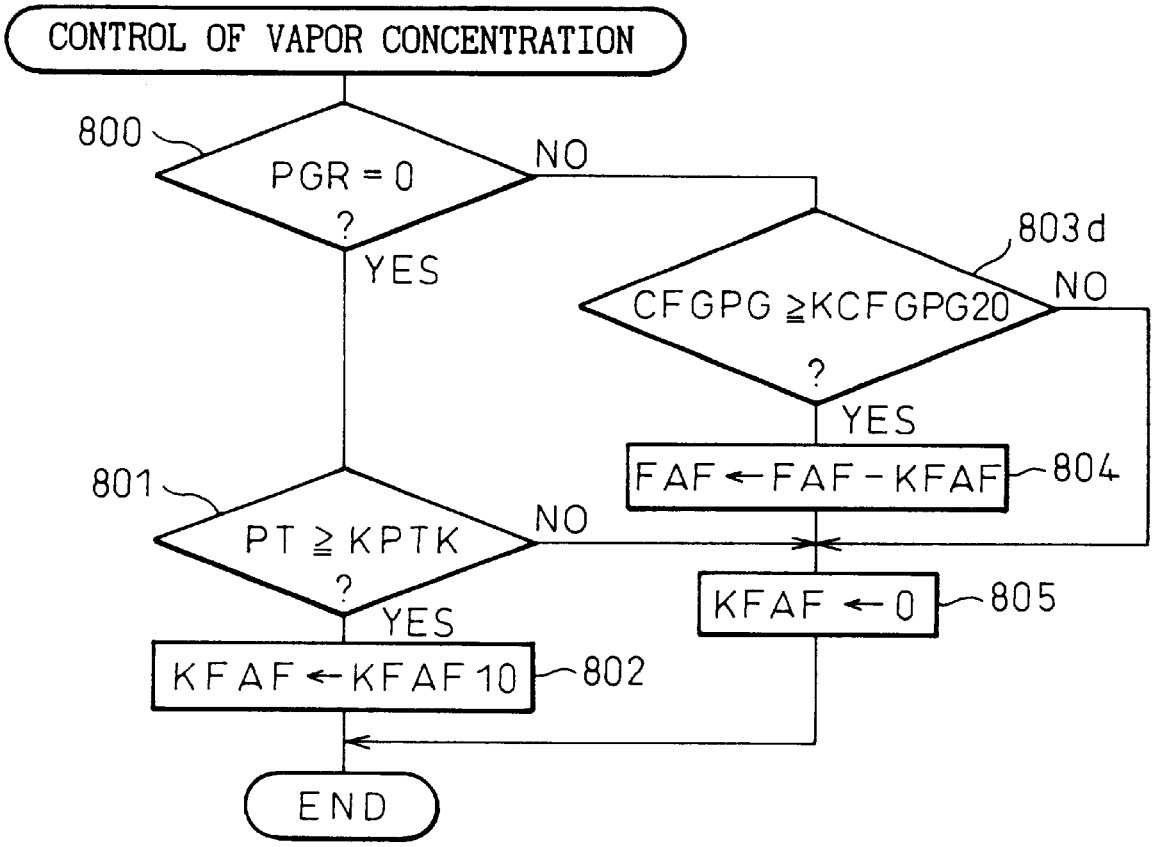
FIG. 28 is a flow chart of the control of the concentration of vapor showing a modification of the seventh embodiment.

In the routine shown in FIG. 28, it is judged at step 803*d* if the number of updates CFGPG of the vapor concentration is larger than the predetermined number KCFGPG20, for example, 20 times. Only when CFGPG≧KCFGPG20 does the routine proceed to step 804. That is, when the number of updates of the vapor concentration is small, the vapor concentration often does not accurately express the actual vapor concentration. If the value of the feedback correction coefficient FAF is reduced when the purge is restarted in such a case, the result is over correction and there is a danger of the air-fuel ratio overly fluctuating. To prevent this, only when the number of updates CFGPG of the vapor concentration is larger than the predetermined number KCFGPG20 is the feedback correction coefficient FAF reduced at the time of restart of the purge.

Figure 29:
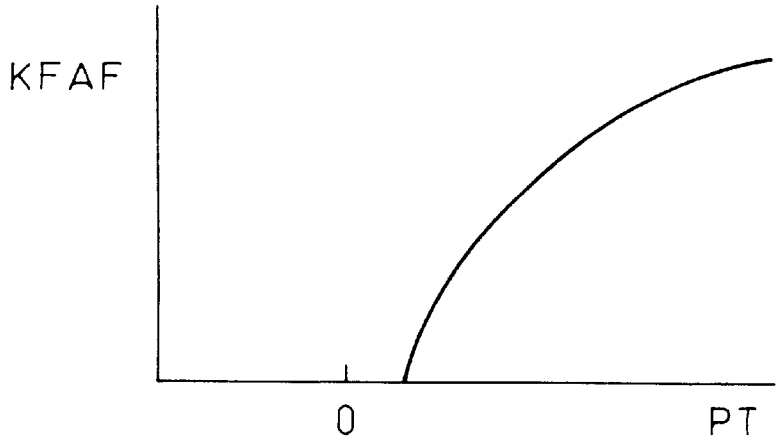
FIG. 29 is a view of the relationship of the pressure PT inside the fuel vapor chamber and the correction amount KFAF.
Figure 30:
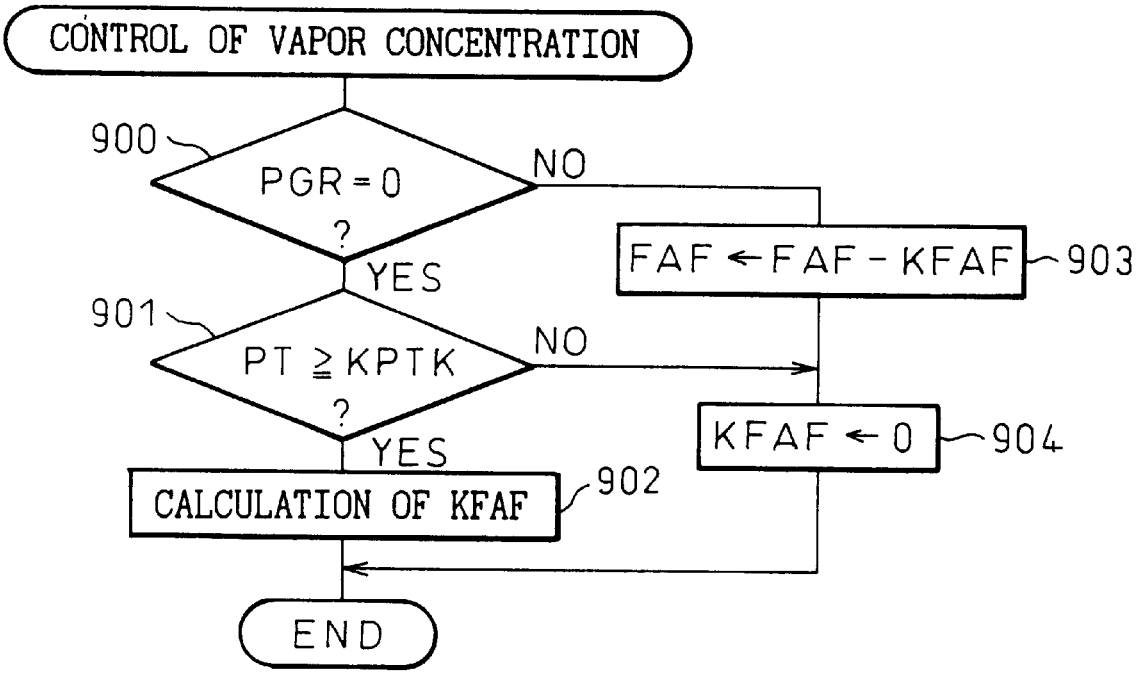
FIG. 30 is a flow chart of the control of the concentration of vapor in an eighth embodiment.

FIG. 29 and FIG. 30 show an eighth embodiment. The higher the pressure PT of the fuel vapor chamber 12 while the purge is stopped, the higher the vapor concentration in the purge gas at the time of restart of the purge. Therefore, in this embodiment, as shown in FIG. 29, the higher the pressure PT in the fuel vapor chamber 12 while the purge is stopped, the larger the correction value KFAF of the feedback correction coefficient FAF is made.

FIG. 30 shows the routine for the control of the vapor concentration for execution of the eighth embodiment. This routine is executed by interruption every predetermined period, for example, 100 msec.

Referring to FIG. 30, first, at step 900, it is judged if the purge rate PGR is zero or not. When PGR=0, that is, when the purge operation is stopped, the routine proceeds to step 901, where it is judged if the pressure PT in the fuel vapor chamber 12 detected by the pressure sensor 32 is higher than the setting KPTK (FIG. 22) or not. When PT≧KPTK, the routine proceeds to step 902, where the correction value KFAF of the feedback correction coefficient FAF is calculated based on the pressure PT from the relationship shown in FIG. 29. As opposed to this, when PT<KPTK, the routine proceeds to step 904, where KFAF is made zero.

On the other hand, when it is judged at step 900 that PGR>0, that is, when the purge operation is started, the routine proceeds to step 903, where the correction value KFAF is subtracted from the feedback correction coefficient FAF. Next, the routine proceeds to step 904. That is, if PT≧KPTK while the purge is stopped, the FAF at the time of restart of the purge is reduced by exactly the correction value KFAF.

Figure 31:
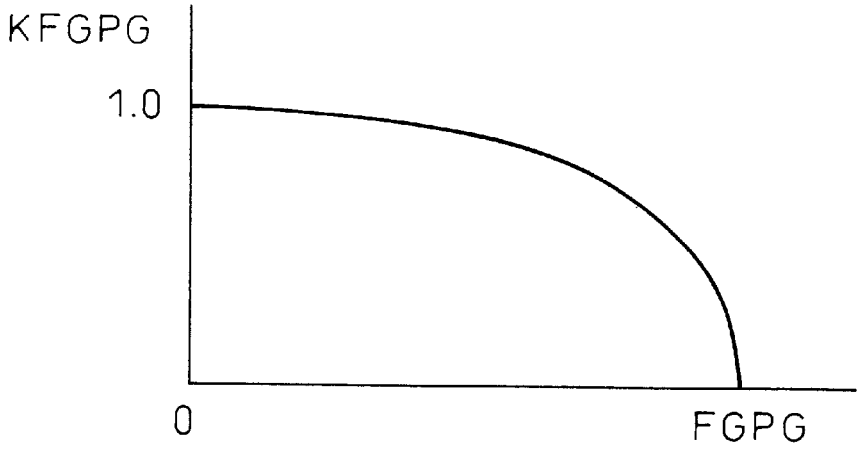
FIG. 31 is a view of the relationship between the concentration of vapor FGPG and the correction coefficient KFGPG.
Figure 32:
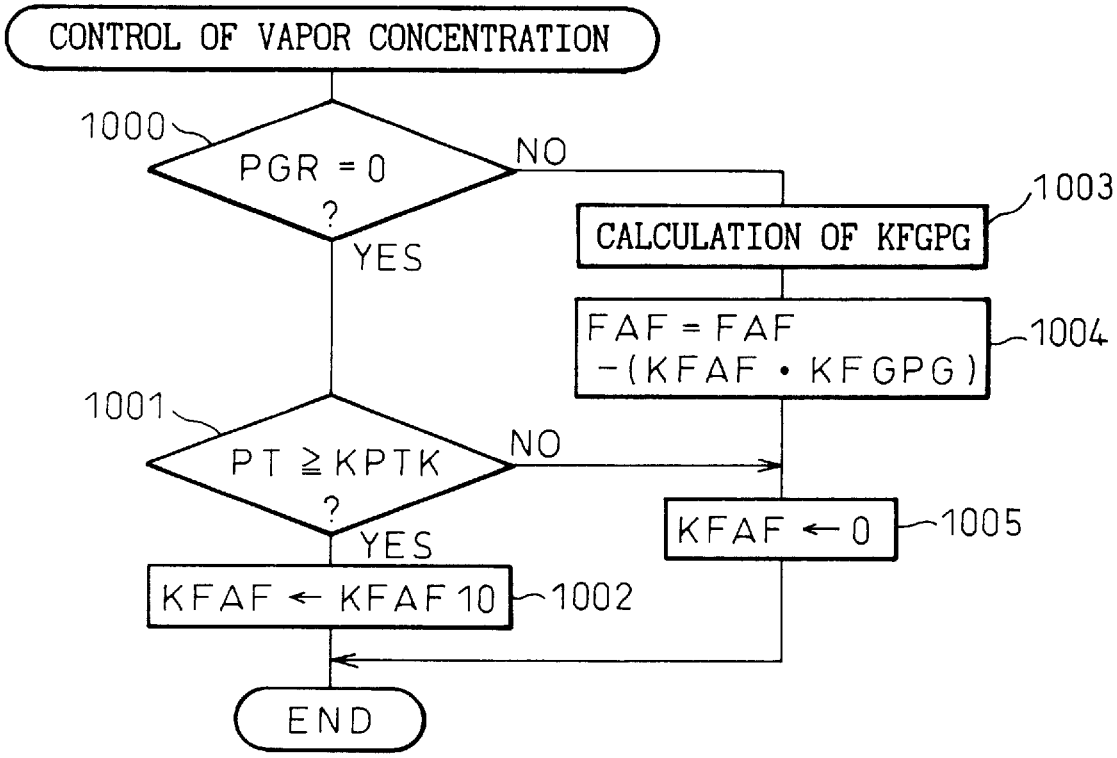
FIG. 32 is a flow chart of the control of the concentration of vapor in a ninth embodiment.

FIG. 31 and FIG. 32 shown a ninth embodiment. Even if the amount of increase of the vapor concentration of the fuel vapor in the upper space of the fuel tank 15 or the purge passage from the upper space of the fuel tank 15 to the purge control valve 17 becomes large, the larger the vapor concentration FGPG immediately before the purge is stopped, the smaller the ratio of change of the vapor concentration FGPG at the time of restart of the purge to the vapor concentration FGPG immediately before the stopping of the purge. Therefore, in this embodiment, the correction coefficient KFGPG is multiplied with the correction value KFAF to find the final correction value (KFAF·KFGPG). This correction coefficient KFGPG is made smaller the larger the vapor concentration FGPG as shown in FIG. 31. By doing this, it is possible to prevent over correction of the vapor concentration FGPG at the time of restart of the purge.

FIG. 32 shows the routine for control of the vapor concentration for execution of a ninth embodiment. This routine is executed by interruption every predetermined period, for example, 100 msec.

Referring to FIG. 32, first, at step 1000, it is judged if the purge rate PGR is zero or not. When PGR=0, that is, when the purge operation is stopped, the routine proceeds to step 1001, where it is judged if the pressure PT in the fuel vapor chamber 12 detected by the pressure sensor 32 is higher than the setting KPTK (FIG. 22) or not. When PT≧KPTK, the routine proceeds to step 1002, where the correction value KFAF of the feedback correction coefficient FAF is made KFAF10 (FIG. 22). As opposed to this, when PT<KPTK, the routine proceeds to step 1005, where KFAF is made zero.

On the other hand, when it is judged at step 1000 that PGR>0, that is, when the purge operation is started, the routine proceeds to step 1003, where the correction coefficient KFGPG is calculated based on the vapor concentration FGPG from the relationship shown in FIG. 31. Next, at step 1004, the feedback correction coefficient FAF is calculated based on the following equation:

$$FAF=FAF-(KFAF\cdot KFGPG)$$

That is, the correction value KFAF and the correction coefficient KFGPG are subtracted from the feedback correction coefficient FAF. Next, the routine proceeds to step 1005. Therefore, in this embodiment, when PT≧KPTK while the purge is stopped, the FAF at the time of the purge is reduced by exactly KFAF·KFGPG.

Figure 33:
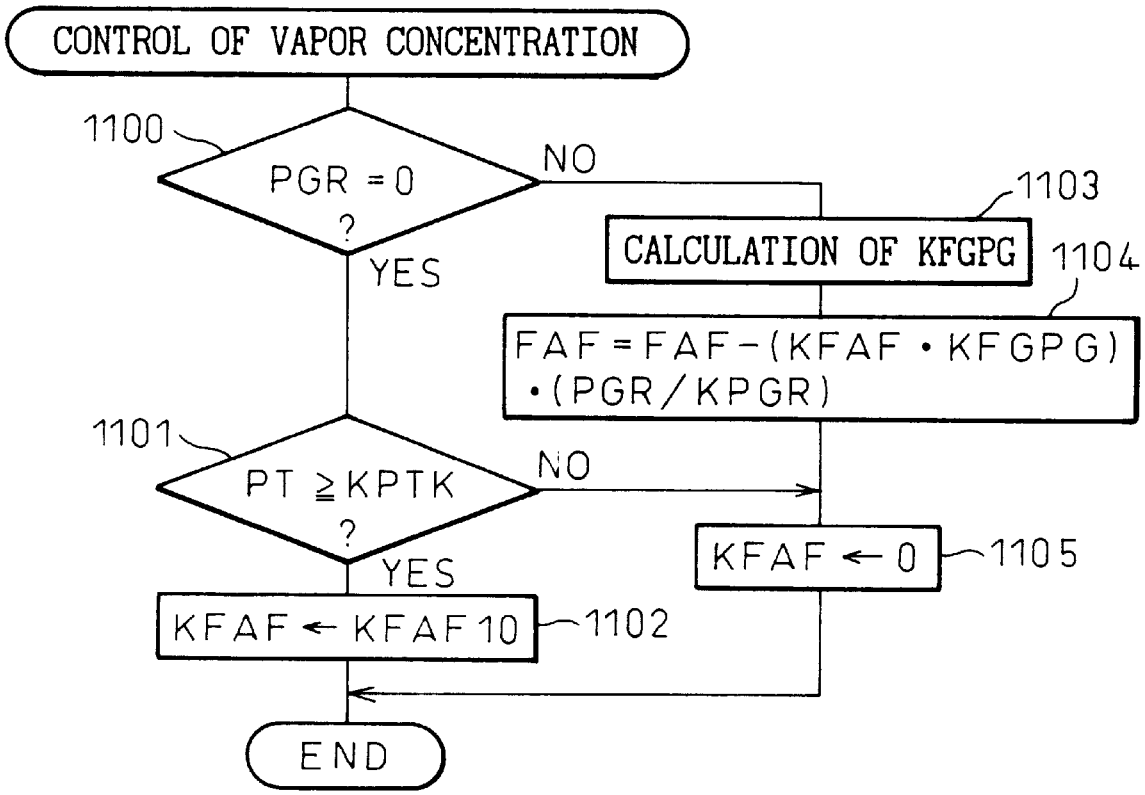
FIG. 33 is a flow chart of a 10th embodiment of the control of the concentration of vapor.

FIG. 33 shows a 10th embodiment. When the amount of increase of the vapor concentration of the fuel vapor inside the upper space of the fuel tank 15 or the purge passage from the upper space of the fuel tank 15 to the purge control valve 17 while the purge is stopped is the same, the higher the purge rate PGR at the time of restart of the purge, the larger the amount of deviation of the air-fuel ratio at the time of restart of the purge. Therefore, in this embodiment, the feedback correction coefficient FAF is found based on the following equation:

$$FAF=FAF-(KFAF\cdot KFGPG)\cdot(PGR/KPGR)$$

Here, KPGR is a predetermined reference purge rate. Therefore, in this embodiment, the correction value KFAF is multiplied with the above-mentioned correction coefficient KFGPG and further multiplied with ratio of the purge rate PGR to the reference purge rate KPGR (PGR/KPGR) to calculate the final correction value.

FIG. 33 shows the routine for control of the vapor concentration for execution of the 10th embodiment. This routine is executed by interruption every predetermined period, for example, 100 msec.

Referring to FIG. 33, first, at step 1100, it is judged if the purge rate PGR is zero or not. When PGR=0, that is, when the purge operation is stopped, the routine proceeds to step 1101, where it is judged if the pressure PT in the fuel vapor chamber 12 detected by the pressure sensor 32 is higher than the setting KPTK (FIG. 22) or not. When PT≧KPTK, the routine proceeds to step 1102, where the correction value KFAF of the feedback correction coefficient FAF is made KFAF10 (FIG. 22). As opposed to this, when PT<KPTK, the routine proceeds to step 1105, where KFAF is made zero.

On the other hand, when it is judged at step 1100 that PGR>0, that is, when the purge operation is started, the routine proceeds to step 1103, where the correction coefficient KFGPG is calculated based on the vapor concentration FGPG from the relationship shown in FIG. 31. Next, at step 1104, the feedback correction coefficient FAF is calculated based on the following equation:

$$FAF=FAF-(KFAF\cdot KFGPG)\cdot(PGR/KPGR)$$

That is, the ratio of the correction value KFAF, the correction coefficient KFGPG, and the purge rate (PGR/KPGR) is subtracted from the feedback correction coefficient FAF. Next, the routine proceeds to step 1105. Therefore, in this embodiment, when PT≧KPTK while the purge is stopped, the FAF at the time of restart of the purge is reduced by exactly KFAF·KFGPG(PGR/KPGR).

Figure 34:
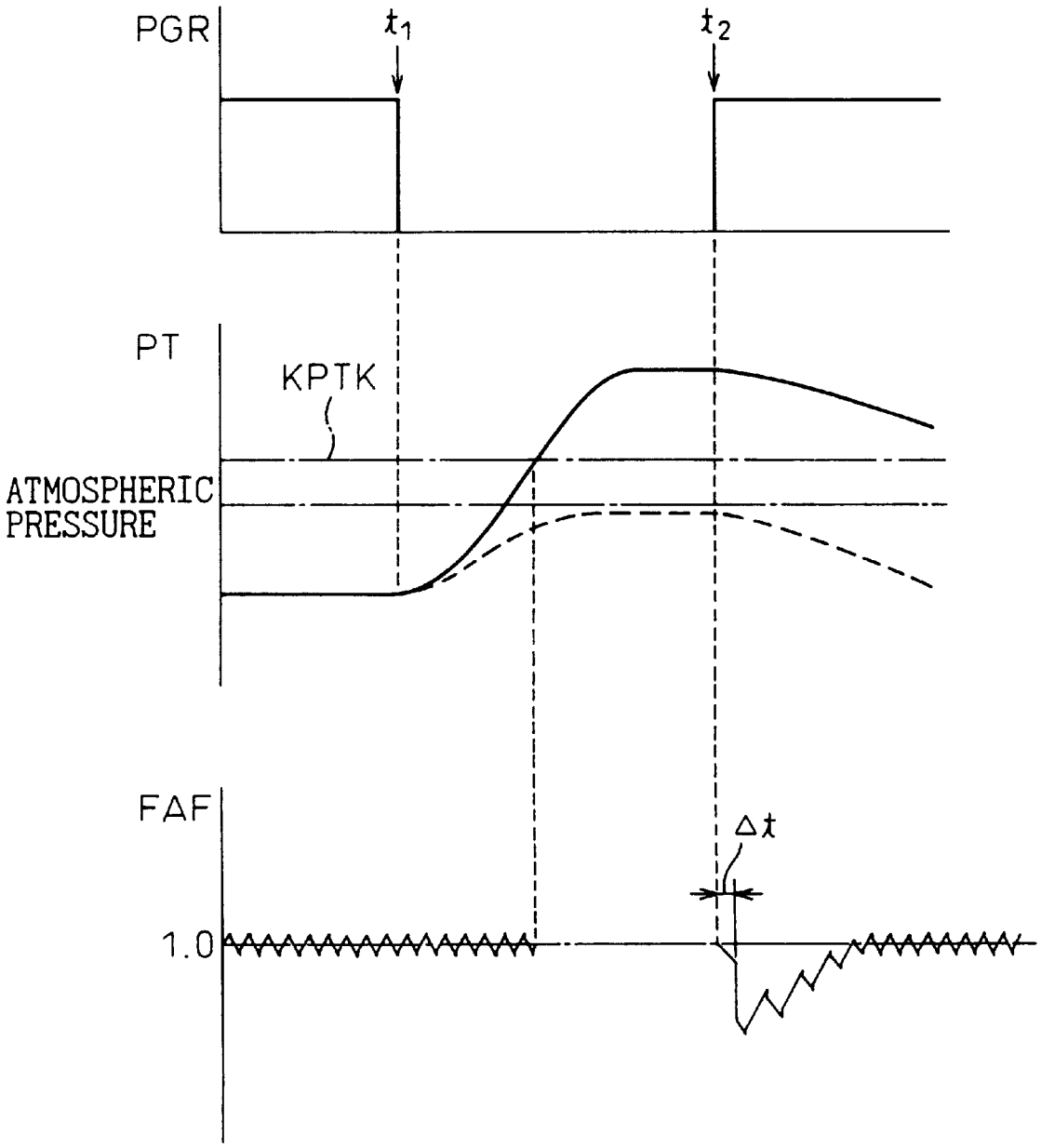
FIG. 34 is a view of the changes in the feedback correction coefficient FAF etc.
Figure 35:
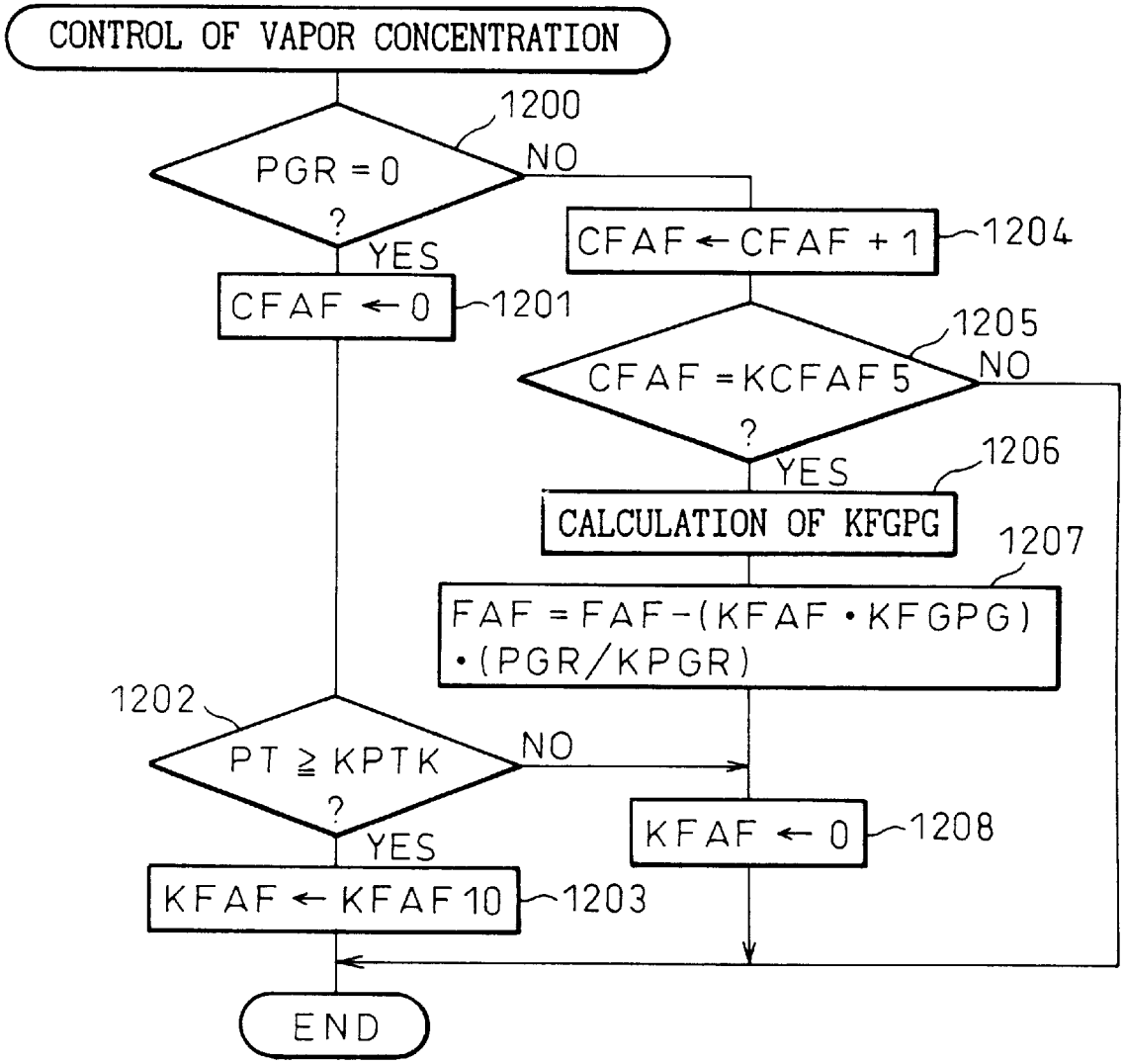
FIG. 35 is a flow chart of the control of the concentration of vapor in an 11th embodiment.

FIG. 34 and FIG. 35 show an 11th embodiment. After the restart of the purge, there is a time lag until the purged fuel vapor reaches the combustion chamber and is made to burn. Therefore, in this embodiment, as shown in FIG. 34, the feedback correction coefficient FAF is reduced after the elapse of the predetermined delay time $\Delta t$ from the time $t_2$ of the restart of the purge.

FIG. 35 shows the routine for control of the vapor concentration for execution of the 11th embodiment. This routine is executed by interruption every predetermined period, for example, 100 msec.

Referring to FIG. 35, first, at step 1200, it is judged if the purge rate PGR is zero or not. When PGR=0, that is, when the purge operation is stopped, the routine proceeds to step 1201, where the time calculation count CFAF is made zero. Next, the routine proceeds to step 1202, where it is judged if the pressure PT in the fuel vapor chamber 12 detected by the pressure sensor 32 is higher than the setting KPTK (FIG. 22) or not. When PT≧KPTK, the routine proceeds to step 1203, where the correction value KFAF of the feedback correction coefficient FAF is made KFAF10 (FIG. 22). As opposed to this, when PT<KPTK, the routine proceeds to step 1208, where KFAF is made zero.

On the other hand, when it is judged at step 1200 that PGR>0, that is, when the purge operation is started, the routine proceeds to step 1204, where the time calculation count CFAF is incremented by exactly 1. Next, at step 1205, it is judged if the time calculation count CFAF has reached the predetermined count KCFAF5 or not, that is, if the delay time Δt shown in FIG. 34 has been reached from the restart of the purge. When CFAF is not KCFAF5, the processing cycle is ended. As opposed to this, when CFAF=KCFAF5, the routine proceeds to step 1206, where the correction coefficient KFGPG is calculated based on the vapor concentration FGPG from the relationship shown in FIG. 31. Next, at step 1207, the feedback correction coefficient FAF is calculated based on the following equation:

$$FAF=FAF-(KFAF\cdot KFGPG)\cdot(PGR/KPGR)$$

Next, the routine proceeds to step 1208. That is, if PT≧KPTK while the purge is stopped, when the predetermined delay time Δt elapses after the restart of the purge, FAF is reduced by exactly KFAF·KFGPG·(PGR/KPGR).

Figure 36:
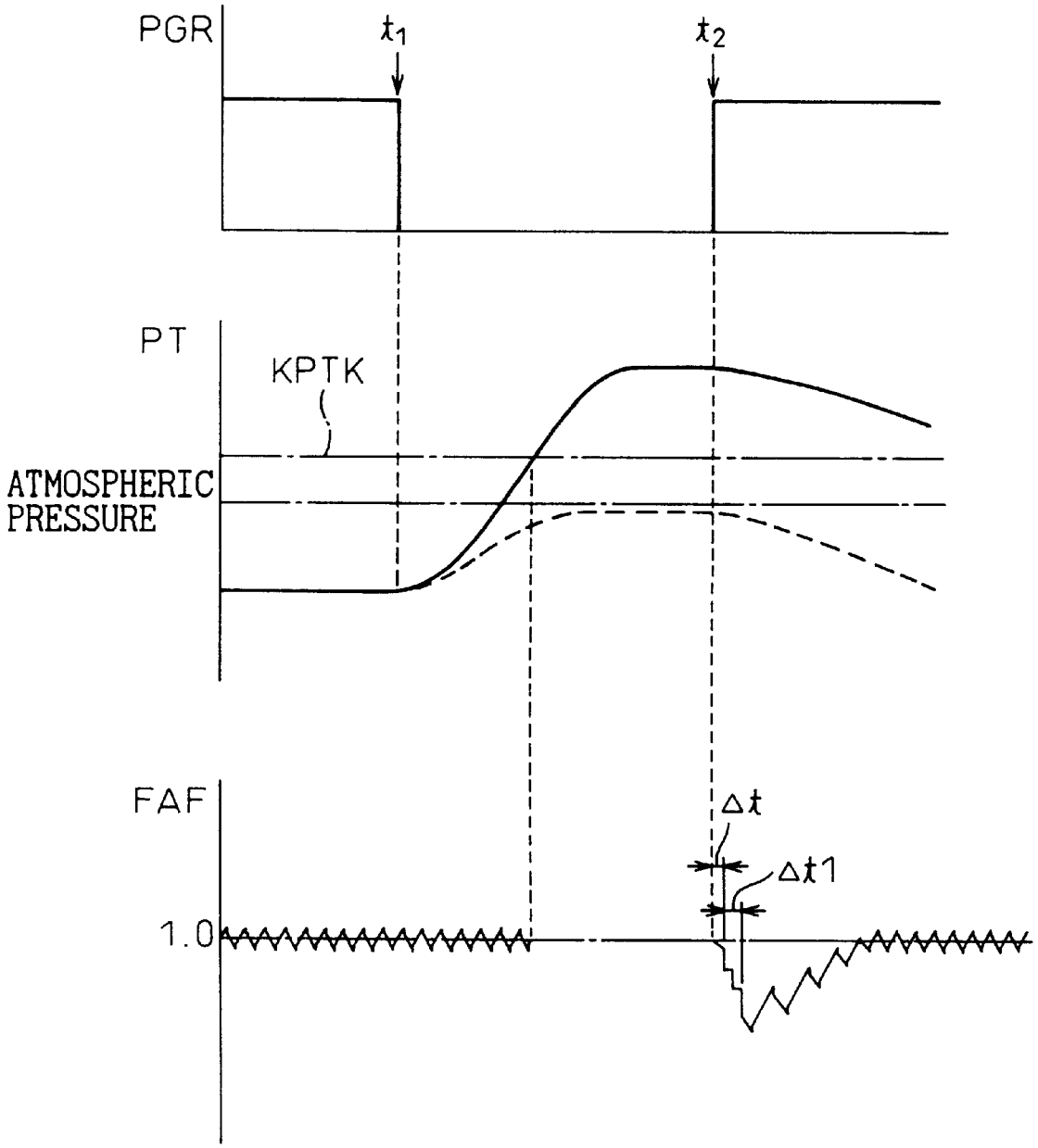
FIG. 36 is a view of the changes in the feedback correction coefficient FAF etc.
Figure 37:
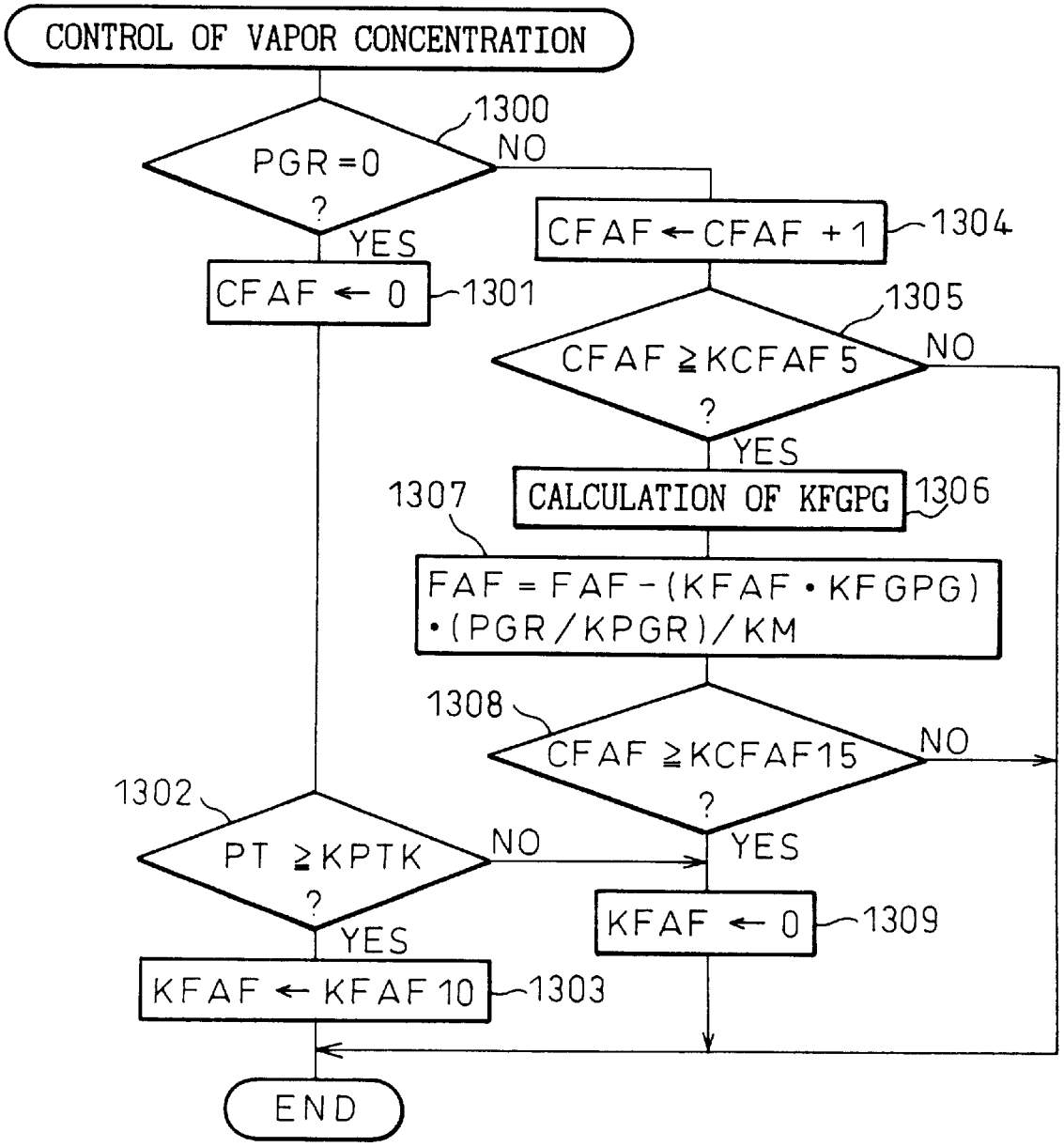
FIG. 37 is a flow chart of the control of the concentration of vapor in a 12th embodiment.

FIG. 36 and FIG. 37 show a 12th embodiment. As explained above, as mentioned above, not only is there a time delay after the restart of the purge until the purged fuel vapor has reached the combustion chamber and is burned, but also the purged fuel vapor mixes with the intake air in the surge tank 5 and then is successively supplied to the cylinders, so the vapor concentration in the intake air supplied to the cylinders successively increases in stages. Therefore, in this embodiment, as shown in FIG. 36, after the predetermined delay time Δt elapses from the time $t_2$ of the restart of the purge, the feedback correction coefficient FAF is reduced little by little in stages across the predetermined time Δt1.

To reduce the feedback correction coefficient FAF in stages in this way, in this embodiment, the feedback correction coefficient FAF is calculated based on the following equation:

$$FAF=FAF-(KFAF\cdot KFGPG)\cdot(PGR/KPGR)/KM$$

Here, KM is a value from 4 to about 8. That is, in this embodiment, FAF is reduced in stages by fractions of KFAF·KFGPG·(PGR/KPGR).

FIG. 37 shows the routine for the control of the vapor concentration for execution of the 12th embodiment. This routine is executed by interruption every predetermined period, for example, 100 msec.

Referring to FIG. 37, first, at step 1300, it is judged if the purge rate PGR is zero or not. When PGR=0, that is, when the purge operation is stopped, the routine proceeds to step 1301, where the time calculation count CFAF is made zero. Next, the routine proceeds to step 1302, where it is judged if the pressure PT in the fuel vapor chamber 12 detected by the pressure sensor 32 is higher than the setting KPTK (FIG. 22) or not. When PT≧KPTK, the routine proceeds to step 1303, where the correction value KFAF of the feedback correction coefficient FAF is made KFAF10 (FIG. 22). As opposed to this, when PT<KPTK, the routine proceeds to step 1309, where KFAF is made zero.

On the other hand, when it is judged at step 1300 that PGR>0, that is, when the purge operation is started, the routine proceeds to step 1304, where the time calculation count CFAF is incremented by exactly 1. Next, at step 1305, it is judged if the time calculation count CFAF has exceeded a predetermined count KCFAF5 or not, that is, if a delay time Δt shown in FIG. 36 has been reached from when the purge is restarted or not. When CFAF<KCFAF5, the processing cycle ends. As opposed to this, when CFAF≧KCFAF5, the routine proceeds to step 1306, where the correction coefficient KFGPG is calculated from the relationship shown in FIG. 31 based on the vapor concentration FGPG. Next, at step 1307, the feedback correction coefficient FAF is calculated based on the following equation:

$$FAF=FAF-(KFAF\cdot KFGPG)\cdot(PGR/KPGR)/KM$$

Next, at step 1308, it is judged if the time calculation count CFAF has exceeded the predetermined count KCFAF15 or not, that is, if the time range Δt1 of FIG. 36 has been exceeded or not. When CFAF<KCFAF15, the processing cycle ends. As opposed to this, when CFAF≧KCFAF15, the routine proceeds to step 1309. That is, when PT≧KPTK while the purge is stopped, when a predetermined delay time Δt has elapsed after the restart of the purge, FAF is reduced in stages by KFAF·KFGPG·(PGR/KPGR)/KM at a time for the predetermined time Δt1.

Figure 38:
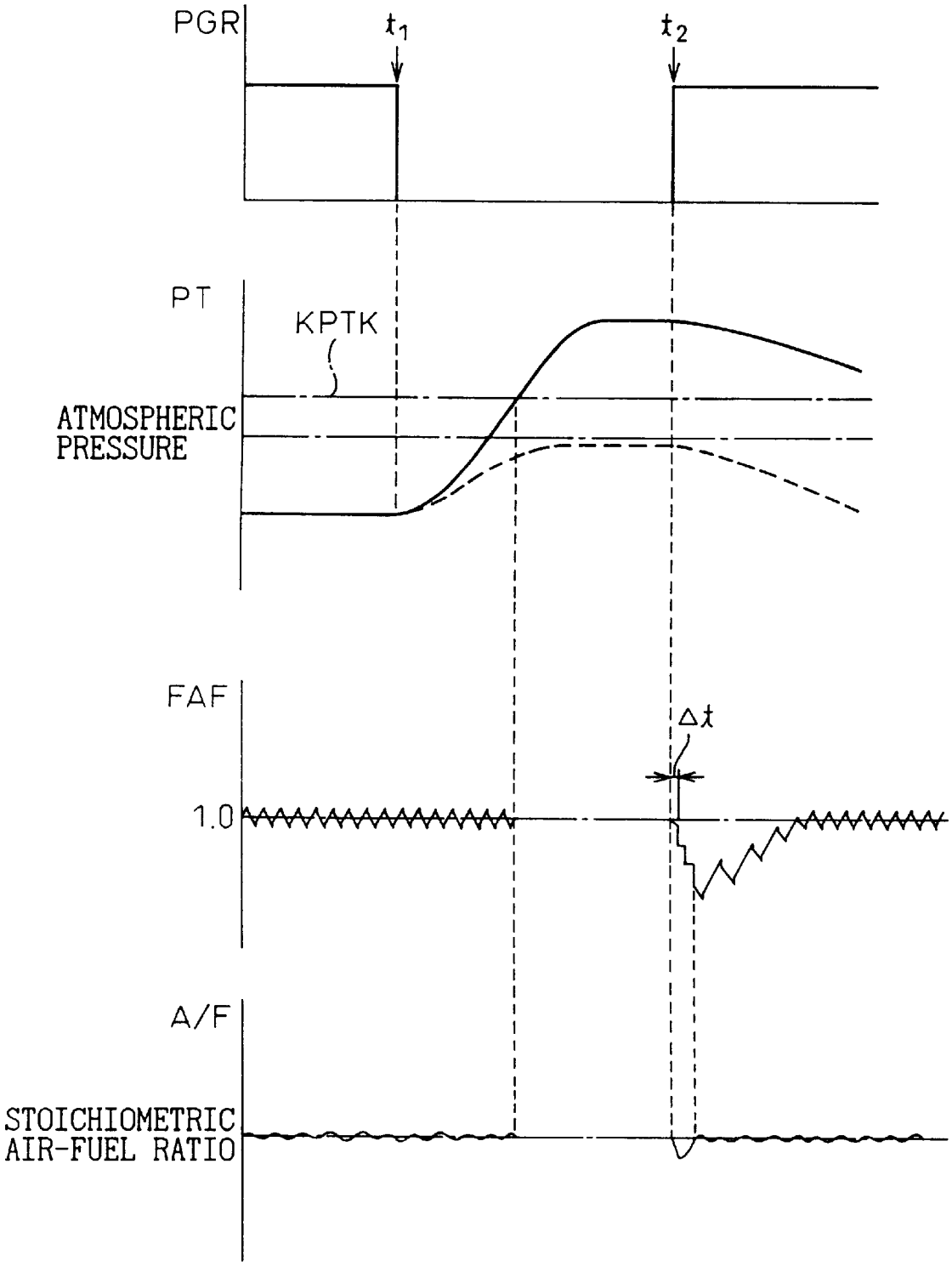
FIG. 38 is a view of the changes in the feedback correction coefficient FAF etc.
Figure 39:
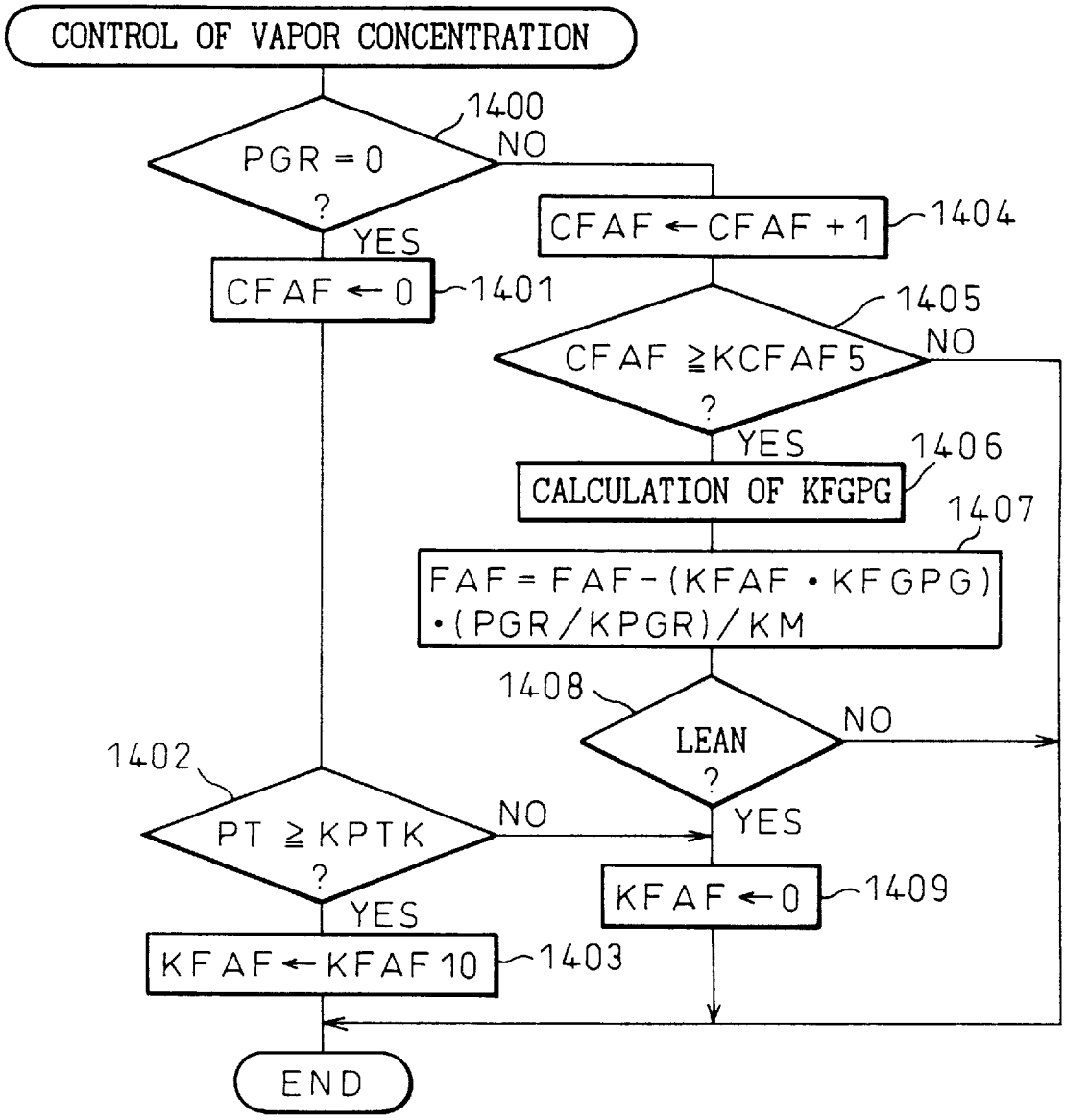
FIG. 39 is a flow chart of the control of the concentration of vapor in a 13th embodiment.

FIG. 38 and FIG. 39 show a 13th embodiment. In this embodiment, as shown in FIG. 38, the feedback correction coefficient FAF is reduced in stages until the air-fuel ratio becomes lean after the purge is restarted. By doing this, it is possible to inhibit over correction of FAF.

FIG. 39 shows the routine for control of the vapor concentration for execution of the 13th embodiment. This routine is executed by interruption every predetermined period, for example, 100 msec.

Referring to FIG. 39, first, at step 1400, it is judged if the purge rate PGR is zero or not. When PGR=0, that is, when the purge operation is stopped, the routine proceeds to step 1401, where the time calculation count CFAF is made zero. Next, the routine proceeds to step 1402, where it is judged if the pressure PT in the fuel vapor chamber 12 detected by the pressure sensor 32 is higher than the setting KPTK (FIG. 22) or not. When PT≧KPTK, the routine proceeds to step 1403, where the correction value KFAF of the feedback correction coefficient FAF is made KFAF10 (FIG. 22). As opposed to this, when PT<KPTK, the routine proceeds to step 1409, where KFAF is made zero.

On the other hand, when it is judged at step 1400 that PGR>0, that is, when the purge operation is started, the routine proceeds to step 1404, where the time calculation count CFAF is incremented by exactly 1. Next, at step 1405, it is judged if the time calculation count CFAF has exceeded a predetermined count KCFAF5 or not, that is, if a delay time Δt shown in FIG. 38 has been reached from when the purge is restarted or not. When CFAF<KCFAF5, the processing cycle ends. As opposed to this, when CFAF<KCFAF5, the routine proceeds to step 1406, where the correction coefficient KFGPG is calculated from the relationship shown in FIG. 31 based on the vapor concentration FGPG. Next, at step 1407, the feedback correction coefficient FAF is calculated based on the following equation:

$$FAF=FAF-(KFAF\cdot KFGPG)\cdot(PGR/KPGR)/KM$$

Next, at step 1408, it is judged if the air-fuel ratio has become lean from the output signal of the $O_2$ sensor. When the air-fuel ratio is not lean, the processing cycle ends. As opposed to this, when the air-fuel ratio has become lean, the routine proceeds to step 1409. That is, when PT≧KPTK while the purge has stopped, FAF is reduced in stages by KFAF·KFGPG·(PGR/KPGR)/KM at a time until the air-fuel ratio becomes lean after the elapse of the predetermined delay time Δt after the restart of the purge.

Figure 40:
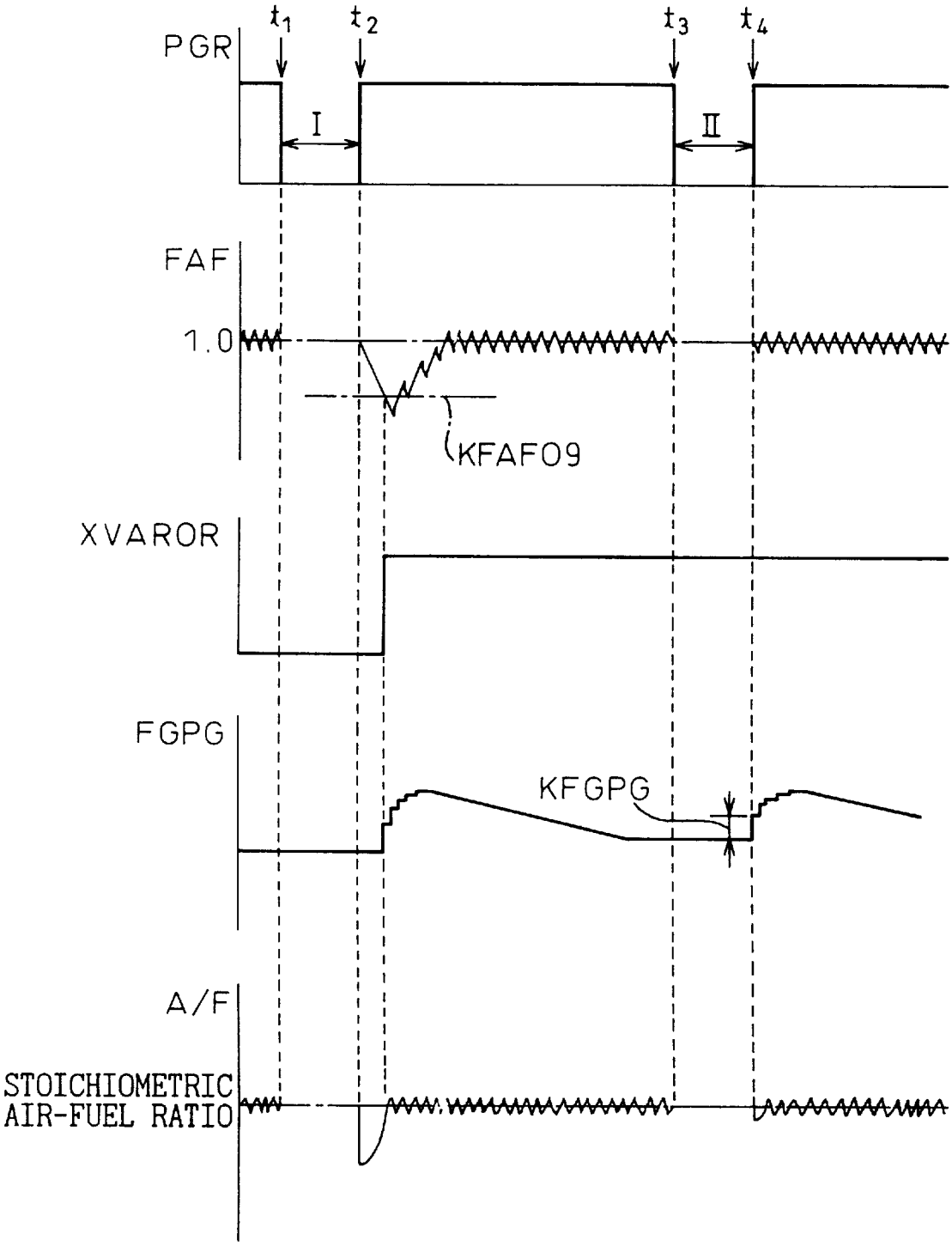
FIG. 40 is a view of the feedback correction coefficient FAF, concentration of vapor FGPG, air-fuel ratio A/F, etc.
Figure 41:
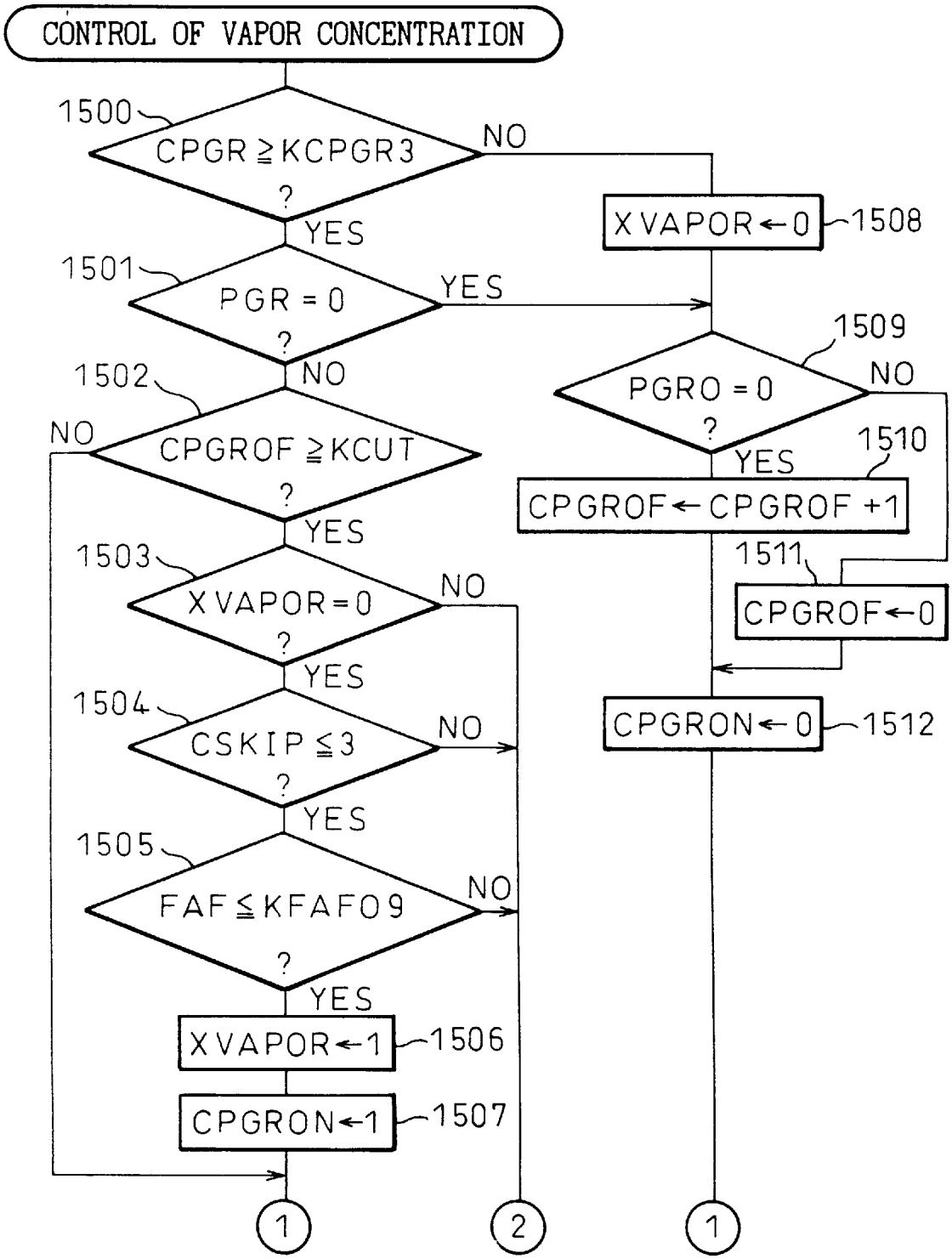
FIGS. 41 and 42 are flow charts of the control of the concentration of vapor in a 14th embodiment.
Figure 42:
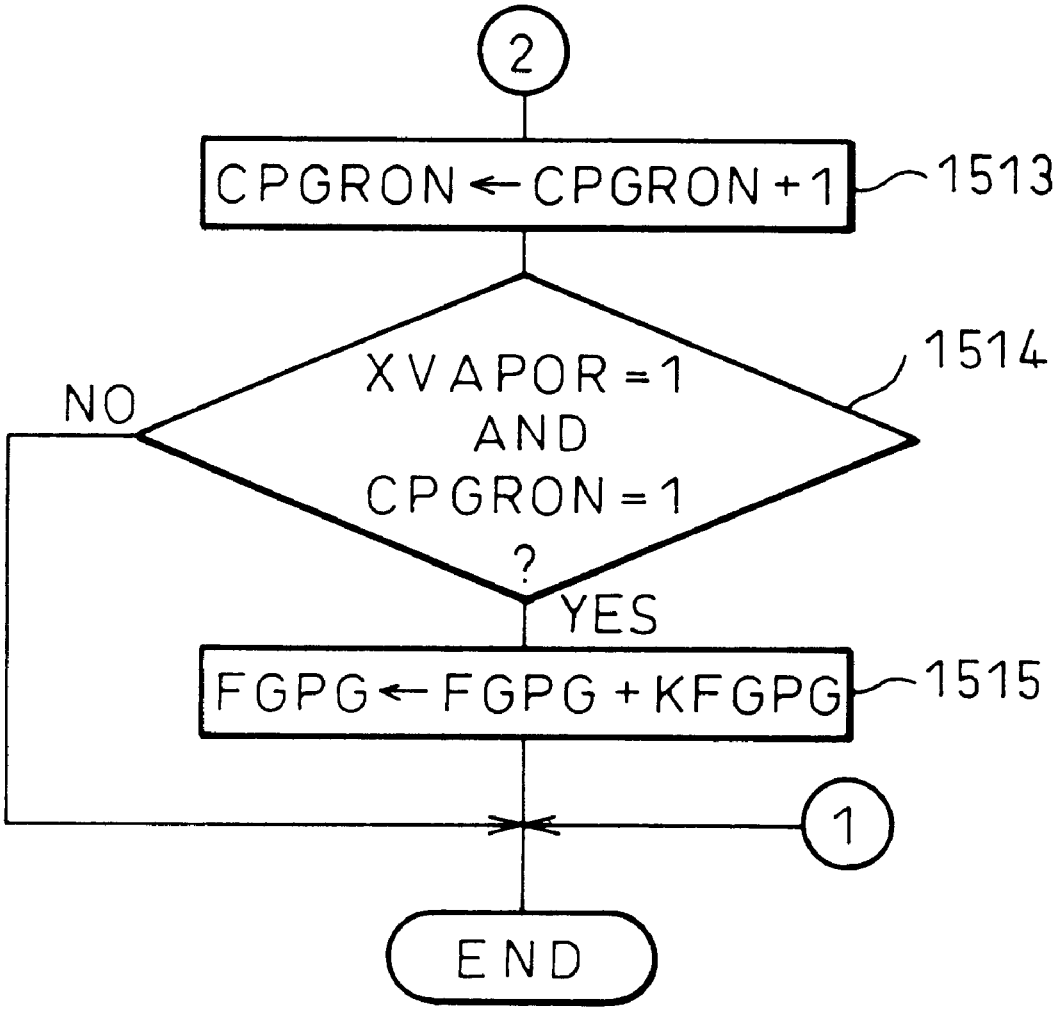

FIG. 40 to FIG. 42 show a 14th embodiment. First, explaining FIG. 40, FIG. 40 shows the first purge stopping action I and the second purge stopping action II. $t_1$ and $t_2$ show the purge stopping timing and the purge restarting timing in the first purge stopping action I. t3 and $t_4$ show the purge stopping timing and the purge restarting timing in the second purge action II.

In this embodiment, it is judged if vapor concentration of the fuel vapor in the upper space in the fuel tank 15 and in the purge passage from the upper space in the fuel tank 15 to the purge control valve 17 has increased while the purge is stopped from the change in the feedback correction coefficient FAF after the start of the purge. For example, in FIG. 40, if vapor concentration of the fuel vapor in the upper space in the fuel tank 15 and in the purge passage from the upper space in the fuel tank 15 to the purge control valve 17 has increased in the first purge stopping period I, the feedback correction coefficient FAF becomes smaller immediately after the restart of the purge ($t_2$ of FIG. 40). In the example shown in FIG. 40, it is judged that the vapor concentration of the fuel vapor in the upper space in the fuel tank 15 and in the purge passage from the upper space in the fuel tank 15 to the purge control valve 17 has increased while the purge is stopped when the feedback correction coefficient FAF has become smaller than the predetermined setting KFAF09, for example, 0.9. At this time, the vapor concentration increase flag XVAPOR showing that the vapor concentration has increased is set.

Once the vapor concentration increase flag XVAPOR is set, the purge is stopped, then the vapor concentration FGPG is made to increase by exactly the predetermined correction value KFGPG each time the purge is restarted, in the example shown in FIG. 40, at the purge restart time $t_4$ after the second purge stopping period II. If the vapor concentration FGPG is made to increase when the purge is restarted in this way, the feedback correction coefficient FAF is maintained at the reference value (=1.0) and the air-fuel ratio A/F is maintained at the stoichiometric air-fuel ratio when the purge is restarted.

FIG. 41 and FIG. 42 show the routine for control of the vapor concentration for execution of a 14th embodiment. This routine is executed by interruption every predetermined period, for example, 100 msec.

Referring to FIG. 41 and FIG. 42, first, at step 1500, it is judged if the purge time execution count CPGR is larger than the setting KCPGR3 or not, for example, if 3 minutes have elapsed from when the purge operation is started after the engine operation has started. When CPGR>KCPGR3, the routine proceeds to step 1508, where the vapor concentration increase flag XVAPOR is reset. Next, at step 1509, it is judged if the purge rate PGR0 at the previous processing cycle was zero or not. When PGR=0, the routine proceeds to step 1510, where the purge stopping time count CPGROF showing the purge stopping time is incremented by exactly 1, then the routine proceeds to step 1512. As opposed to this, when PGR0 is not zero, the routine proceeds to step 1511, where the purge stopping time count CPGROF is made zero, then the routine proceeds to step 1512. At step 1512, the purge time count CPGRON showing the purge continuation time is made zero, then the processing cycle ends.

On the other hand, when it is judged at step 1500 that CPGR≧KCPGR3, the routine proceeds to step 1501, it is judged if the purge rate PGR is zero or not. When PGR=0, the routine proceeds to step 1509. As opposed to this, when PGR>0, that is, when the purge is started, the routine proceeds to step 1502, where it is judged if the purge stopping time count CPGROF is larger than the setting KCUT. When CPGROF≧KCUT, the routine proceeds to step 1503.

At step 1503, it is judged if the vapor concentration increase flag XVAPOR has been set or not. When XVAPOR=0, that is, when the vapor concentration increase flag XVAPOR has been reset, the routine proceeds to step 1504, where it is judged if the number CSKIP of skips S of the feedback correction coefficient FAF after the start of the purge is smaller than 3 or not. When CSKIP≦3, the routine proceeds to step 1505, where it is judged if the feedback correction coefficient FAF has become smaller than the setting KFAF09 (FIG. 40) or not. When FAF≦KFAF09, the routine proceeds to step 1506, where the vapor concentration increase flag XVAPOR is set. That is, when CSKIP≦3, if FAF≦KFAF09, the vapor concentration increase flag XVAPOR is set. Next, at step 1507, the purge time count CPGRON is made 1.

If the vapor concentration increase flag XVAPOR is set, at the next processing cycle, the routine proceeds from step 1503 to step 1513, where the purge time count CPGRON is incremented by exactly 1. Next, at step 1514, it is judged if the vapor concentration increase flag XVAPOR is set and if the purge time count CPGRON is 1 or not. At this time, XVAPOR=1, but CPGRON=2, so the processing cycle ends. At this time, the vapor concentration FGPG is not corrected.

Next, assuming that the purge is once again stopped and that then the purge is restarted, at this time the vapor concentration increase flag XVAPOR is already set, so the routine proceeds from step 1503 to 1513. At this time, the purge time count CPGRON becomes 1. Therefore, at step 1514, it is judged that XVAPOR=1 and CPGRON=1, so the routine proceeds to step 1515 where the predetermined correction value KFGPG is added to the vapor concentration FGPG. Therefore, as explained above referring to FIG. 40, it is possible to inhibit fluctuation of the air-fuel ratio A/F at the time of restart of the purge.

Figure 43:
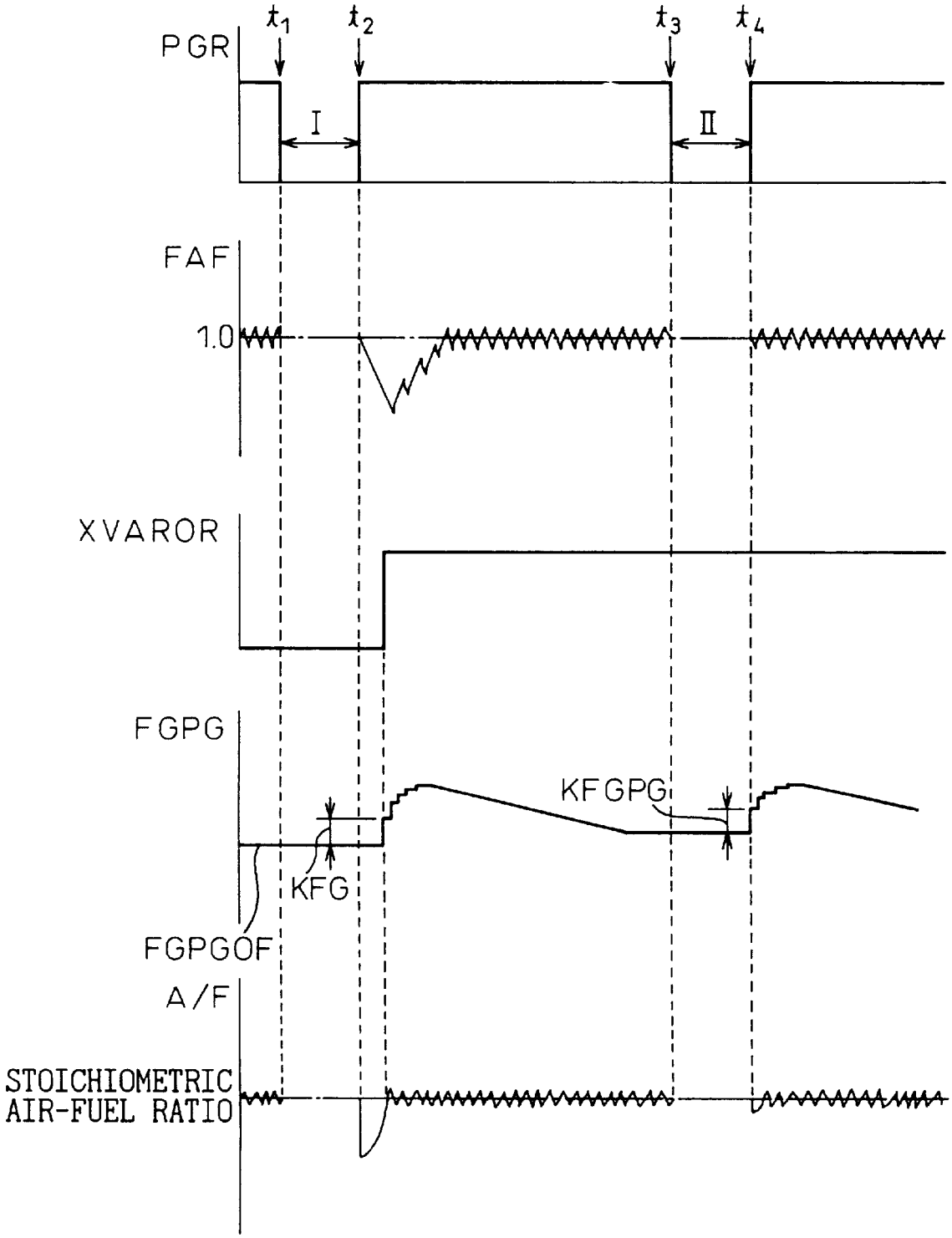
FIG. 43 is a view of the feedback correction coefficient FAF, concentration of vapor FGPG, air-fuel ratio A/F, etc.
Figure 44:
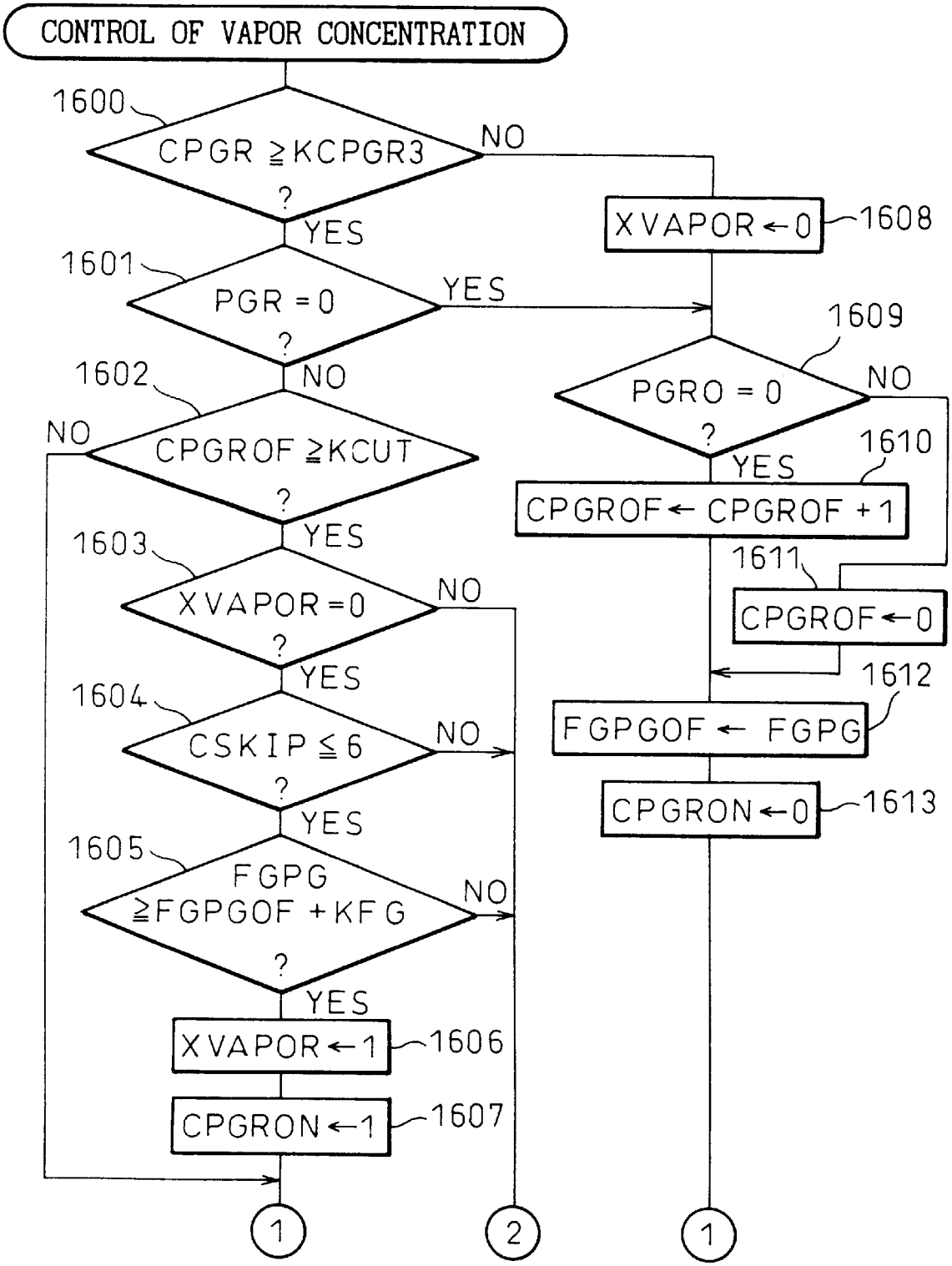
FIGS. 44 and 45 are flow charts of the control of the concentration of vapor in a 15th embodiment.
Figure 45:
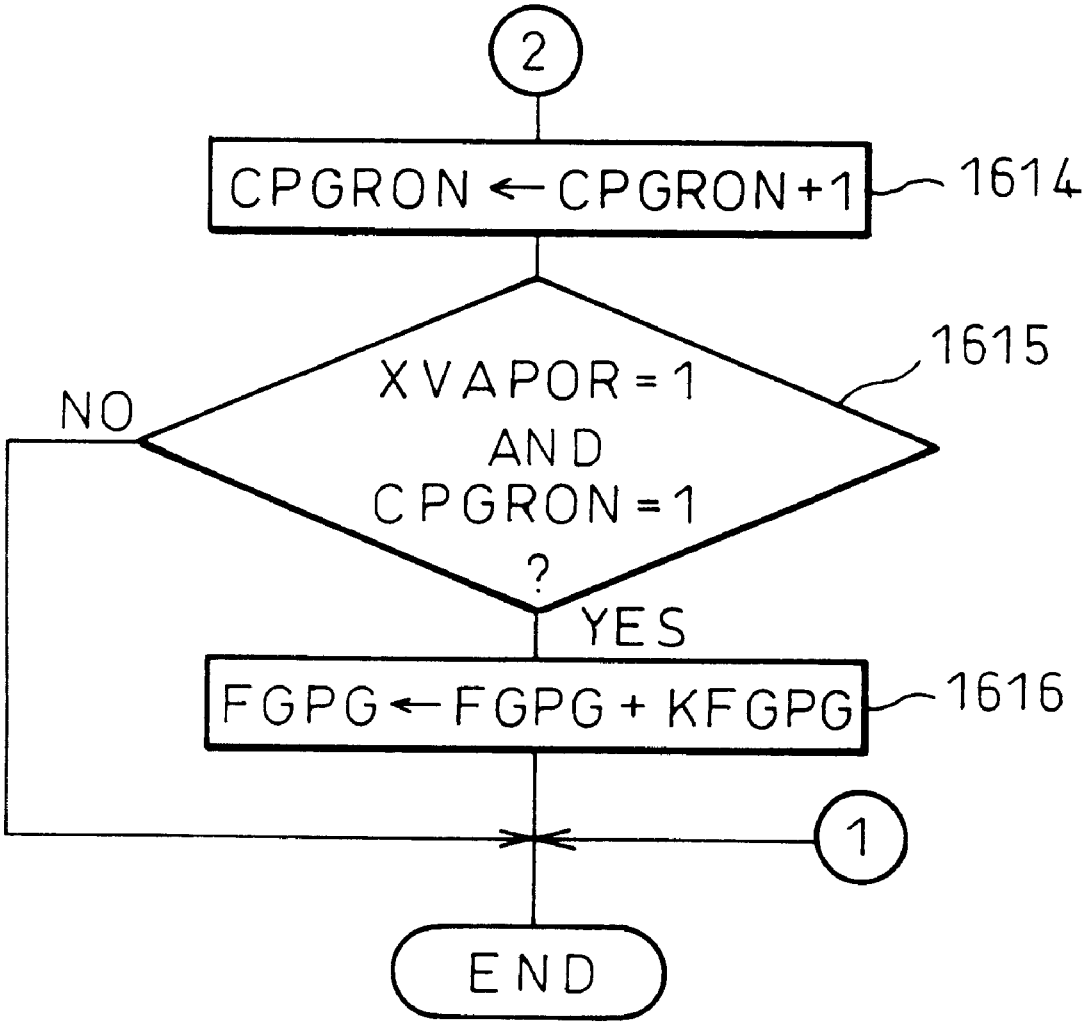

FIG. 43 to FIG. 45 shows a 15th embodiment. In this embodiment, when the vapor concentration at the time of restart of the purge increases more than a predetermined value, it is judged that the vapor concentration of the fuel vapor in the upper space of the fuel tank 15 or the purge passage from the upper space of the fuel tank 15 to the purge control valve 17 has increased while the purge is stopped. That is, in FIG. 43, at the restart of the purge after the first purge stopping period I, when the vapor concentration FGPG has become larger than the setting KFG compared with the vapor concentration FGPGOF immediately before the purge has stopped, that is, when FGPG≧FGPGOF+KFG, the vapor concentration increase flag XVAPOR is set. Then, when the purge is stopped and then the purge is restarted, the vapor concentration FGPG is made to increase by exactly the predetermined correction value KFGPG.

FIG. 44 and FIG. 45 show the routine for control of the vapor concentration for execution of a 15th embodiment. This routine is executed by interruption every predetermined period, for example, 100 msec.

Referring to FIG. 44 and FIG. 45, first, at step 1600, it is judged if the purge time execution count CPGR is larger than the setting KCPGR3 or not, for example, if 3 minutes have elapsed from when the purge operation is started after the engine operation has started. When CPGR>KCPGR3, the routine proceeds to step 1608, where the vapor concentration increase flag XVAPOR is reset. Next, at step 1609, it is judged if the purge rate PGR0 at the previous processing cycle was zero or not. When PGR=0, the routine proceeds to step 1610, where the purge stopping time count CPGROF showing the purge stopping time is incremented by exactly 1, then the routine proceeds to step 1612. As opposed to this, when PGR0 is not zero, the routine proceeds to step 1611, where the purge stopping time count CPGROF is made zero, then the routine proceeds to step 1612. At step 1612, the vapor concentration FGPG is made FGPGOF. Next, at step 1613, the purge time count CPGRON showing the purge continuation time is made zero, then the processing cycle ends.

On the other hand, when it is judged at step 1600 that CPGR≧KCPGR3, the routine proceeds to step 1601, it is judged if the purge rate PGR is zero or not. When PGR=0, the routine proceeds to step 1609. As opposed to this, when PGR>0, that is, when the purge is started, the routine proceeds to step 1602, where it is judged if the purge stopping time count CPGROF is larger than the setting KCUT. When CPGROF≧KCUT, the routine proceeds to step 1603.

At step 1603, it is judged if the vapor concentration increase flag XVAPOR has been set or not. When XVAPOR=0, that is, when the vapor concentration increase flag XVAPOR has been reset, the routine proceeds to step 1604, where it is judged if the number CSKIP of skips S of the feedback correction coefficient FAF after the start of the purge is smaller than 6 or not. When CSKIP≦6, the routine proceeds to step 1605, where it is judged if the vapor concentration FGPG has become larger than the sum (FGPGOF+KFG) of the vapor concentration FGPGOF immediately before the purge was stopped and the setting KFG. When FGPG≧FGPGOF+KFG, the routine proceeds to step 1606, the vapor concentration increase flag XVAPOR is set. That is, when CSKIP≦6, if FGPG≦FGPOF+KFG, the vapor concentration increase flag XVAPOR is set. Next, at step 1607, the purge time count CPGRON is made 1.

If the purge concentration increase flag XVAPOR is set, at the next processing cycle, the routine proceeds from step 1603 to step 1614, where the purge time count CPGRON is incremented by exactly 1. Next, at step 1615, it is judged if the vapor concentration increase flag XVAPOR is set and the purge time count CPGRON is 1 or not. At this time, XVAPOR=1, but CPGRON=2, so the processing cycle ends. At this time, the vapor concentration FGPG is not corrected.

Next, assuming that the purge is again stopped and then the purge is restarted, at this time, the vapor concentration increase flag XVAPOR is already set, so the routine proceeds to step 1603 to step 1614. At this time, the purge time count CPGRON becomes 1. Therefore, at the next step 1615, it is judged if XVAPOR=1 and CPGRON=1, so the routine proceeds to step 1616, where the predetermined correction value KFGPG is added to the vapor concentration FGPG. Therefore, it is possible to inhibit the fluctuation of the air-fuel ratio A/F at the time of restart of the purge.

Figure 46:
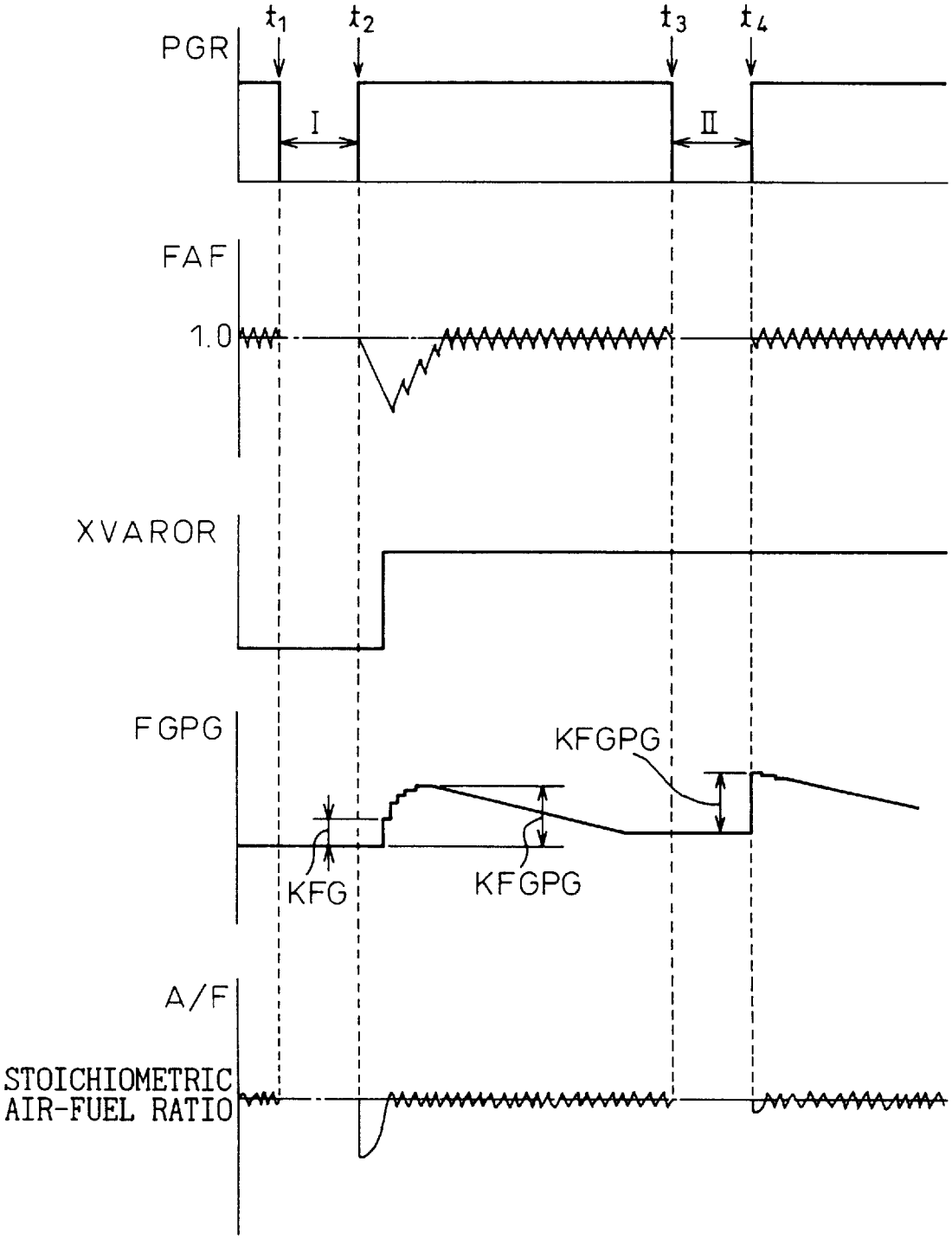
FIG. 46 is a view of the feedback correction coefficient FAF, concentration of vapor FGPG, air-fuel ratio A/F, etc.
Figure 47:
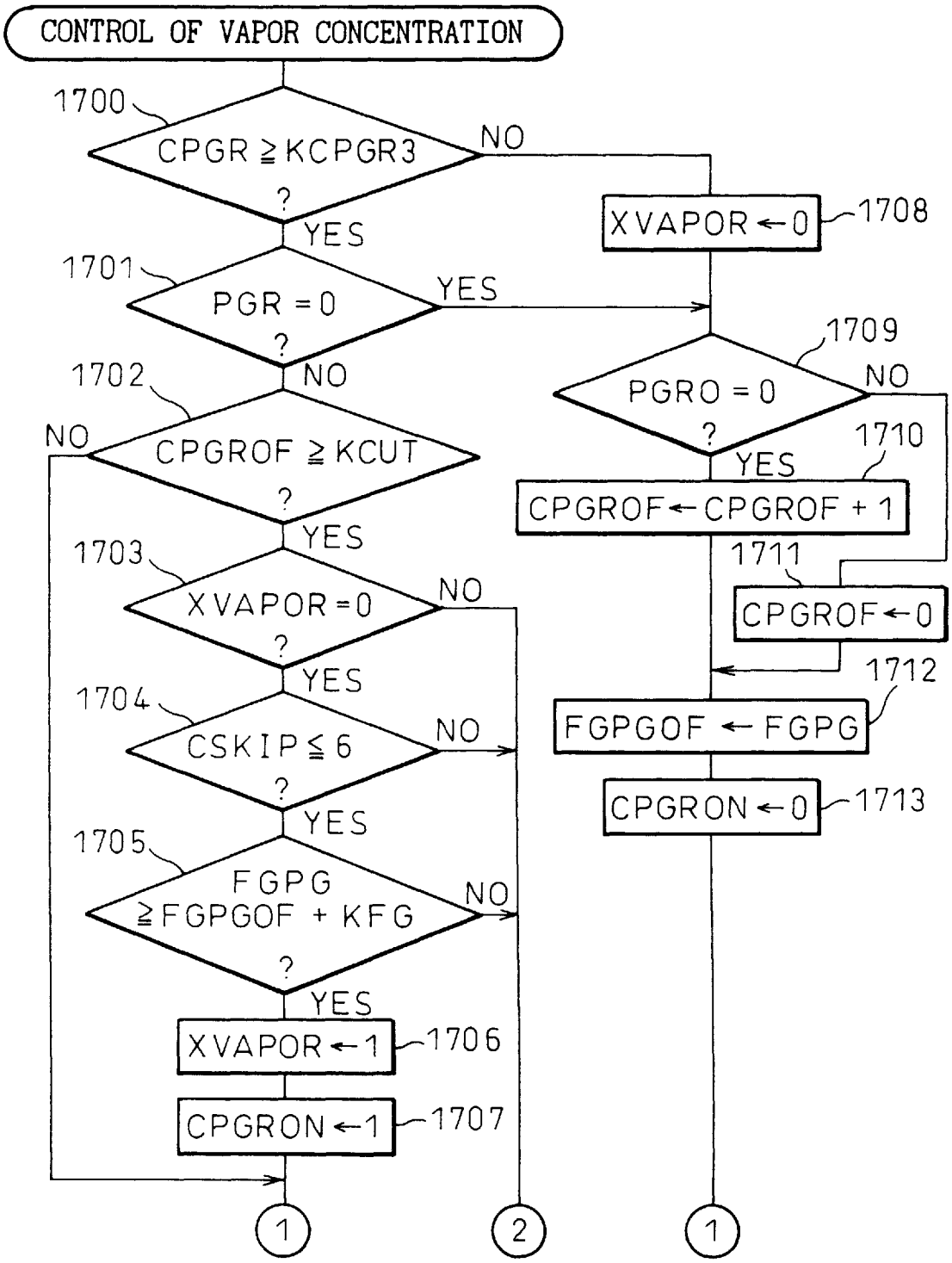
FIGS. 47 and 48 are flow charts of the control of the concentration of vapor in a 16th embodiment.
Figure 48:
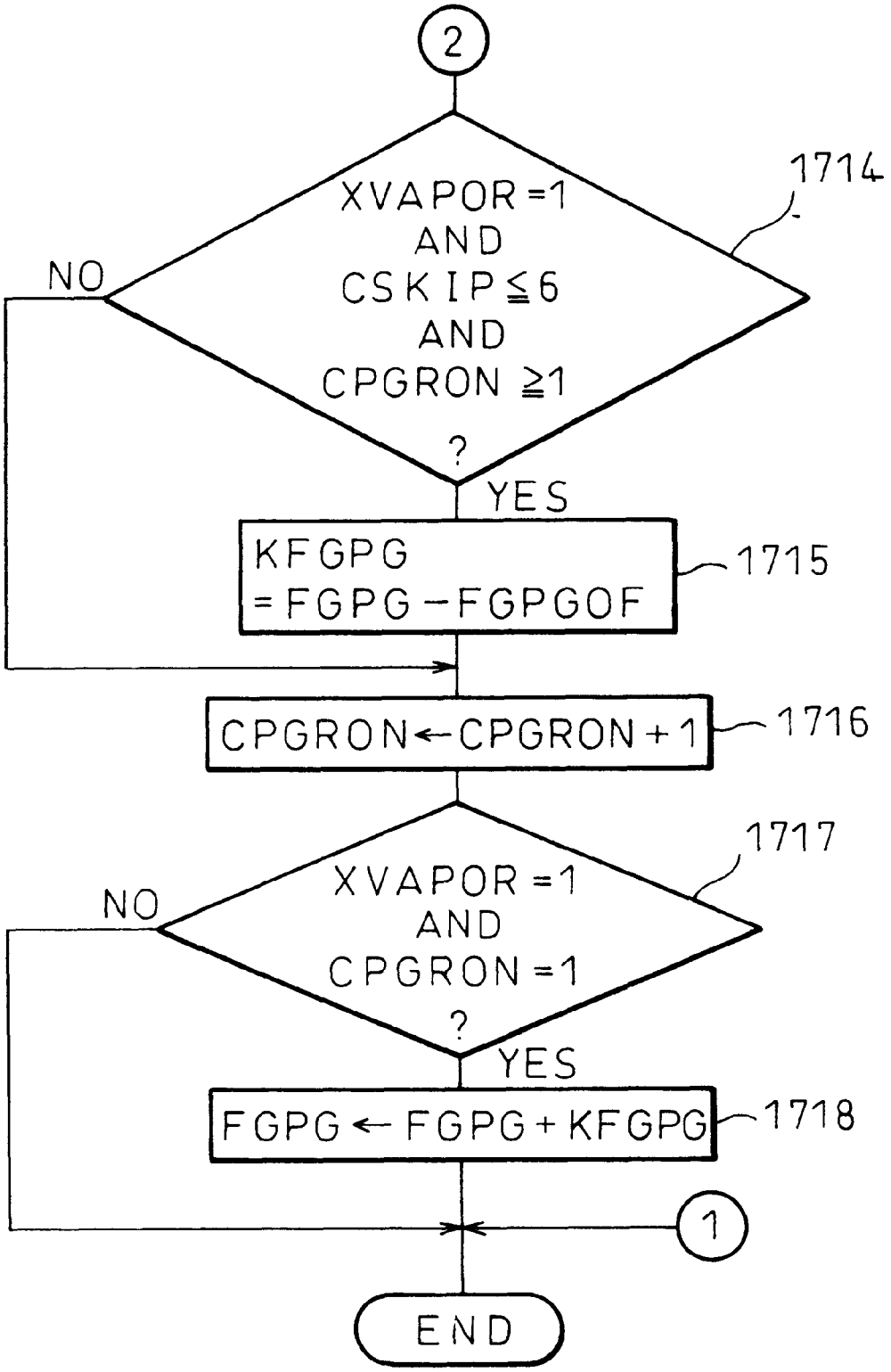

FIG. 46 to FIG. 48 shows a 16th embodiment. In this embodiment, as shown in FIG. 46, substantially the entire KFGPG of the amount of increase of the vapor concentration FGPG after the first purge stopping period I is made the correction value KFGPG of the vapor concentration at the time of restart of the purge after the second purge stopping period II.

FIG. 47 and FIG. 48 show the routine for control of the vapor concentration for execution of a 16th embodiment. This routine is executed by interruption every predetermined period, for example, 100 msec. Note that the routine from step 1700 to step 1713 of FIG. 47 is the same as that of step 1600 to step 1613 of FIG. 44. The difference from the routine shown in FIG. 44 and FIG. 45 lies in the part after step 1714 of FIG. 48. Below, step 1714 of FIG. 48 on will be explained.

After the start of the purge, if FGPG≧FGPGOF+KFG and the vapor concentration increase flag XVAPOR is set, at the next processing cycle, the routine proceeds from step 1703 to step 1714. At step 1714, it is judged if the vapor concentration increase flag XVAPOR is set, the skip number CSKIP is not more than 6, and the purge time count CPGRON is at least 1. At this time, XVAPOR=1 and CPGRON≧1, so if CSKIP<6, the routine proceeds to step 1715, where the difference of the current vapor concentration FGPG minus the vapor concentration FGPGOF immediately before the purge has stopped (FGPG−FGPGOF) is made the correction value KFGPG.

Next, at step 1716, the purge time count CPGRON is incremented by exactly 1. Next, at step 1717, it is judged if the vapor concentration increase flag XVAPOR is set and the purge time count CPGRON is 1. At this time, XVAPOR=1, but CPGRON=2, so the processing cycle ends. At this time, the vapor concentration FGPG is not corrected.

At the next processing cycle, so long as SKIP≦6, the routine proceeds from step 1714 to step 1715, where the correction value KFGPG is updated. When SKIP=6, the learning of the vapor concentration FGPG is substantially completed. Therefore, the correction value KFGPG substantially matches the amount of increase of the vapor concentration FGPG.

Next, assuming that the purge is again stopped and then the purge is restarted, at this time, the vapor concentration increase flag XVAPOR is already set, so the routine proceeds from step 1703 to 1714. At this time, the purge time count CPGRON is zero, so the routine jumps from step 1714 to step 1716. At step 1716, the purge time count CPGRON becomes 1. Therefore, at the next step 1717, it is judged that XVAPOR=1 and CPGRON=1, so the routine proceeds to step 1718, where the already calculated correction value KFGPG is added to the vapor concentration FGPG. Therefore, it is possible to inhibit fluctuation of the air-fuel ratio A/F at the time of restart of the purge.

At the next processing cycle, if CSKIP≦6, the routine proceeds to step 1715, where the correction value KFGPG is again updated.

Figure 49:
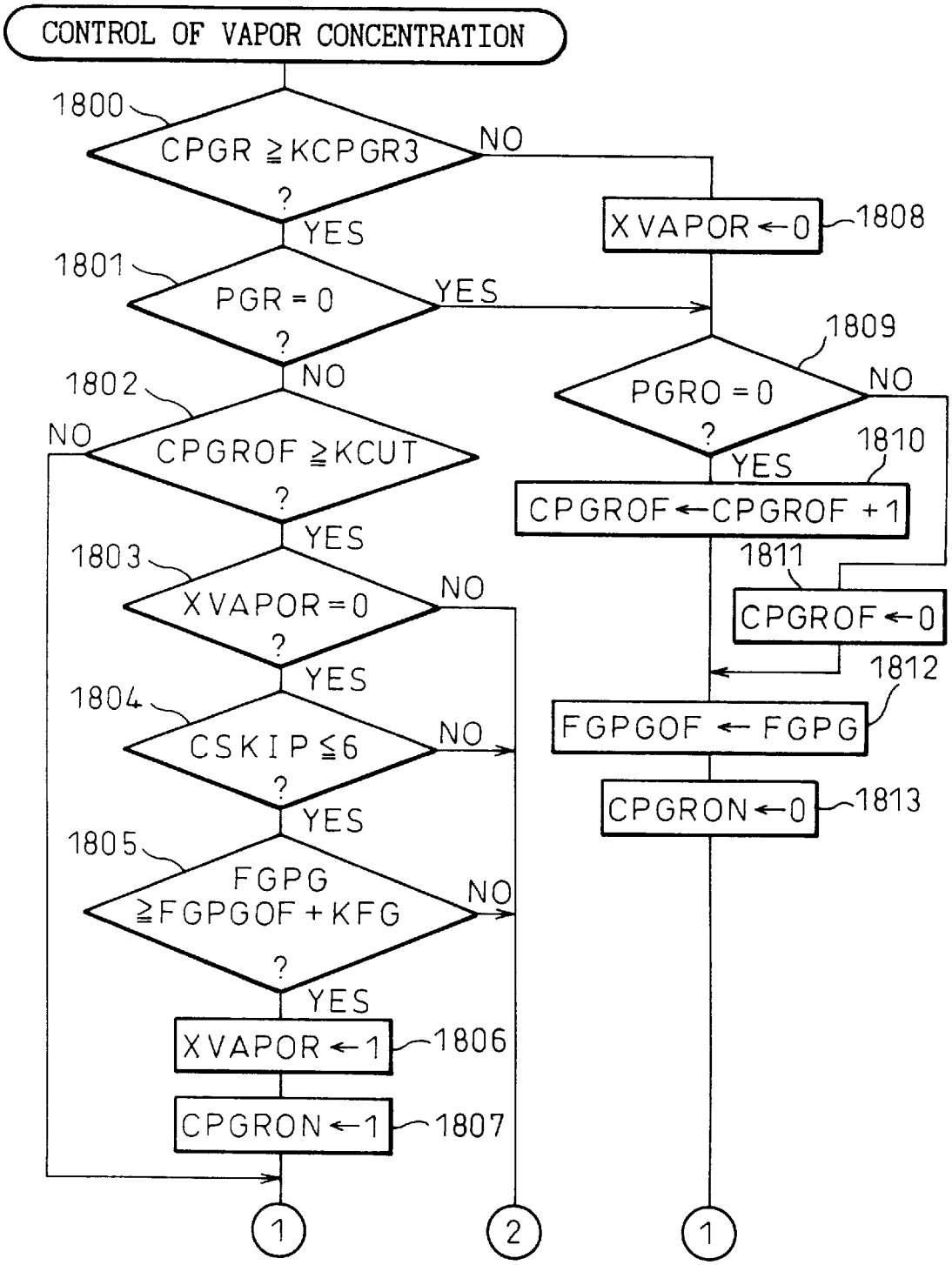
FIGS. 49 and 50 are flow charts of the control of the concentration of vapor in a 17th embodiment.
Figure 50:
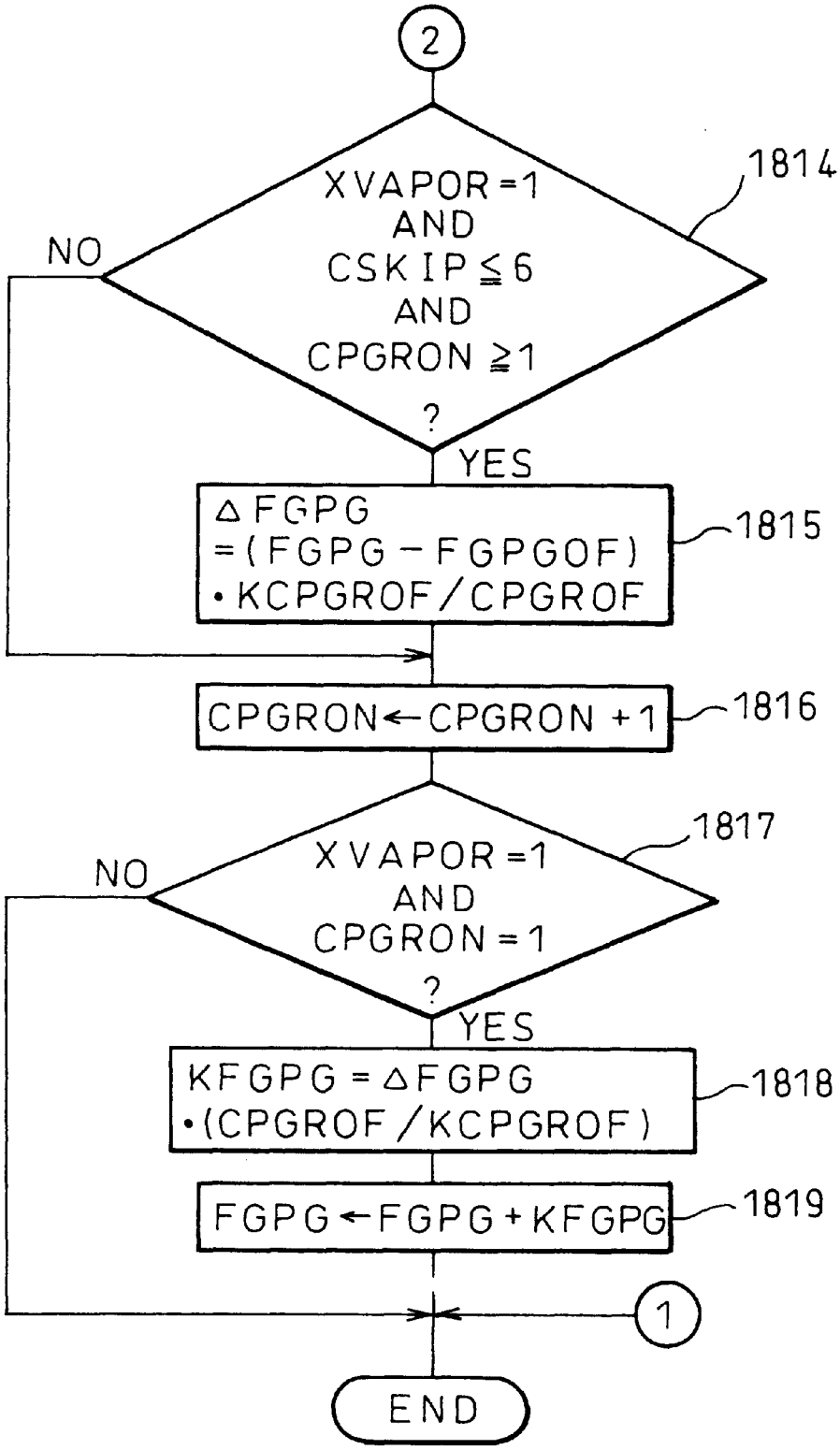

FIG. 49 to FIG. 50 show a 17th embodiment. In this embodiment, the correction value ΔFGPG per unit purge stopping time is found. The final correction value KFGPG, which is proportional to the purge stopping time, is found from this correction value ΔFGPG. Specifically, the final correction value KFGPG is calculated based on the following equation:

$$\Delta FGPG=(FGPG-FGPGOF)\cdot KCPGROF/CPGROF \quad (1)$$

$$KFGPG=\Delta FGPG\cdot(CPGROF/KCPGROF) \quad (2)$$

Here, KCPGROF is the reference purge stopping time, for example, 10 sec.

Explaining this using FIG. 46, CPGROF in equation (1) shows the first purge stopping period I, therefore the correction value ΔFGPG per 10 seconds of purge stopping time is found from equation (1).

As opposed to this, CPGROF in equation (2) shows the second purge stopping period II. Therefore, the final correction value KFGPG is increased the longer the purge stopping time.

FIG. 49 and FIG. 50 shows the routine for control of the vapor concentration. This routine is executed by interruption every predetermined period, for example, every 100 msec. Note that step 1800 to step 1813 of FIG. 49 are the same as step 1600 to step 1613 of FIG. 44. The difference from the routine shown in FIG. 44 and FIG. 45 lies in the part after step 1814 of FIG. 50. The explanation will therefore be made of step 1814 on in FIG. 50.

If, after the start of the purge, FGPG≧FGPGOF+KFG and the vapor concentration increase flag XVAPOR is set, at the next processing cycle, the routine proceeds from step 1803 to step 1814. At step 1814, it is judged if the vapor concentration increase flag XVAPOR has been set, the skip number CSKIP is not more than 6, and the purge time count CPGRON is at least 1. At this time, XVAPOR=1 and CPGRON≧1, so if CSKIP≦6, the routine proceeds to step 1815, where the correction value ΔFGPG per unit purge stopping time is calculated based on the following equation using the current vapor concentration FGPG, the vapor concentration FGPGOF immediately before the purge was stopped, the reference purge stopping time KCPGROF, and the purge stopping time count CPGROF showing the purge stopping time:

$$\Delta FGPG=(FGPG-FGPGOF)\cdot KCPGROF/CPGROF$$

Next, at step 1816, the purge time count CPGRON is incremented by exactly 1. Next, at step 1817, it is judged if the vapor concentration increase flag XVAPOR has been set and the purge time count CPGRON is 1. At this time, XVAPOR=1, but CPGRON=2, so the processing cycle ends. At this time, the vapor concentration FGPG is not corrected.

At the next processing cycle, so long as SKIP≦6, the routine proceeds from step 1814 to step 1815, where ΔFGPG if updated.

Next, assuming that the purge is stopped and then the purge is restarted, at this time, the vapor concentration increase flag XVAPOR is already set, so the routine proceeds from step 1803 to step 1814. At this time, the purge time count CPGRON is zero, so the routine jumps from step 1814 to step 1816. At step 1816, the purge time count CPGRON becomes 1. Therefore, at the next step 1817, it is judged that XVAPOR=1 and CPGRON=1, so the routine proceeds to step 1818, where the final correction value KFGPG is calculated based on the following equation:

$$KFGPG=\Delta FGPG\cdot(CPGROF/KCPGROF)$$

Next, at step 1819, the correction value KFGPG is added to the vapor concentration KFPG. At the next processing cycle, if CSKIP≦6, the routine proceeds to step 1815, where ΔFGPG is again updated.

Figure 51:
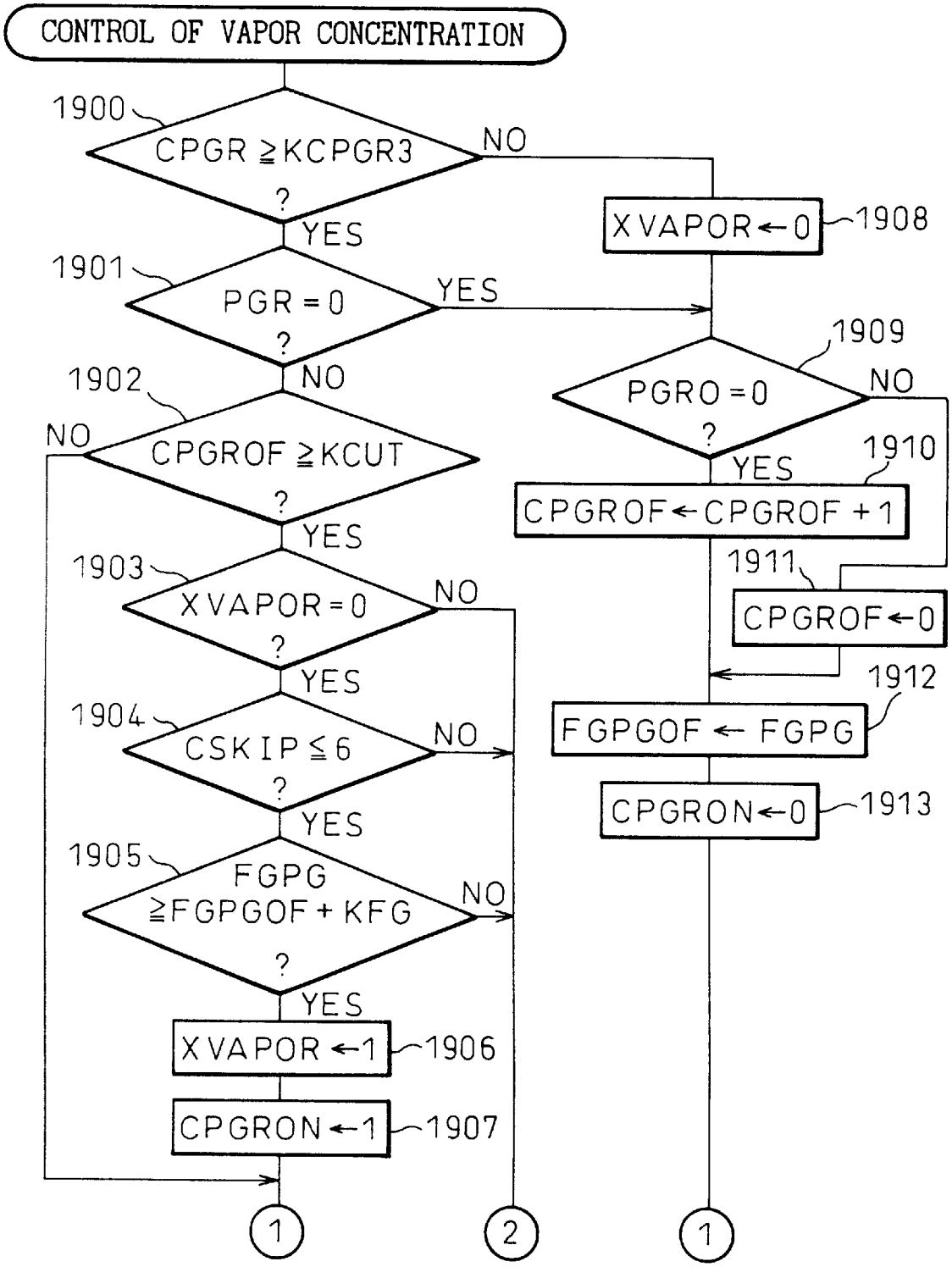
FIGS. 51 and 52 are flow charts of the control of the concentration of vapor in a 18th embodiment.
Figure 52:
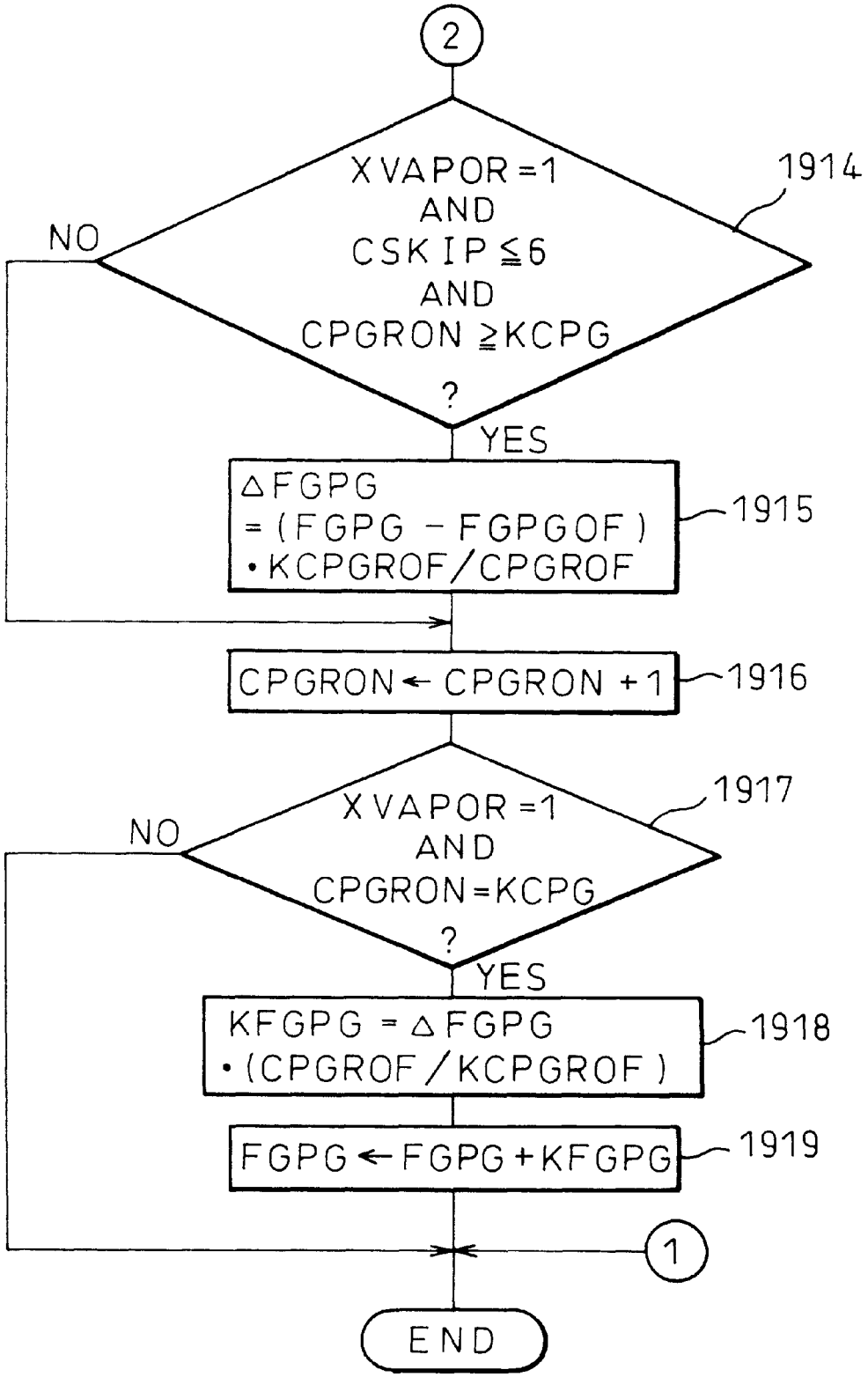

FIG. 51 and FIG. 52 shows an 18th embodiment. In this embodiment, the delay time from when the purge is restarted to when the purged fuel vapor reaches the combustion chamber, the corrective action of the vapor concentration FGPG at the restart of the purge is delayed by exactly a predetermined time until the purge time count CPGRON becomes the predetermined value KCPG.

FIG. 51 and FIG. 52 shows the routine for control of the vapor concentration. This routine is executed every predetermined period, for example, every 100 msec. Note that step 1900 to step 1913 of FIG. 51 is the same as step 1600 to step 1613 of FIG. 44. The difference with the routine shown in FIG. 44 and FIG. 45 lies in the part after step 1914 of FIG. 52, so the explanation will be made below of step 1914 on of FIG. 52.

After the start of the purge, if FGPG≧FGPGOF+KFG and the vapor concentration increase flag XVAPOR is set, at the next processing cycle, the routine proceeds from step 1903 to step 1914. At step 1914, it is judged if the vapor concentration increase flag XVAPOR has been set, the skip number CSKIP is not more than 6, and the purge time count CPGRON is at least KCPG. At this time, XVAPOR=1, but CPGRON is 1, so the routine jumps to step 1916.

At step 1916, the purge time count CPGRON is incremented by exactly 1. Next, at step 1917, it is judged if the vapor concentration increase flag XVAPOR has been set and the purge time count CPGRON is KCPG. At this time, XVAPOR=1, but CPGRON=2 (<KCPG), so the processing cycle ends. At this time, the vapor concentration FGPG is not corrected.

Next, if CPGRON becomes KCPG at step 1916, the routine proceeds to step 1918. When the routine proceeds to step 1918 for the first time after the engine operation is started, ΔFGPG is not yet calculated and ΔFGPG has become zero, so the correction value KFGPG becomes zero. Therefore, even at this time, the vapor concentration FGPG is not corrected.

On the other hand, if CPGRON becomes KCPG, at the next processing cycle, if CSKIP≦6, the routine proceeds from step 1914 to step 1915, where the correction value ΔFGPG per unit purge stopping time is calculated based on the following equation using the current vapor concentration FGPG, the vapor concentration FGPGOF immediately before the purge was stopped, the reference purge stopping time KCPGROF, and the purge stopping time count CPGROF showing the purge stopping time:

$$\Delta FGPG=(FGPG-FGPGOF)\cdot KCPGROF/CPGROF$$

Next, at step 1916, CPGRON becomes KCPG+1, so the routine proceeds to step 1917 and the processing cycle ends.

At the next processing cycle, so long as SKIP≦6, the routine proceeds from step 1914 to step 1915, where the ΔFGPG is updated.

Next, assuming that the purge has again stopped and then the purge is restarted, the vapor concentration increase flag XVAPOR is already set, so the routine proceeds from step 1903 to step 1914. At this time, the purge time count CPGRON is zero, so the routine jumps from step 1914 to step 1916.

Next, at step 1916, if CPGRON becomes KCPG, the routine proceeds from step 1917 to step 1918, where the final correction value KFGPG is calculated based on the following equation:

$$KFGPG=\Delta FGPG\cdot(CPGROF/KCPGROF)$$

Next, at step 1919, the correction value KFGPG is added to the vapor concentration FGPG. That is, when the purge is restarted, when CPGRON has become KCPG after the restart of the purge, that is, a predetermined time after the restart of the purge, the vapor concentration FGPG is corrected. At the next processing cycle, if CSKIP≦6, the routine proceeds to step 1915, where ΔFGPG is again updated.

Figure 53:
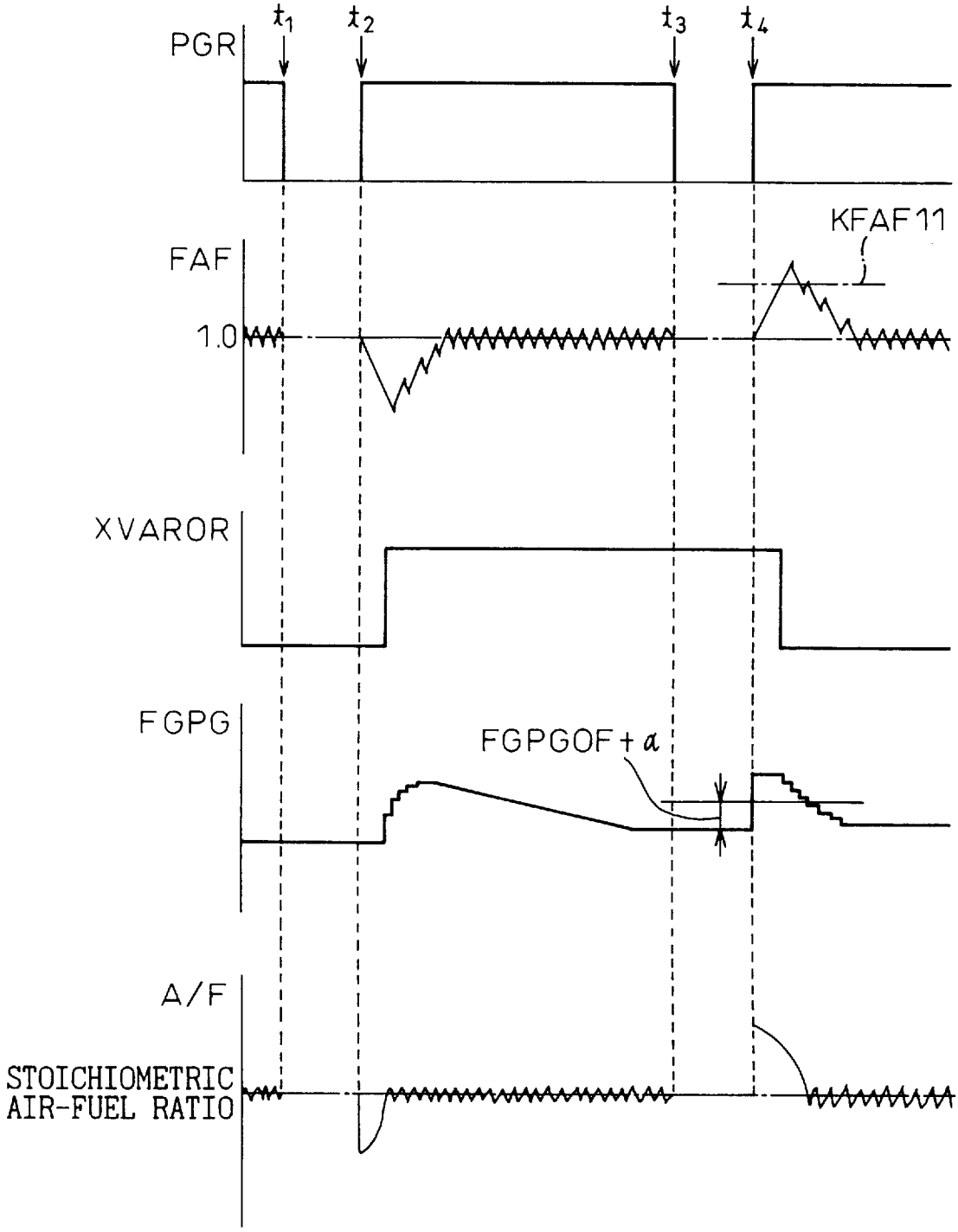
FIG. 53 is a view of the feedback correction coefficient FAF, concentration of vapor FGPG, air-fuel ratio A/F, etc.

Next, an explanation will be given of the case where the vapor concentration increase flag XVAPOR is reset if the correction would become over correction when for example correcting the vapor concentration FGPG when the purge is restarted. FIG. 53 shows the case where the correction would become over correction when the vapor concentration is corrected at the time $t_4$ of the restart of purge. When the correction would become over correction in this way, as shown in FIG. 53, the feedback correction coefficient FAF becomes larger and the vapor concentration FGPG rapidly falls.

Figure 54:
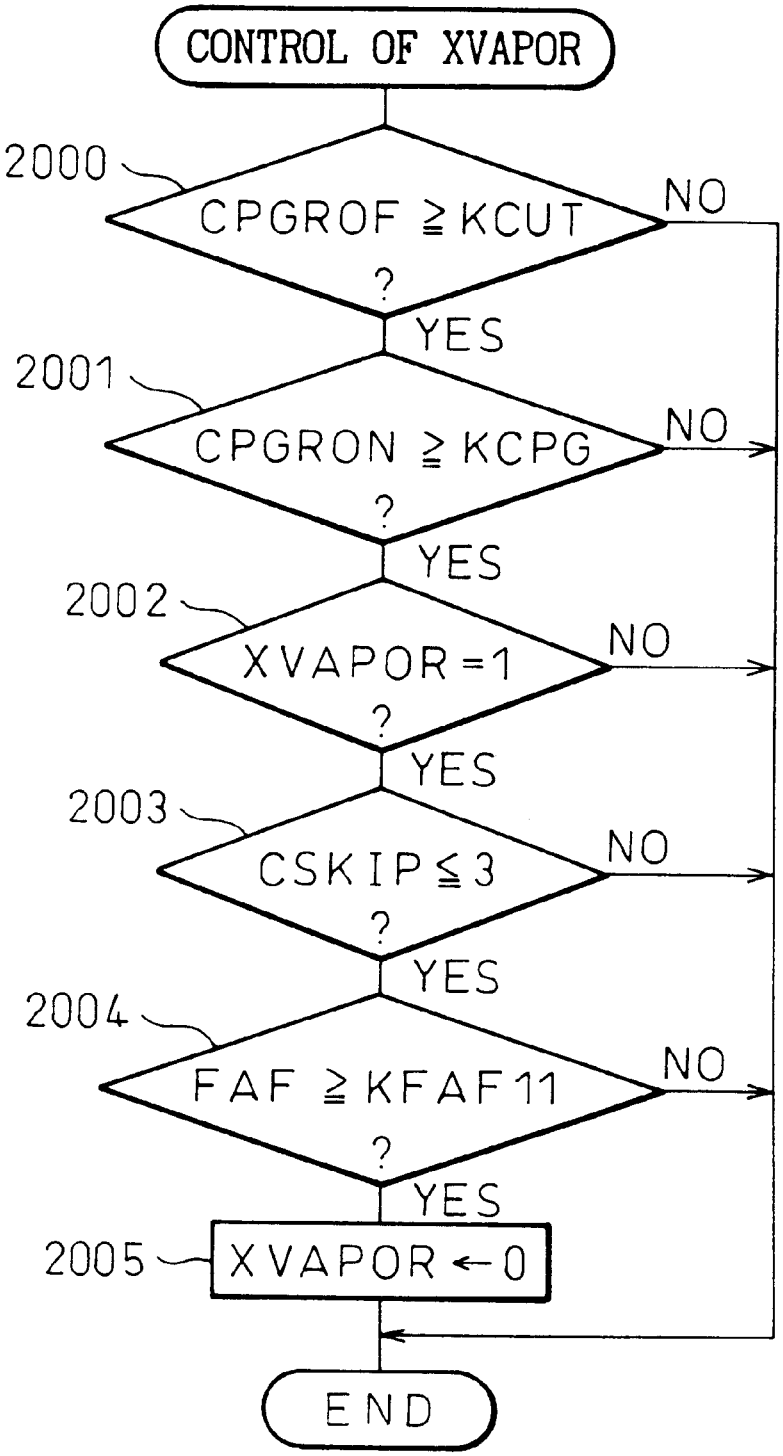
FIG. 54 is a flow chart of the control of a vapor concentration increase flag XVAPOR.

Therefore, in the routine for control of the vapor concentration increase flag XVAPOR shown in FIG. 54, when the feedback correction coefficient FAF exceeds the predetermined value KFAF11, for example, 1.1, within a certain period after the restart of the purge as shown in FIG. 53, it is judged if the vapor concentration increase flag XVAPOR is reset and the vapor concentration of the fuel vapor in the upper space of the fuel tank 15 or the purge passage from the upper space of the fuel tank 15 to the purge control valve 17 while the purge is stopped again has increased or not. In the routine for control of the vapor concentration increase flag XVAPOR shown in FIG. 55, as shown in FIG. 53, when the vapor concentration FGPG has fallen more than the predetermined value FGPGOF+α (α≧0) in a predetermined period after the restart of the purge, it is judged of the vapor concentration increase flag XVAPOR has been reset and the vapor concentration of the fuel vapor in the upper space of the fuel tank 15 or the purge passage from the upper space of the fuel tank 15 to the purge control valve 17 while the purge is stopped again has increased or not.

Referring to FIG. 54, first, at step 2000, it is judged if the purge stopping time count CPGROF has become larger than the predetermined time KCUT or not. When CPGROF≧KCUT, the routine proceeds to step 2001, where it is judged if the purge time count CPGRON is larger than the predetermined time KCPG or not. When CPGRON≧KCPG, the routine proceeds to step 2002, where it is judged if the vapor concentration increase flag XVAPOR has been set or not.

When the vapor concentration increase flag XVAPOR has been set, the routine proceeds to step 2003, where it is judged if the skip number CSKIP of the feedback correction coefficient FAF is not more than 3. When CSKIP≦3, the routine proceeds to step 2004, where it is judged if the feedback correction coefficient FAF has become larger than the predetermined value KFAF11. When FAF≧KFAF11, the routine proceeds to step 2005, where the vapor concentration increase flag XVAPOR is reset.

Figure 55:
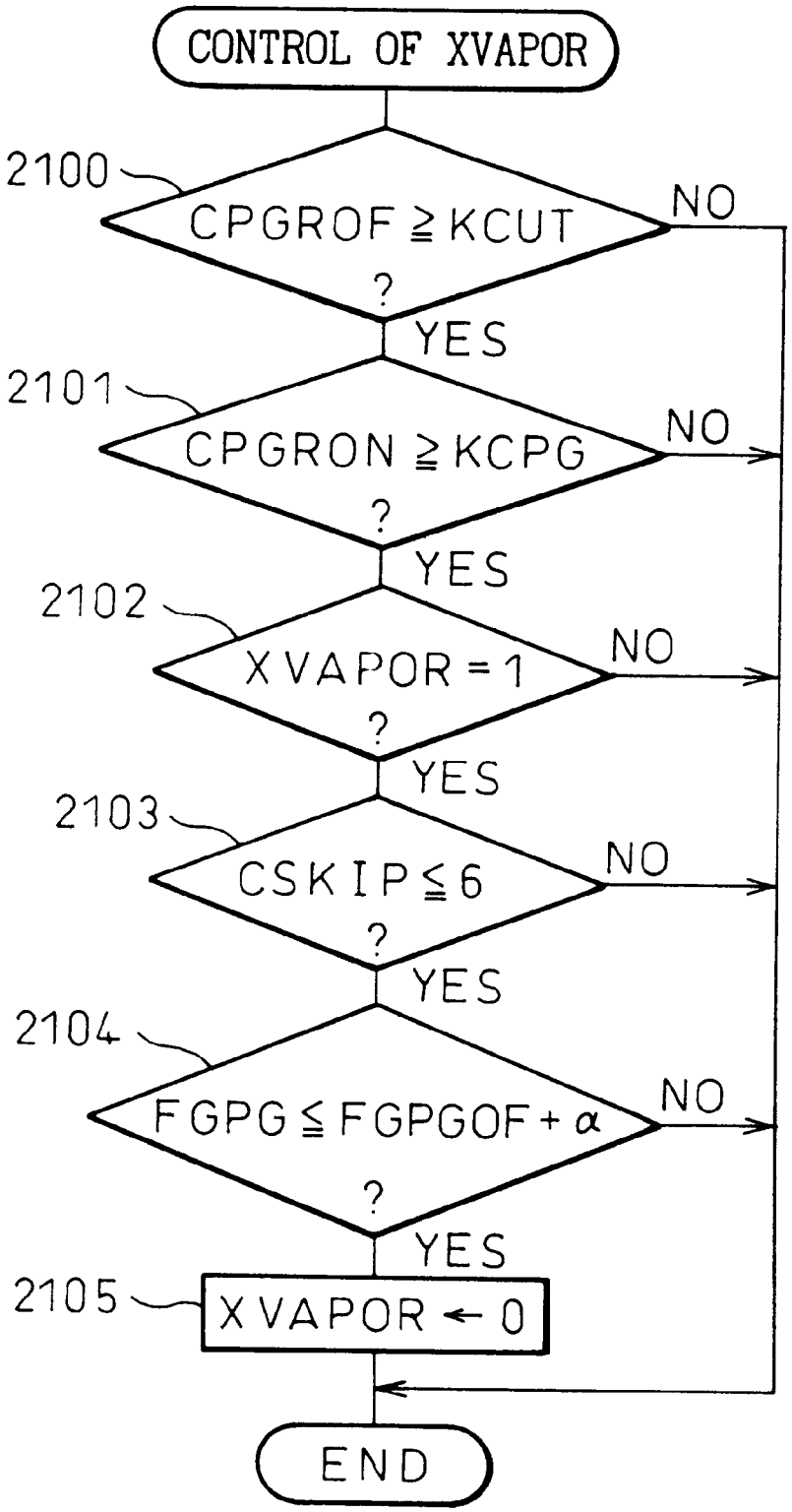
FIG. 55 is a flow chart of another embodiment of the control of a vapor concentration increase flag XVAPOR.

Next, referring to FIG. 55 showing another embodiment, first, at step 2100, it is judged if the purge stopping time count CPGROF is larger than a predetermined time KCUT or not. When CPGROF≧KCUT, the routine proceeds to step 2101, where it is judged if the purge time count CPGRON is larger than the predetermined time KCPG or not. When CPGRON≧KCPG, the routine proceeds to step 2102, where it is judged if the vapor concentration increase flag XVAPOR is set or not.

When the vapor concentration increase flag XVAPOR is set, the routine proceeds to step 2103, where it is judged if the skip number CSKIP of the feedback correction coefficient FAF is not more than 6. When CSKIP≦6, the routine proceeds to step 2104, where it is judged if the vapor concentration FGPG has become smaller than the predetermined value FGPGOF+α. When FGPG≦FGPGOF+α, the routine proceeds to step 2105, where the vapor concentration increase flag XVAPOR is reset.

According to the present invention, as mentioned above, it is possible to inhibit fluctuation of the air-fuel ratio when the purge operation is temporarily stopped and then the purge operation is restarted.

While the invention has been described by reference to specific embodiments chosen for purposes of illustration, it should be apparent that numerous modifications could be made thereto by those skilled in the art without departing from the basic concept and scope of the invention.

What is claimed is:

1. An evaporated fuel treatment device for an engine provided with an intake passage, comprising:

a fuel vapor purge passage connecting an upper space of a fuel tank and the intake passage;

a purge control valve arranged in the purge passage;

air-fuel ratio detecting means for detecting an air-fuel ratio;

first fuel supply correcting means for controlling an amount of fuel supply based on an air-fuel ratio detected by the air-fuel ratio detecting means so that an air-fuel ratio approaches a target air-fuel ratio;

vapor concentration calculating means for calculating an intake passage vapor concentration of fuel vapor supplied to the intake passage based on an amount of deviation of the air-fuel ratio from the target air-fuel ratio;

second fuel supply correcting means for further correcting the amount of fuel supply based on the intake passage vapor concentration so that the air-fuel ratio approaches the target air-fuel ratio; and concentration change detecting means for detecting, while a purge operation is stopped, a change of a purge system vapor concentration of fuel vapor in one of the upper space of the fuel tank and a portion of the purge passage extending between the upper space of the fuel tank and the purge control valve, one of the first fuel supply correcting means and the second fuel supply correcting means correcting the amount of fuel supply in accordance with the detected concentration change so that the air-fuel ratio immediately after a restart of the purge operation becomes the target air-fuel ratio.

2. An evaporated fuel treatment device as set forth in claim 1, wherein the second fuel supply correcting means corrects the intake passaae vapor concentration in accordance with the detected concentration change so that the air-fuel ratio immediately after the restart of the purge operation becomes the target air-fuel ratio.

3. An evaporated fuel treatment device as set forth in claim 2, wherein when the purge system vapor concentration increases, the calculated intake passage vapor concentration is increased.

4. An evaporated fuel treatment device as set forth in claim 2, wherein the concentration change detecting means detects the concentration change based on a pressure in one of the upper space of the fuel tank and the portion of the purge passage extending between the upper space of the fuel tank and the purge control valve.

5. An evaporated fuel treatment device as set forth in claim 2, wherein the concentration change detecting means detects the concentration change based on a temperature in the fuel tank.

6. An evaporated fuel treatment device as set forth in claim 2, wherein, after a start of the engine, the purge operation is first started and then stopped, before the concentration change is detected and the intake passage vapor concentration is corrected in accordance with the concentration change.

7. An evaporated fuel treatment device as set forth in claim 2, wherein, when a stopping period during which the purge operation is stopped is shorter than a predetermined period, correction of the vapor concentration by the second fuel supply correcting means is prohibited.

8. An evaporated fuel treatment device as set forth in claim 1, wherein the first fuel supply correcting means controls the amount of fuel supply based on a feedback correction coefficient which changes in accordance with the detected air-fuel ratio so that the air-fuel ratio becomes a target air-fuel ratio and wherein the first fuel supply correcting means controls the value of the feedback correction coefficient at the time of the restart of the purge operation based on the concentration change so that the air-fuel ratio immediately after the restart of the purge operation becomes the target air-fuel ratio.

9. An evaporated fuel treatment device as set forth in claim 8, wherein the concentration change detecting means detects the concentration change based on a pressure in one of the upper space of the fuel tank and the portion of the purge passage extending between the upper space of the fuel tank to the purge control valve.

10. An evaporated fuel treatment device as set forth in claim 8, wherein, when the purge system vapor concentration increases while the purge operation is stopped, the value of the feedback correction coefficient at the restart of the purge operation is reduced by a predetermined correction value.

11. An evaporated fuel treatment device as set forth in claim 10, wherein, when the pressure in the one of the upper space of the fuel tank and the portion of the purge passage extending between the upper space of the fuel tank and the purge control valve increases while the purge operation is stopped, the correction value is made larger.

12. An evaporated fuel treatment device as set forth in claim 10, wherein, when the vapor concentration calculated by the vapor concentration calculation means increases, the correction value is made smaller.

13. An evaporated fuel treatment device as set forth in claim 10, wherein, when a purge rate of the fuel vapor decreases, the correction value is made smaller.

14. An evaporated fuel treatment device as set forth in claim 8, wherein, when the purge system vapor concentration increases while the purge operation is stopped, the value of the feedback correction coefficient when the purge operation is restarted is reduced in a plurality of stages by a predetermined correction value.

15. An evaporated fuel treatment device as set forth in claim 8, wherein when the purge system vapor concentration increases while the purge operation is stopped, the value of the feedback correction coefficient when the purge operation is restarted is reduced in a plurality of stages by a predetermined correction value until the air-fuel ratio becomes lean.

16. An evaporated fuel treatment device as set forth in claim 8, wherein when the purge system vapor concentration increases while the purge operation is stopped, the value of the feedback correction coefficient is reduced by a predetermined correction value only when one of the following conditions exists: a purge execution time after a start of the engine is longer than a predetermined time; a purge rate of the fuel vapor is higher than a predetermined purge rate; an opening degree of the purge control valve is larger than a predetermined opening degree; an amount of intake air is smaller than a predetermined amount; and a number of updates of the purge system vapor concentration is larger than a predetermined number.

17. An evaporated fuel treatment device as set forth in claim 8, wherein, when the purge system vapor concentration increases while the purge operation is stopped, a predetermined time after the restart of the purge operation the value of the feedback correction coefficient is reduced by a predetermined correction value.

18. An evaporated fuel treatment device as set forth in claim 1, wherein the concentration change detecting means detects the concentration change based on a in one of the air-fuel ratio and the intake passage vapor concentration when the purge operation has been started and wherein the second fuel supply correcting means corrects the intake passaae vapor concentration based on the concentration change so that the air-fuel ratio becomes the target air-fuel ratio when the purge operation is subsequently stopped once and the purge operation is restarted.

19. An evaporated fuel treatment device as set forth in claim 18, wherein, when the purge system vapor concentration increases while the purge operation is stopped, when the purge operation is restarted after being stopped once, the intake passage vapor concentration is increased by exactly a predetermined correction value.

20. An evaporated fuel treatment device as set forth in claim 19, wherein, when the air-fuel ratio at the start of the purge operation is smaller than a predetermined air-fuel ratio, it is judged that the purge system vapor concentration has increased while the purge operation was stopped.

21. An evaporated fuel treatment device as set forth in claim 19, wherein, when it is judged that the intake passage vapor concentration has exceeded a predetermined concentration in a predetermined period after the start of the purge, it is judged that the purge system vapor concentration has increased while the purge operation was stopped.

22. An evaporated fuel treatment device as set forth in claim 21, wherein, when it is judged that the purge system vapor concentration has increased while the purge operation was stopped, the correction value is calculated as a value proportional to a difference obtained by subtracting a first value of the intake passage vapor concentration immediately before the purge operation was stopped from a second value of the intake passage vapor concentration during a predetermined period after the start of the purge operation.

23. An evaporated fuel treatment device as set forth in claim 21, wherein, when it is judged that the purge system vapor concentration has increased while the purge operation was stopped, the correction value is calculated based on a difference obtained by subtracting a first value of the intake passage vapor concentration immediately before the purge operation was stopped from a second value of the intake passage vapor concentration during a predetermined period after the start of the purge operation and a purge stopping period during which the purge operation is subsequently stopped again and wherein the correction value is proportional to the difference and proportional to the purge stopping period.

24. An evaporated fuel treatment device as set forth in claim 19, wherein, when the air-fuel ratio is smaller than a predetermined air-fuel ratio when the intake passage vapor concentration has been increased by exactly the predetermined correction value, the intake passage vapor concentration is increased by exactly a predetermined amount each time the purge operation is restarted until the air-fuel ratio exceeds a predetermined air-fuel ratio after the intake passage vapor concentration has been increased by the correction value, and wherein, when the air-fuel ratio exceeds the predetermined air-fuel ratio after the intake passage valpor concentration has been increased by the correction value, it is again judged whether the vapor concentration should be corrected when the purge operation is next stopped and then restarted and, based on this judgement, the intake passage vapor concentration is corrected when the purge operation is next stopped and then restarted.

25. An evaporated fuel treatment device as set forth in claim 19, wherein, when the intake passage vapor concentration remains larger than a predetermined concentration for a predetermined period after the intake passage vapor concentration has been increased by the correction value, the intake passage vapor concentration is increased by exactly a predetermined amount every time the purge operation is restarted and wherein when, during a predetermined period after the intake passage vapor concentration has been increased by the correction value, the intake passage vapor concentration has become smaller than a predetermined concentration, it is again judged whether the intake passage vapor concentration should be corrected when the purge operation is next stopped and then restarted and, based on this judgement, the intake passage vapor concentration is corrected when the purge operation is next stopped and restarted.

26. An evaporated fuel treatment device as set forth in claim 18, wherein, when the purge system vapor concentration increases while the purge operation is stopped, the intake passage vapor concentration is increased by exactly a predetermined correction value a predetermined time after the purge operation is subsequently stopped once and then restarted.

27. An evaporated fuel treatment device as set forth in claim 18, wherein the second fuel supply correcting means corrects the intake passage vapor concentration and wherein, when a stopping time during which the the purge operation is stopped is shorter than a predetermined period, correction of the intake passage vapor concentration by the second fuel supply correcting means is prohibited.

* * * * *

UNITED STATES PATENT AND TRADEMARK OFFICE

CERTIFICATE OF CORRECTION

PATENT NO. : 6,095,121
DATED : August 1, 2000
INVENTOR(S) : Akinori Osanai

It is certified that error appears in the above-identified patent and that said Letters Patent is hereby corrected as shown below:

Column 7,
Line 42, delete “once”.

Column 25,
Line 32, change “FGPG≤FGPOF…” to -- FGPG≥FGPOF… --.

Column 30,
Line 28, change “passaae” to -- passage --.

Column 31,
Line 60, delete “a in”.

Signed and Sealed this

Twenty-ninth Day of April, 2003

JAMES E. ROGAN
*Director of the United States Patent and Trademark Office*